US011247814B2

(12) United States Patent
Munoz

(10) Patent No.: US 11,247,814 B2
(45) Date of Patent: Feb. 15, 2022

(54) TRAVEL BAG AND FOAM ROLLER

(71) Applicant: Alfredo Munoz, Jersey City, NJ (US)

(72) Inventor: Alfredo Munoz, Jersey City, NJ (US)

( * ) Notice: Subject to any disclaimer, the term of this patent is extended or adjusted under 35 U.S.C. 154(b) by 488 days.

(21) Appl. No.: 16/234,563

(22) Filed: Dec. 28, 2018

(65) Prior Publication Data

US 2019/0135490 A1 May 9, 2019

Related U.S. Application Data

(63) Continuation of application No. 15/295,418, filed on Oct. 17, 2016, now abandoned.

(51) Int. Cl.

| | |
|---|---|
| ***A45C 13/30*** | (2006.01) |
| ***B65D 25/28*** | (2006.01) |
| ***A45C 3/00*** | (2006.01) |
| ***A45C 7/00*** | (2006.01) |
| ***A45F 3/00*** | (2006.01) |
| ***A45F 3/02*** | (2006.01) |
| ***A45F 3/04*** | (2006.01) |
| ***A45C 9/00*** | (2006.01) |

(52) U.S. Cl.

CPC ..... *B65D 25/2873* (2013.01); *A45C 3/001* (2013.01); *A45C 3/004* (2013.01); *A45C 7/0077* (2013.01); *A45C 9/00* (2013.01); *A45C 13/30* (2013.01); *A45F 3/005* (2013.01); *A45F 3/02* (2013.01); *A45F 3/04* (2013.01); *A45C 2003/007* (2013.01); *A45C 2003/008* (2013.01); *A45F 2003/008* (2013.01); *A45F 2200/0566* (2013.01); *A45F 2200/0583* (2013.01)

(58) Field of Classification Search

CPC ..... A45F 3/005; A45F 2200/0566; A45F 2003/008; A45F 3/02; A45F 3/04; B65D 25/2873; A45C 3/004; A45C 3/30; A45C 13/30; A45C 7/0077; A45C 9/00; A45C 2003/07; A45C 2003/08; A61H 15/00; A61H 37/00

USPC ..... 206/278

See application file for complete search history.

(56) References Cited

U.S. PATENT DOCUMENTS

| | | | | |
|---|---|---|---|---|
| 1,688,764 | A | 10/1927 | Trankowski et al. | |
| 1,811,574 | A * | 6/1931 | Barrett | A47G 7/085 206/423 |
| 2,546,095 | A | 3/1951 | Gustlin | |
| 3,662,748 | A | 5/1972 | Thurman | |
| 4,070,719 | A | 1/1978 | Morgan | |
| 4,109,649 | A | 8/1978 | Iyomasa | |
| D285,117 | S | 8/1986 | Snyder | |
| 5,307,908 | A | 5/1994 | Shyr et al. | |
| 6,612,453 | B2 * | 9/2003 | Joo-Tai | A45C 7/0077 220/9.2 |
| 7,084,357 | B2 * | 8/2006 | Roberts | A45C 15/00 177/131 |
| D660,450 | S | 5/2012 | Johnson | |
| D713,050 | S | 9/2014 | Kao | |
| D714,952 | S | 10/2014 | Gonglach et al. | |

(Continued)

*Primary Examiner* — Sue A Weaver

(57) ABSTRACT

The disclosure provides a transportation bag particularly suitable for carrying articles that can be rolled-up such as yoga-pilates mats, elongated articles such as instruments, toys, or bottles as well as, blueprints or garments such as suits or shirts. The bag may be used as a foam roller when not being used for transportation. The disclosure further relates to methods of storing, packing, and displaying rolled yoga mats and garments.

20 Claims, 34 Drawing Sheets

(56) References Cited

U.S. PATENT DOCUMENTS

| | | | | |
|---|---|---|---|---|
| 8,926,482 | B2 | 1/2015 | Miller, Jr. | |
| 9,005,146 | B2 | 4/2015 | Phillips | |
| 9,039,641 | B1 | 5/2015 | Johnson | |
| D744,112 | S | 11/2015 | Phillips et al. | |
| D749,233 | S | 2/2016 | Phillips | |
| 9,320,675 | B2 | 4/2016 | Johnson | |
| 2002/0186901 | A1* | 12/2002 | Lin | A45C 7/0063 383/104 |
| 2011/0073425 | A1* | 3/2011 | Siu | A45C 7/0077 190/101 |
| 2012/0065557 | A1 | 3/2012 | Phillips | |
| 2012/0310125 | A1 | 12/2012 | Hall et al. | |
| 2014/0128786 | A1 | 5/2014 | Ross | |
| 2015/0283023 | A1* | 10/2015 | Phillips | A63B 23/03541 601/118 |
| 2017/0156479 | A1* | 6/2017 | Kwong | A45F 4/02 |

* cited by examiner

100

TRAVEL BAG AND FOAM ROLLER

This application is a continuation of U.S. patent application Ser. No. 15/295,418 filed Oct. 17, 2016 the entire disclosure of which is incorporated by reference herein.

The application Ser. No. 15/295,418 claims the benefit of U.S. Provisional Application Ser. No. 62/247,749, filed Oct. 29, 2015, the entire disclosure of which is incorporated by reference herein. This application also claims the benefit of U.S. Provisional Application Ser. No. 62/362,041, filed Jul. 14, 2016.

FIELD OF THE INVENTION

The present disclosure relates to a travel bag and transportation bag particularly suitable for carrying elongated articles such as instruments, toys, weapons or bottles as well as articles that can be rolled-up such as yoga-pilates mats (yoga mats, pilates mats or mats that may be used for both yoga and pilates), blueprints or garments such as suits or shirts. The bag may be used as a foam roller when not being used for transportation. The disclosure further relates to methods of storing garments and to methods of displaying garments.

BACKGROUND

Traveling by necessity or pleasure is constantly increasing. Moreover, in cities, usually people commute to work or to do different activities. Hence, the need of transport elements or bags that are practical as well as attractive is constantly increasing.

Transport articles such as bags or suitcases traditionally have no use once they have fulfilled the transportation task. This means that when they are not being used they occupy an unusable space.

Some known bags or pieces of luggage are able to reduce their size and geometry once the transportation function is ended. However, these bags are still unusable (i.e. do not fulfil a function) once they are reduced, and thus still occupy an unusable space. The unusable space is just smaller than when the bags or pieces of luggage are not able to reduce their size.

A further concern nowadays is the constantly increasing use of "gadgets", especially electronic gadgets such as mobile phones, chargers, speakers, mirrors, notebooks, tablets or similar that also require space when they are not in use. These articles are usually transported in an additional or separate piece of luggage. However, travelling with various pieces of luggage is rather cumbersome Furthermore, transportation of suits, jackets, dresses and garments in general normally involve special packing care to avoid wrinkling of the garments. It is known to transport these products separately in one or more bags making travel more difficult and cumbersome. In order to reduce the folding time of garments it is also known to pack garments in foldable suitcases. However, known foldable suitcases are bulky and unhandy to carry, particularly because they have a substantially flat shape that makes them e.g. unstable in winds and difficult to carry in crowds. In fact, such bulky pieces of luggage are usually unsuitable for carry-on items thereby defeating the purpose of keeping the garment bag with the traveler. And still these foldable pieces of luggage do not have a further use once the transportation is ended.

In addition, in the world of "fitness", yoga or pilates a mat or the like that is usually accompanied by other elements such as incense sticks, jump ropes, resistance bands, sculpting resistance bands, fitness trackers and boards with texts inspirational motives, colours or patterns of drawings and textures or sculptures to aid concentration usually need to be transported. These mats are usually transported under the arm. This complicates using the hands for other nowadays necessities such as writing on the phone, eating while travelling, or even carrying other things. It is known to embrace the mats with e.g. bandoliers or other types of straps. However, these straps may carry the mat but still need the use of further space for their storage and they do not provide protection to the mat. A similar situation arises with e.g. big towels used in beaches and pool areas.

The transport of these bulky articles usually goes against combining activities such as fitness, pilates, yoga or pool with subsequent activities that may require more formal attire like a dinner or a concert. In a typical situation, a mat may not be able to be carried to formal events.

Foam rollers, used for myofascial release, traditionally have no use once the training is over. This means that when they are not being used they occupy an unusable space. Current foam rollers might have different densities or the same density all over the roller. In some cases such rollers are a tube comprised of one material and in others a main hollow core is covered with a second material that is the one that acts as the massage area for the myofascial release. Some rollers have a flat surface and others have textured foam. In any case such rollers traditionally use materials that are petrol-based, specially plastics, which have a bad performance from the environmental point of view. Although some of such materials could be recycled, they still do not meet the best environmental standards due to the own nature of the material used. Some of such foam materials are EVA (Ethylene vinyl acetate), EPE (Expanded Polyethylene Foam), PVC (Polyvinyl chloride), rubber or Styrofoam. The solutions that provide a hollow, rigid and elongated core with a cylindrical shape often use the same materials for such core, such as PVC tubes, PPE (polyphenylene) tubes or other similar kind of plastic tubes. In addition, there is a need in the art for a foam rollers that uses environmentally friendly materials and that also acts as a bag for transportation of elongated articles while providing different levels of protections from the weather or from the access of unauthorized people to the inside of the bag. These and other features and advantages of the present invention will be explained and will become obvious to one skilled in the art through the summary of the invention that follows.

It is an object of the present disclosure to provide a travel or transportation bag, particularly suitable for elongated articles that at least partially overcome some of above mentioned drawbacks.

SUMMARY OF THE INVENTION

In a first aspect, a travel bag is disclosed. The travel bag comprises a main body extending from a first end to a second end, and configured to assume an extended configuration for transportation of one or more elongated articles, and a compressed configuration for use other than transportation of the elongated article. A distance between the first end and the second end is larger in the extended configuration than in the compressed configuration.

According to this aspect, a travel bag being extendable is provided. This means that the travel bag provides at least two different geometries that may be used differently. Firstly, the extended configuration that is suitable for transportation of an elongated article and, secondly, the compressed configuration that may be used for different alternatives that will be described later on. The extended configuration may thus be defined as a function of the elongated article to be transported.

As used herein, an elongated article encompasses in particular a long and slender article. In some cases the article per se may be slender. In others, it may acquire a tubular/cylindrical (slender) condition once it is e.g. rolled-up. Examples of long and slender articles may be musical instruments, tools, toys, guns or even bottles. Examples of articles that may be rolled-up and become slender may be yoga-pilates mats, towels, papers and documents, inflatable mattresses or garments such as suits, jackets, pants, coats, dresses, kanduras, thawbs, dishdashas, saris, kimonos, cheongsams, shirts, ties or any other piece of clothing that requires transportation and may be subject to wrinkling.

As will be explained in the remainder of the present disclosure, the travel bag may be designed for several different used. Also, the travel bag may have different main bodies, and may include various additional elements, such as lids, handles or elements allowing grabbing and manipulation, or closure elements. Many possible variants and possibilities will be explained in the following non-exhaustive description.

In some examples, the travel bag may further comprise a first lid extending from an inner open end to an outer closed end, and a second lid extending from an inner open end to an outer closed end. In these cases, in the extended configuration, the main body first and second ends may be respectively connected to the inner open ends of the first and second lids such that a substantially elongated storage housing is defined within the main body, and in the compressed configuration, the second lid inner end may be connected to the first lid inner end to define an alternative storage housing that may be smaller than the elongated storage housing within the outer ends of the first and second lids.

In these examples, the possibility of the bag to change its geometry and define housings of different sizes permits the transportation of the elongated article and the introduction of less volumetric articles when it is not being used for transportation of the elongated article. A function to an object that usually would be stored occupying a valuable space is thus provided. The possibility of losing other articles can also be reduced by storing them in the smaller housing. Or what is equivalent, this involves that the same object that initially was linked to the transportation of an article can later on be used, either separated (e.g. each lid separately) or assembled (e.g. the two lids connected to each other to define the minimum housing) for other purposes thus combining a single object (the bag) with different uses besides the original use. This contributes to reducing space occupancy, improving logistics, being cost-effective and adapting to fast changing needs in society.

In some examples, the bag may be in such a way that distance between an open end and a closed end of the first and/or second lids is minimal such that they substantially define two opposite surfaces of a substantially flat element. In some other examples the first lid may comprise a substantially flat nature and the second lid may also comprise a substantially flat nature such that in the extended configuration the substantially elongated storage housing can be defined and in the compressed configuration a substantially flat object can be defined.

In some examples, one or more of such lids may be fully removable from the main body while in other examples one or more lids may be partially fixed to the main body. The connection between the lids and the main body in the areas that are not permanently attached may differ depending on the use but could consist of zips, male-female connectors, magnets, pressure fitting, friction fitting, snap fit connectors, clip connectors, latches, buckle connectors, electronic connectors, biometric or other password locks of any kind, rubber connectors, threads, clamps or other mechanical-based connectors, e.g. Velcro® (a hook/loop fastener). In some examples the connectors may be located at the inner end of the lids while in other examples the connectors may be located at the outer end of the lids. In some examples the connectors may be located at lateral sides of the lids. In other examples the connectors may be located in a combination of the positions hereinbefore.

In some examples, one or more lids may be fully removable from the main body while in other examples one or more lids may be partially fixed to the main body.

In some examples, the first and second lids may be provided with corresponding connectors for establishing a detachable connection between each other. In some examples, the connectors may be provided at their inner ends. In others, they may be provided at outer surface of the lids. Combinations thereof may also be possible.

In some examples such lids may physically and directly touch each other while in other examples the lids may not have a direct physical contact between each other and may just be connected through one or more appropriate corresponding connectors.

In some cases, the connectors may be selected from the group consisting of zippers, male-female connectors, magnets, knots, clasps, hooks, staples, screws, rings, straps, pressure fittings, friction fittings, snap fit connectors, clip connectors, latches, buckle connectors, electronic connectors, biometric or other password locks of any kind, rubber connectors, threads, clamps or other mechanical-based connectors, e.g. Velcro®. In some cases, the connectors may be removable from any of the lids or even the main body. In others, they may be fixed. Combinations thereof may also be foreseen. The selection of the type connector used for establishing the detachable connection between the two lids may depend on the final intended use for the bag in the compressed configuration. In an example, the bag may be used as a handbag and the connector may thus be selected so as to provide a safe and elegant closure.

In some examples, one or more of the outer ends of the first and second lids or the lids as such may comprise an outer surface that allows the possibility of incorporating features such as texts, diagrams, textures, drawings and patterns, technical or installation descriptions, bar codes, QR codes, art representations, logos or specific colours located at their outer close ends. These features may have great use for logistics, tagging, tracking, etc. Such features may be used for marketing or for inspirational or motivational purposes as they may support with concentration, guidance of a particular activity or attitude during activities such as meditation or physical exercise among others. Such lids (or lid outer surfaces) may include other elements that may also be flat in nature but that may include a specific use, like digital screens, electronic ink displays, note boards, mirrors of different types, touch devices or similar.

In some examples, both lids may be flat. In these cases, the bag in the compressed configuration may only allow storage of objects of a flat nature such as coins, bills, keys or cards. In other examples having both lids flat the bag may not provide any possibility of extra storage while in its compressed configuration but the features located at the lids outer surface may provide a further second use totally different to the transportation activity associated with the extended configuration.

In more examples, one or more of the lids may be of a solid nature, i.e. the inner open end is filled with the same material as the outer closed end. In these examples, the lids, either independently or in combination (in the compressed configuration) may have a totally different use as that of the bag in the extended configuration (transportation). Examples of such uses may be yoga blocks, portable benches, step platforms, (inflatable) fitballs, balance trainers, etc.

In more examples, one or more of the lids may comprise one or more perforations at their outer closed end to allowing air to pass through. This way ventilation during transportation is achieved thus avoiding overheating of the transported article. Ventilation may be required for transportation of e.g. special instruments, guns, toys or liquids.

In more examples, one or more of the outer ends of the first and second lids may comprise an outer surface that may be flat or irregular in shape. In these cases, the outer surface may be provided with a sculpture, an incense burner or pray shrines or combinations thereof. These examples may be of interest e.g. in the world of "fitness", yoga and/or pilates in which the transport of a mat that may be rolled-up to become an elongated article may be combined with e.g. the burning of incense or exposure of sculptures that are usually used in these activities for concentration and inspiration. In more examples, an outer surface the first and/or second lids may be coloured or may be covered by features such as patterns of drawings, inspirational motives or texts and/or textures that may also help concentration during these activities.

In some examples, one or more of the first and second lids may comprise one or more power sources selected from batteries, photovoltaic chargers, piezoelectric or kinetic chargers or any other portable energy device or power source able to charge a user electronic device. This provides the bag with further alternative uses when its transportation use is over. In some cases, the bag may also use any of these power sources when it is carrying the elongated article, i.e. when the main body is in the extended configuration. In an example, the power source may be used to power lights, speakers, digital screens or other electrical components that may be incorporated into the bag. Similarly, the power source may be used to charge or provide power to external devices such as mobile computing devices, portable hair dryers, electric razor, or other electrical devices.

In some examples, one or more of the first and second lids may comprise one or more electronic or digital device selected from speakers for connecting to external or internal audio sources, media player, lights, or GPS geolocation. This provides the bag with further alternative uses when its transportation use is over. In some cases, the bag may also use any of these electronic or digital components when it is carrying the elongated article, i.e. when the main body is in the extended configuration.

In some examples, the main body may be made of a flexible and foldable material. In some of these cases, the main body may fit inside the minimum storage housing defined by in the compressed configuration of the examples comprising lids. In some examples the main body may extend due to the weight of the lower lid. In other examples, the main body may further be provided with one or more rods describing a substantially helical shape to allow instant twist and fold of the main body. This permits a substantially instant set-up and fold-down of the main body thus transforming the bag from the extended configuration to the compressed configuration (and vice versa) in a rather simple and fast way, similarly to igloo tents or tipi tents. In more examples, the main body may consist of a flexible structure with parallel sections that are rigid or semi-rigid and that compress next to each other, similar to an accordion, in which case the main body provides a similar transformative nature as the helical solution explained above. In more examples, the same transformative configuration may be provided by a main body that contains folding lines that allow the main body to compress in a three-dimensional matter, similar to origami.

In some examples, one or more of the lids may be provided with a fastening system for attachment of a handle system. This enhances portability of the bag. In more examples, a fastening system for attachment of a handle may be provided in the main body, either in a fixed or removable manner. In yet more examples, handle systems may be attached to the main body and one or more of the lids. The fastening system may be provided internally or externally or combinations thereof, depending on the further intended use for the bag in the compressed configuration. In the examples where there is a removable fastening system the connection may be selected from knots, clasp, hook, staple, screws, clips, rings, straps, Velcro®, male-female systems, magnetic solutions, zippers, male-female connectors, pressure fitting, friction fitting, snap fit connectors, clip connectors, latches, buckle connectors, electronic connectors, rubber connectors, threads, clamps or other mechanical-based connectors, e.g. Velcro®.

In some examples, the handle system may be adjustable in length. This ensures adaptability of the handle system to the different size of people and also allows different handling postures or conditions, e.g. hand bag or bandolier. In more examples, multiple handle systems may be provided. Such carrying elements may comprise, but are not limited to, handles, handle straps, collapsible pull handles, shoulder straps, back-pack straps, bandoliers, cords, grips, hooks, or similar elements. They may be fixed or adjustable e.g. in length. In some examples, extra storage areas may be provided in one or more of the handle systems. In some examples, one or more of the handle system may have a further use once the transportation of the elongated article is finalized. The further use of one or more of the handle systems may comprise, for example, jumping rope, resistance bands, sculpting bands, or similar.

In alternative examples, the main body and the lids may be integrally formed. A handle system substantially as hereinbefore described may further be included.

In some examples, the main body may be made of a substantially rigid or semi-rigid material and may comprise a plurality of folding lines arranged substantially perpendicular to a longitudinal axis of the main body. In these cases, in the extended configuration the main body may be folded at a portion of the folding lines such that a substantially elongated storage housing is defined within the main body, and, in the compressed configuration, the main body may be folded at all or at a portion of the folding lines. In other cases the folding is such that in the compressed configuration the main body is folded so as to define a geometry that is different to that of the extended configuration. In these cases, in the compressed configuration the resulting bag has a geometry and volume that allows for a secondary use. In examples, such secondary use may be a concentration board or a pin-up board where different yoga cards with postures or training exercises may be placed. Such a secondary use may also be an alternative bag to carry other (and smaller) things different to the elongated article, such as shoes, a mobile phone and other articles once the yoga mat that has been transported using the extended configuration. In these examples, the extended configuration may leave the elongated article being transported exposed to the outside without a full cover.

In some examples, the plurality of folding lines at the main body may be arranged in a triangular or trapezoidal manner so the main body folds in a similar manner as origami. In some of these cases, the main body may fold in a tubular shape to define the extended configuration thus defining a shell for the elongated article to be transported. In some examples, the extended configuration may be maintained through connectors provided in the main body or through external connectors such as latches or ropes. In these cases, one or more of the connectors may be fixedly attached to the main body or they may be removable. In some cases, the connectors may be selected from zips, male-female connectors, magnets, pressure fitting, friction fitting, snap fit connectors, clip connectors, latches, buckle connectors, electronic connectors, biometric or other password locks of any kind, rubber connectors, threads, clamps or other mechanical-based connectors, e.g. Velcro®. In some examples, one or more lids substantially as hereinbefore described may be provided to physical close the housing wherein the elongated article is to be transported when the main body is in the extended configuration. In some examples, handle system may also be added to the main body to ease transportation.

In some of these examples, the main body may be provided with holes or eyelets. In these cases, the holes and/or eyelets may be configured to receive a back-pack handle system. This ensures a hands free transportation of the elongated article. In alternatives, the handle system may comprise a single strap or one or more handles. In some alternatives, a foldable handle system may be provided such that it may be directly defined by the folding of the main body while in other alternatives a separate handle system may be attached to the main body. In some particular case, the bag may be such that the main body comprises four or more pairs of holes or eyelets, wherein in the extended configuration two pairs are arranged at opposite sides of the main body and at the same first height along the longitudinal axis of the main body and the other two pairs are arranged at opposite sides of the main body and at the same second height along the longitudinal axis of the main body, wherein the first height is different than the second height.

In some of the examples comprising lids, the bag may further comprise a garment rolling guide attached to any of the lids or to the main body. When the bag is in its extended configuration, the provision of a garment rolling guide allows transportation of pieces of garment in a rolled condition thus reducing wrinkling. Transporting garments in a rolled up condition further contributes to optimizing the use of space as a rolled configuration that has a substantially overall tubular appearance may fit in a quite reduced space and at the same time the rolling condition of the garment prevents wrinkling. Moreover, carrying garments in a rolled up condition makes the transportation easier than with traditional garment bags. In some cases, the rolling guide may be extendable, foldable, retractable or telescopic so as to fit inside the compressed configuration of the main body. The use of these bags may also be of interest e.g. for a point of sales of reduced size and high density of potential customers such as e.g. in airport stores or even outdoor spaces in which displaying of garments may be complicated. In these cases, provided the main body is made of a translucent material, the clothes can be exhibited while they are packed. The store can thus optimize its use of the space, increase the number of items offered for sale, and even improve on security, as the bags substantially as hereinbefore described may be closed/lock with locking systems. Last but not least, selling the garments inside a bag substantially as hereinbefore described involves that the customers do not need to worry about wrinkling of the newly acquired items. In some of these examples, additional components may be added to the rolling guide, such as a rolling sheet to place the garment before rolling or a clipping device to support the process of rolling by reducing movement of the garment. In some examples, more than one garment may be rolled up together in the same bag substantially as hereinbefore described. If more than one garment is rolled up, a protection sheet of light material may be used between the different pieces of garment to separate them and provide extra protection. In some examples where a garment rolling sheet is provided, the sheet may be automatically rolled-up or stretched, in a fashion that is similar to projection screens or window shades. In some examples the rolling guide may be configured to fit inside the lids when the main body is in the compressed configuration while in other examples the rolling guide may be removable. In other examples the rolling guide may compress one or more rails, rods or bars around which a garment is to be wrapped. In some examples said rails or bars may be the same material of the bag while in other examples it my be different materials. In some examples the garment rolling sheet further comprises fastening members to firmly secure a garment while allow rolling the garment.

In some examples, the main body of the bag may be provided with one or more supplementary storage compartments. In other examples, one or more of the lids may be provided with supplementary storage compartments. Combinations thereof may also be possible. These compartments provide extra storage capacity. In some of these examples, the supplementary storage compartments may be internal or external or combinations thereof. Some compartments may further be permanent while others may be removable. Some compartments may be provided with a configuration such that they allow the combination of different bags as substantially hereinbefore described in a modular manner.

In some examples, additional components such as hooks or wheels may be attached to the lids or the main body to facilitate its storage or transportation. In some cases, the hooks and/or the wheels may be removable.

In a further aspect, another example of travel bag is provided. The travel bag may comprise a first lid extending from an inner open end to an outer closed end, and a second lid extending from an inner open end to an outer closed end, wherein the inner open ends of the first and second lids have a geometry defined as a function of a substantially rigid or semi-rigid elongated article to be transported such that the elongated article can be snap fitted inside the inner open ends. These examples may be used for carrying rigid elongated articles such as an instrument or semi-rigid articles such as yoga-pilates mat in a rolled up condition.

In some of these examples, the elongated article may comprise a rolling sheet in which a garment may be placed before rolling, with or without the existence of a rolling guide. Once the garment is rolled up with the rolling sheet the resulting tubular article may be connected to the lids for transportation substantially as hereinbefore described.

In some examples, the rolling sheet may be formed from layers of materials and may be rigid or semi rigid. Such a rolling sheet may be continuous or with folding lines to allow a tube-like form once it is rolled up.

In a still further aspect, a portable mat is provided. The portable mat comprises an elongated body extending from a first end to a second end, wherein the elongated body is made of a substantially rigid or semi-rigid material and comprises a plurality of folding lines arranged substantially perpendicularly to a longitudinal axis of the elongated body.

In some cases, the portable mat may comprise a plurality of rigid or semi-rigid slats that may be held together with strops of e.g. a fabric hinge material adhered to edges of the rigid slats acting as folding lines thus resulting in a mat that can be rolled up in a tubular-like form. The mat may further comprise foldable handles. The mat may be configured to adopt different shapes by folding along a portion or the totality of the folding lines. In a fully extended configuration the mat may be used as yoga-mat or towel and in a compressed configuration, created by folding a portion or the totality of folding lines, the mat can be converted into a bag that can be carried through the foldable handles.

The mat may be configured to adopt different shapes and define at least an extended configuration in which the elongated body can be laid flat, and a compressed configuration in which the elongated body is folded at the folding lines, wherein the elongated body comprises one or more foldable handles configured to project out of an outer surface of the elongated body when it is in the compressed configuration. According to this aspect, by extending the foldable handles the mat can be transported in the compressed configuration and by folding the handles the mat can be used as a mat as such.

In some examples, the material of the main body (and/or the material of one or more lids) may be the same throughout its length or may have different materials on different parts or surfaces. In other examples, the lids may be made of the same material while in others they may be made of different materials. In some examples, the material of the lids and the main body may be the same, while in others such materials may be different. Such materials may be selected from, but not limited to: paper, metal paper, cork, bamboo, carbon fiber, nylon, fiberglass, polyester, polymers, plastics, leather, graphite, cardboard, foam, cotton, and other fabrics, leather, wood, graphite, rubber, thermo-formable materials, elastomers, shape-memory alloys, aramid fibers (e.g. Nomex® or Kevlar®), aluminium and other lightweight metals, recycled materials, jute, composites, or combinations thereof. In some cases, the material may have flat surfaces while in others it may comprise textures, reliefs or embossing to provide higher mechanical resistance or non-slippery properties. In more examples, an open mesh to provide mechanical protection may be foreseen. Such materials may be opaque, translucent or transparent. In some examples, different treatments or finish materials may be applied to any of the surfaces, including, but not limited to treatments for waterproofing, anti-scratch and stain resistance. In more examples, the inner surface may be different than the outer surface.

In some examples, in the extended configuration the main body may have a shape having a cross-section with a shape selected from, but not limited to, circular, oval, elliptical, triangular, square, hexagonal, or similar shape. In more examples, the extended configuration may have a non-tubular design, such as a substantially conical, irregular or cube design. In some examples a bag substantially as hereinbefore described may be rigid, semi-rigid, soft-sided, flexible, or inflatable, or combinations thereof. In some examples the bag may vary in cross-section along its length.

In yet another aspect a method of storing and/or selling garments is provided. The method comprises providing a plurality of garments, wrapping each garment into a portable bag substantially as hereinbefore described, and, accommodating the bags in a horizontal configuration in rows, one next to the other and a row above the other. Packing garments in a rolled condition ensure minimum wrinkling of the clothing. Furthermore, the space needed for storing a rolled garment with bag is substantially smaller than that need for an extended piece of clothing. This combination of reduced size/minimum wrinkling is of special interest in small stores with a high rate of potential customers such as airport stores, or in those cases where wrinkle-free clothes are given a special attention. The provision of e.g. mats inside the bags prior to storing them thus reduces the risk of the mats being flattened due to the weight of other mats being placed on top that is shown in FIG. 27. The possibility of placing other elements such as bar codes and/or tags in the lids or the main body substantially as hereinbefore described further facilitates the logistics of the storage (and transport) of the wrapped garments. Moreover, the reduced space occupied by the bags in its compressed configuration, also facilitates transportation and storage of the bags when they are not being used for placing e.g. garments inside.

Another aspect provides a method of displaying and/or selling garments or other pieces of fabrics such as towels. The method comprises, providing a plurality of garments, wrapping each garment into a portable bag substantially as hereinbefore described wherein the main body of the bag is substantially translucent or transparent. The method further comprises hanging the bags from a bar of a display. In some examples, the display may comprise a straight or rounded bar. Again, the combination of reduced size/minimum wrinkling provided by a garment rolled into a bag substantially as hereinbefore described in combination with a translucent or transparent bag is the key to this display method which is of special interest in small stores with a high rate of potential customers such as airport stores, touristic areas with a lot of flow of people or even for those shops or retailers where unconventional sales methods are required.

Alternatively, an opaque bag may also be used. In these cases, an outer surface of the main body may be provided with diagrams or characteristics of the garment housed inside such a bag. Moreover, the traditional method of displaying garments, especially in the case of suits, usually requires a back wall for them to be displayed. This reduces the options of displaying when no wall is available. The methods of displaying garments substantially as hereinbefore described allow displaying the garments independently on the presence (or not) of a wall thus increasing the potential area for displaying.

It is yet another aspect of some embodiments of the present invention to provide a travel bag comprising: a main body extending from a first end of said main body to a second end of said main body, and configured to assume an extended configuration for transportation of one or more elongated articles, and a compressed configuration for use other than transportation of the elongated article, a first lid extending from an inner open end of said first lid to an outer closed end of said first lid, a second lid extending from an inner open end of said second lid to an outer closed end of said second lid, defining an outer surface of said second lid and an inner surface of said second lid; wherein the distance between the first end of the main body and the second end of the main body is larger in the extended configuration than in the compressed configuration, wherein in the extended configuration, the main body first and second ends are respectively connected to the inner open ends of the first and second lids such that a substantially elongated storage housing is defined within the main body, and wherein in the compressed configuration, the second lid inner end is connected to the first lid inner end to define an alternative storage housing that is smaller than the elongated storage housing within the outer ends of the first and second lids.

In alternative examples, the present invention relates to a transportation or storage bag that can be also used as a foam roller while said bag is not being used for transportation. Said foam roller may be used at some part of the human body. Specifically, some embodiments of the present invention are directed towards a bag or similar container system comprising at least two modules wherein the first main module acts also as the said foam roller.

In alternative examples, the present invention consists of a transportation bag comprising: a first bag module that comprises a hollow and longitudinal core defined by a first end point of the bag module and a second end point of the bag module at an opposite end of said first end point, a storage cavity formed inside said core, an exterior surface of said core, and one or more connectors; a telescoping second bag module comprising a main body portion defined by a first end point of the second bag module and a second end point of the second bag module at an opposite end of said first end point, a storage cavity formed inside said main body portion, an openable first lid that provides access to said second bag module located at a first end point of said second bag module; and wherein the first bag module is configured to have the second bag module aligned at one first end of the first bag module and the second bag module is configured to have the first bag module aligned at the second end point of said second bag module; and wherein the exterior surface of said core of the first bag module comprises at last one massage zone for myofascial release.

In some examples, according to an embodiment of the present invention, the exterior of the core of the first bag module may comprise a massage element selected from a group of massage elements consisting of serrations; longitudinal channels; circumferential channels or massage fingers.

In other examples, according to an embodiment of the present invention, the exterior of said core of the first bag module may comprise a plurality of massage zones.

In alternative examples, according to an embodiment of the present invention, the bag may further comprise a third bag module comprising a main body portion defined by a first end point of said third bag module and a second end point of said third bag module at an opposite end of said first end point; and wherein the said first bag module is configured to have said third bag module aligned at the second end of the first bag module and the third bag module is configured to have the first bag module aligned at the second end point of said third bag module.

Alternatively, according to an embodiment of the present invention, the third bag module may comprise an electronic device that comprises at least one of speaker for connecting to external or internal audio device; a media player; a geolocation device; a digital display screen; an electronic ink display; a power source; a piezoelectric charger; a kinetic charger; a portable energy device; and a battery charger.

In some examples, according to an embodiment of the present invention, the third bag module may comprise a storage cavity formed inside said main body portion and an openable lid that provides access to said third bag module located at a first end point of said third bag module; and wherein said third module is a telescoping bag module or an accordion-like bag module.

It is yet another aspect of some embodiments of the present invention that the hollow and longitudinal core of the first bag module may be made of recycled or biodegradable materials.

Alternatively, according to an embodiment of the present invention, the first bag module may further comprise a roller body at the exterior surface of the core of said first bag module.

In some examples the material of said roller body may be different to the material of the exterior surface of the core of said first bag module.

Additionally, in other examples, the material of said roller body may be cork.

In other examples the material of said roller body may be flat and may include two dimensional elements that comprises at least one of texts, diagrams, textures, drawings, art representations, logos or different colors.

In alternative embodiments, the bag may further comprise one or more connectors at the second end of said second bag module wherein said connectors allow to remove the second bag module from the first bag module.

In other embodiments, the bag may further comprise an openable second lid located at the second end of said second bag module wherein said second lid separates the storage cavity formed inside the core of said first module and the storage cavity formed inside the main body portion of said second module.

In some examples, the bag may comprise a first bag module comprising a hollow and longitudinal core defined by a first end point of the bag module and a second end point of the bag module at an opposite end of said first end point, a storage cavity formed inside said core, an exterior surface of said core, and one or more connectors located at one first end of the first bag module; a telescoping second bag module comprising a main body portion defined by a first end point of the second bag module and a second end point of the second bag module at an opposite end of said first end point, a storage cavity formed inside said main body portion, an exterior surface of said main body portion of said second bag module, an openable lid that provides access to said second bag module located at a first end point of said second bag module; and at least two side straps each comprising a longitudinal axis defined by a first longitudinal end point and a second longitudinal end point at the opposite end of the longitudinal axis, a flexible and foldable material that connects both end points and one least one detachable connector at the second end point of said side strap; and wherein the first bag module is configured to have the second bag module aligned at the first end of the first bag module and the second bag module is configured to have the first bag module aligned at the second end point of said second bag module; wherein the first end points of said side straps are permanently connected to said second bag module at the first end of the second bag module; and wherein said side strap of the second bag module goes through said first bag connectors, creating the telescoping feature of said second bag module by pulling said side straps from either longitudinal end points of said side straps.

In some embodiments the bag may further comprise a third bag module comprising a main body portion defined by a first end point of said third bag module and a second end point of said third bag module at an opposite end of said first end point; and wherein the said first bag module is configured to have said third bag module aligned at the second end of the first bag module and the third bag module is configured to have the first bag module aligned at the second end point of said third bag module.

In other embodiments, said third bag module may comprise a storage cavity formed inside said main body portion and an openable lid that provides access to said third bag module located at a first end point of said third bag module; and wherein said third module is a telescoping bag module or an accordion-like bag module.

Alternatively, the first bag module may be closed at the second end of the first bag module.

In other embodiments, the bag may comprise a locking mechanism located at the second end of the second end points of said side straps.

It is yet another aspect of some embodiments of the present invention the bag and packaging solution consist of least two modules wherein the main module is a foam roller used for myofascial release massage and the second module is of a telescoping nature, allowing the transportation of elongated elements, such as rolled yoga mats, documents or garments.

In some embodiments, in some embodiments, the bag may include fewer or additional components and features. Optional components include, but are not limited to (i) straps, handles, and other carrying elements; (ii) hangers, hooks, and similar elements for hanging the bag and; (iii) supplemental storage compartments that are formed on or attached to any of the bag modules (iv) electronic devices; (v) power source devices; and (v) ropes or any kind of resistant bands traditionally associated with foam rollers. One of ordinary skill in the art would appreciate that numerous possible components and configurations for a bag, and embodiments of the present invention are contemplated for use with any such component or configuration.

According to some embodiments of the present invention, a primary function of the bag might be for carrying yoga-pilates mat in a rolled up condition or for carrying any rigid elongated articles such as an instruments. It may also be used as a gym bag to transport fitness products, towels, shoes, toiletries or garments. During the compressed configuration the bag may be used as a foam roller. In the case of the bag having digital screens or alike at the lid of the second module, as per some of the present embodiments, the bag may be used to follow fitness instruction or to track certain exercises. As alternative examples the bag may be used for activities that include but, are not limited to a camping bag configured to carry an inflatable mattress and other outdoor items; to sell and display yoga mats; to sell and display garment bags; as a garment bag for garments such as suits, jackets, pants, coats, dresses or any other piece of clothing that requires transportation and may be subject to wrinkling; a beach bag to carry towels, drinks, food, and other beach items; a gym bag with separate compartments for clean and wet or dirty items or as a mountaineering bag to carry clothes and drinks while trekking. One of ordinary skill in the art would appreciate that the modular bag could be arranged in a myriad of configurations, and embodiments of the present invention are contemplated for use in any such configuration.

According to some embodiments of the present invention, a bag module may be used to transport, display or to storage different garments, even without the existence of any garment rolling device to be used for such transportation. On other embodiments an additional garment rolling device may be included. In one such embodiment, said garment rolling device may be cylindrical guide rail or bar, such as a garment rolling bar, around which a garment could be wrapped. In another embodiment, the garment rolling device may be one or more sheets or layer of material, such as a garment rolling sheet, on which a garment is arranged and then rolled-up in. In some embodiments, the garment rolling sheet may also be configured with folding lines to help facilitate folding of items that are too large for the garment rolling sheet. In some embodiments a garment rolling device may include a clipping device element that secures the garment during the rolling process.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Throughout the following figures the same reference numbers will be used for matching parts.

Figure 1A:
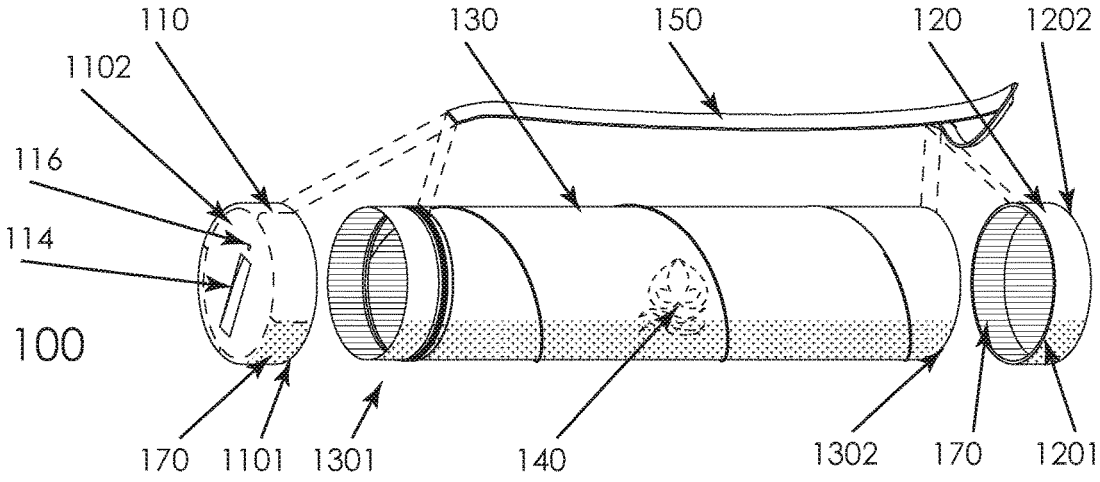
FIG. 1*a* shows a travel bag according to an example.

FIG. 1*a*. shows a travel bag or transportation bag (100) according to an example. The travel bag (100) of this example comprises a main body (130) that may extend from a first end (1301) to a second end (1302) to define an extended configuration. The main body (130) may further be configured to adopt a compressed configuration (shown in FIG. 2). The travel bag (100) may further comprise a first lid (110) that may extend from an inner open end (1101) to an outer closed end (1102) and a second lid (120) that may extend from an inner open end (1201) to an outer closed end (1202).

The first end (1301) of the main body (130) may be connectable to the inner open end (1101) of the first lid (110). The second end (1302) of the main body (130) may be connectable to the inner open (1201) of the second lid (120). The first (110) and second (120) lids may be provided with connectors (170) in order to be connectable to the main body (130) to define the extended configuration. In some cases, the connectors (170) may further be able to connect the first (110) and second (120) lids, when the main body 130 adopts the compressed configuration.

In some examples, the connectors (170) may be selected from the group consisting of zippers, male-female connectors, magnets, pressure fitting, friction fitting, snap fit connectors, clip connectors, latches, buckle connectors, electronic connectors, rubber connectors, threads, clamps or combinations thereof.

The travel bag (110) may further comprise a handle system (150) that may be connectable to either an outer surface of the main body first (1301) and second (1302) ends or to the first (110) and second (120) lids. See dashed lines of FIG. 1*a*. In the example of FIG. 1*a* the handle system (150) is a strap. In alternative examples, the handle system may comprise more than one straps, one or more cords, ribbons, strings, belts, chains, ropes or bands.

An outer surface of the main body (130) may further be provided with drawings (140), texts, diagrams, textures, patterns, bar codes or logos. Alternatively, it may be coloured. In more alternatives, drawings and/or texts and/or colouring may be provided in the lids or combinations thereof.

The outer closed end (1102) of the first lid (110) may comprise a substantially flat surface that may be provided with e.g. an incense burner (116) and an area for ashes (114). In alternatives, a sculpture, a mirror, a board or combinations thereof may be foreseen.

Figure 1B:
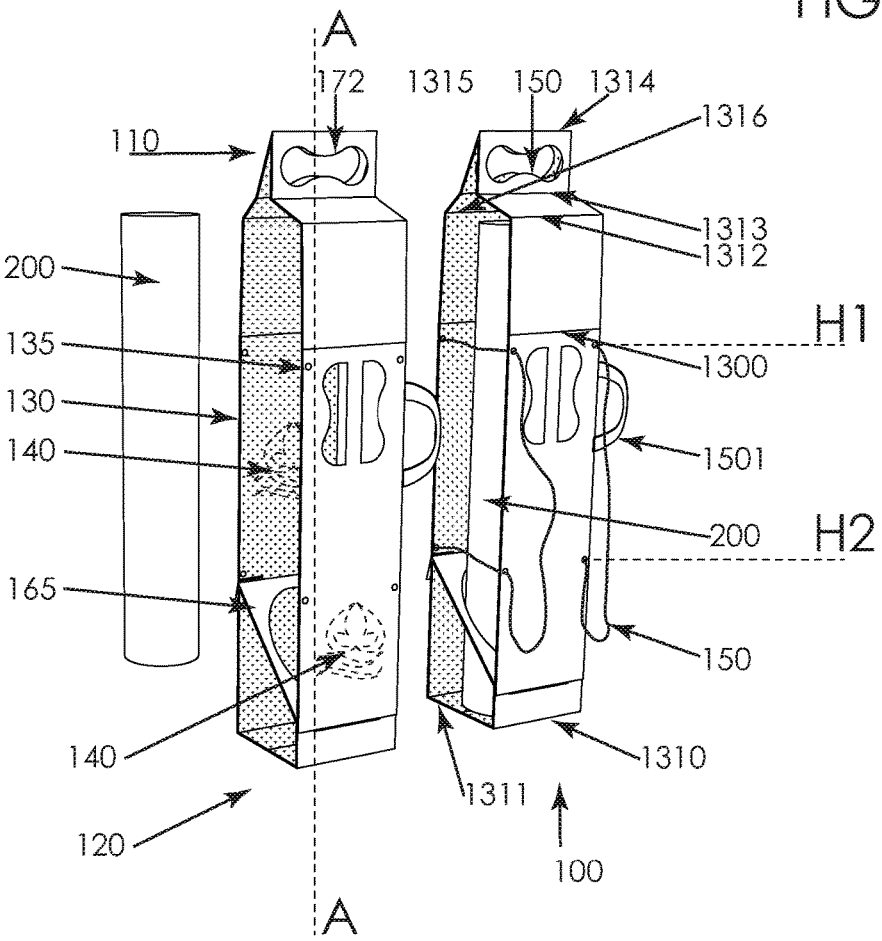
FIG. 1*b* shows a travel bag according to another example.

FIG. 1*b* shows another example of travel bag (100) that may be formed in a single piece and comprises a main body (130) that may extend from a first end (110) to a second end (120). The main body (130) may be made of a substantially rigid or semi-rigid material and may comprise a plurality of folding lines (1300) that may be arranged substantially perpendicular to the longitudinal axis A-A of the main body (130). In the example of FIG. 1*b*, the main body (130) may be folded at a portion of the folding lines (1300) to define an extended configuration in which an elongated storage space for receiving a substantially elongated article is defined. In the example of FIG. 1*b*, only folding lines (1310-1316) are folded to define the extended configuration including an elongated storage space within the main body (130).

In the figure on the left, a yoga mat (200) is shown that is ready to be housed inside the elongated storage space. In the figure of the right, the mat (200) is shown to be housed inside the storage space.

In the example of FIG. 1*b*, the main body (130) is further provided with holes (135) that may be arranged in pairs. The holes may be configured to receive a back-pack handle system (150). In this example, four pairs of holes (135) may be provided. Two pairs may be arranged at opposite sides (along a direction perpendicular to the longitudinal axis) of the main body and at the same first height H1 along the longitudinal axis A-A of the main body (130). The other two pairs of holes (135) may be arranged at opposite sides of the main body and at the same second height H2 along the longitudinal axis A-A of the main body. The first height H1 may be closer to the first end 110 and the second height H2 may be closer to the second end (120) when the main body is in the extended configuration. In an arrangement of the main body in which the first end is a top end and the second end is a bottom end, the first height H1 is higher than the second height H2.

In the example of FIG. 1*b*, the back-pack handle system (150) comprises cords or ropes. In alternative examples, bands may be foreseen. The cords, ropes or bands may be used for a different use when the bag is not being used for transportation. In examples, jumping ropes, fitness bands, sculpting resistance bands, resistance bands or cords may be foreseen. The cords may further serve to laterally secure the mat 200 in the storage housing as shown in the figure of the right.

The folding of lines (1313-1315) may further define a further handle (172) at the first end (110) of the main body (130) in the extended configuration. The handle (172) may be form as a cut out on the rigid or semi-rigid material. In other examples, other folding lines may be folded and the further handle may not be present. See FIG. 4 or 10*b*.

In the example of FIG. 1*b*, a further bending line may fold a portion of the main body having a substantially oval shaped cut-out (165). The cut out may serve to secure the mat 200 when it is placed inside the storage housing and the fold portion provides stabilization to the main body. See figure on the right.

In the example of FIG. 1*b*, the main body (130) may further comprise a pair of foldable handles (1501) that may be configured to project out of its outer surface when the main body (130) is in the compressed configuration. See FIG. 3 (numeric reference 164).

Figure 3:
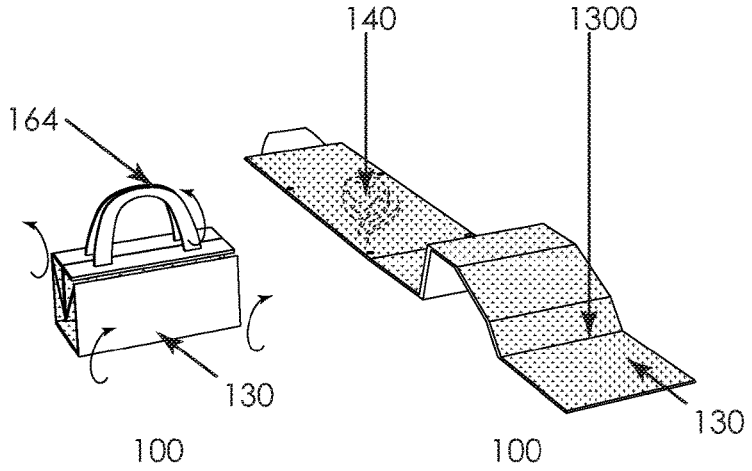
FIG. 3 shows a travel bag as that of FIG. 1*b* in different configurations.
Figure 4:
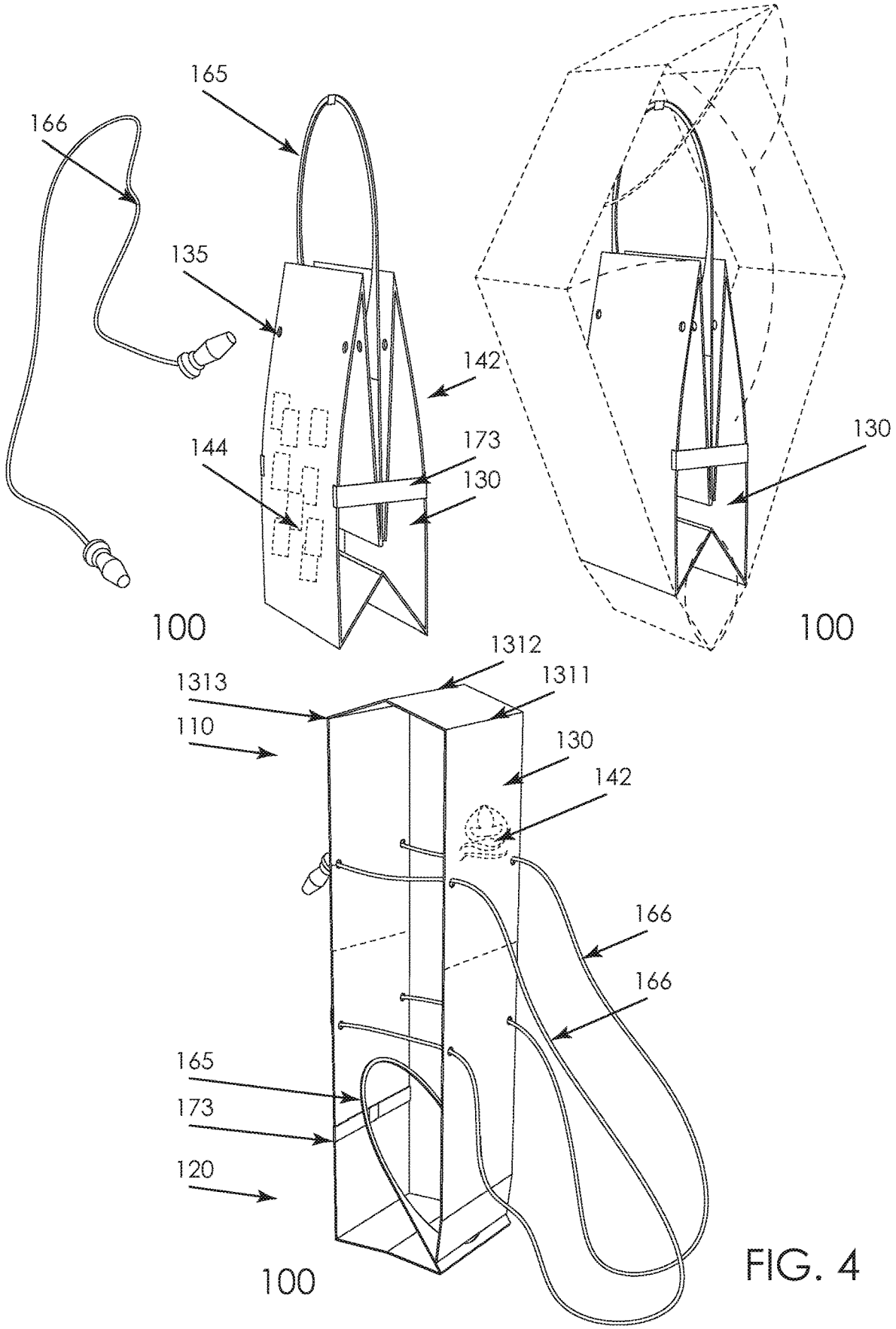
FIG. 4 shows an example of the travel bag of FIG. 1*b* in different configurations.

In further examples, other number of folding lines may be folded as shown in the examples of FIG. 3 or 4 to define e.g. the compressed configuration. In the example of FIG. 3, the main body (130) may be made of e.g. cardboard. The figure of the right shows substantially no folded lines, the bag is not being formed yet and may function as a towel or mat. The figure of the left shows a compressed configuration of the main body (130) in which all folding lines may be folded. A pair of foldable handles (164) may further be provided configured to project out of the main body (130) outer surface when the main body (130) is in the compressed configuration.

Figure 2:
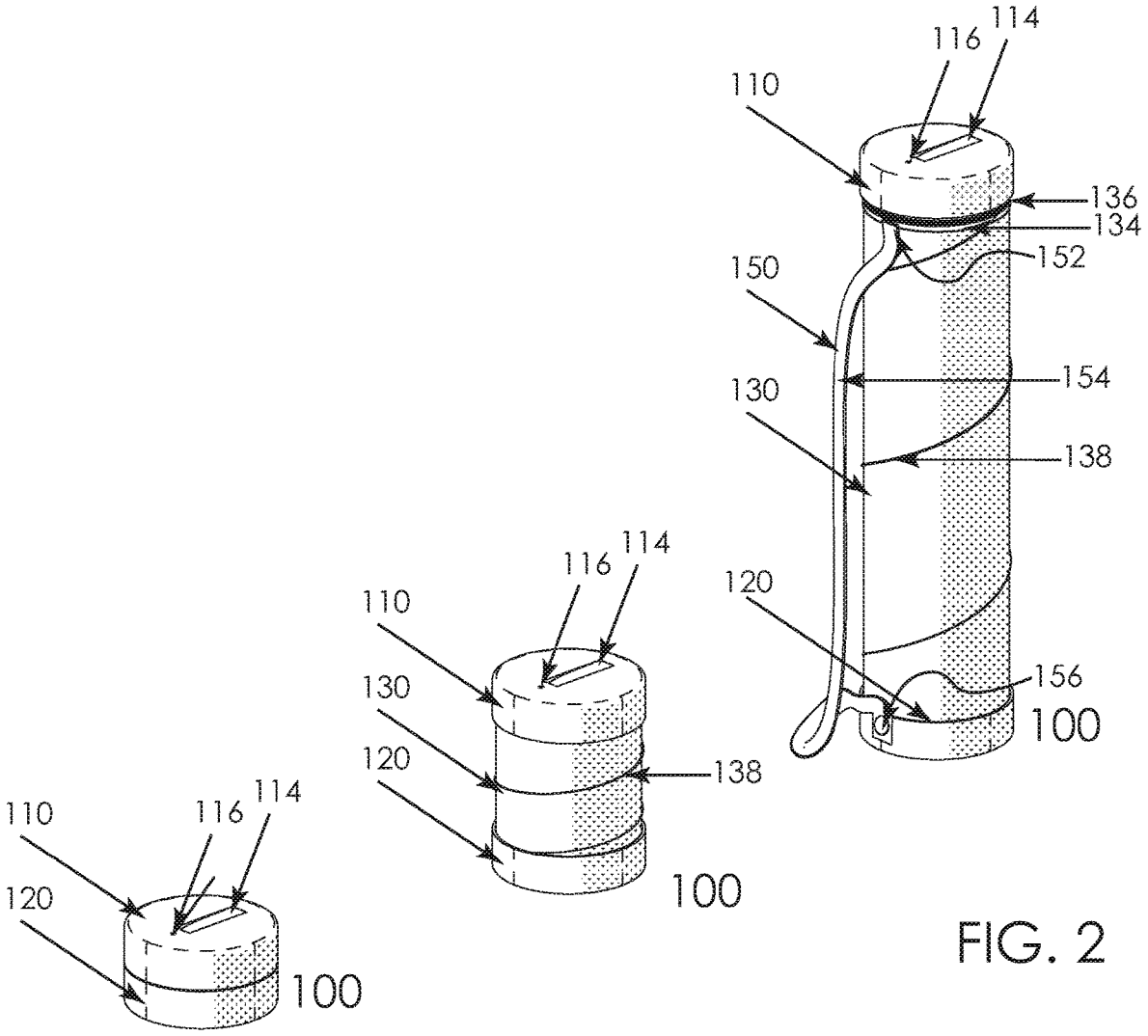
FIG. 2 shows the travel bag of FIG. 1*a* in different configurations.

FIG. 2 shows the example of FIG. 1*a* in three different configurations. The figure on the right shows the main body (130) in the extended configuration. The lids (110) and (120) may be respectively connected to both ends of the main body (130). In this example, a stiffening member (134) may further be provided at both ends of the main body (130) to aid connecting the ends with the lids (110) and (120). A zipper (136) may be provided at the open ends of the lids (110, 120). A matching zipper may be provided at the stiffening member or at the ends of the main body when no stiffening member is provided. The zipper (136) connecting the first lid (110) with one end of the main body (130) is also shown in the cross-sectional view of FIG. 15. In alternative examples, other mechanical closing systems may be foreseen. The stiffening member (134) is also shown in the cross-sectional view of FIG. 15.

In this example, the strap (150) may be in the form of a bandolier and may be connected to the second lid (120) through a mechanical coupling such as a button/eyelet coupling (156). In alternative examples, other mechanical couplings may be foreseen such as clips, hook-and-loop strip, tie strings, Velcro® or similar.

Further in this example, the main body (130) may be made of a flexible and foldable material and may further provided with one rod (138) describing a substantially helical shape around the flexible and foldable material to allow instant twist and fold of the main body (130). In this example, the natural "relaxed" state of the rods may be close to their shape in the extended configuration. To obtain the compressed configuration, the body is compresses, and the various turns of the helical rod are pushed closer together.

In the example of FIG. 2, the figure in the middle shows an intermediate configuration in which the main body is partly compressed. In this case, a storage housing (not shown) may be defined within the main body and the lids. The storage housing having a volume that is lower than that of the elongated housing of the extended configuration and that is bigger than that defined within the two lids when the main body is in the compressed configuration. A further mechanical coupling may be provided to lock the bag in this intermediate configuration.

The figure on the left shows that the two lids (110, 120) may be connected to each other, to define the compressed configuration. In this example, the compressed main body (not shown) may be housed within a storage housing that may be defined by the lids (110) and (120) connected to each other.

The example of FIG. 4 differs from the example of FIG. 1*b* in that the further handle has been removed. Furthermore, the cords have been replaced by a jumping rope (166). The final shape is also slightly changed.

In this example, the figure of the bottom shows the extended configuration and the figures of the top the compressed configuration. In the figure of the bottom, the first end (110) of the main body (130) may be made by merely folding lines (1311-1313). And an outer surface of the main body may incorporate texts or diagrams (142).

In the figure of the top, the main body (130) may be in the compressed configuration, acting as a secondary bag for smaller articles, and the jumping rope (166) may be separated from the bag (and used). A portion of the outer surface of the main body may further be used as a notepad (144) or as a digital screen. A further band or strap (173) may be provided to aid maintain together the main body in the compressed configuration. And the substantially oval shaped cut-out (165) becomes a handle.

Figure 5A:
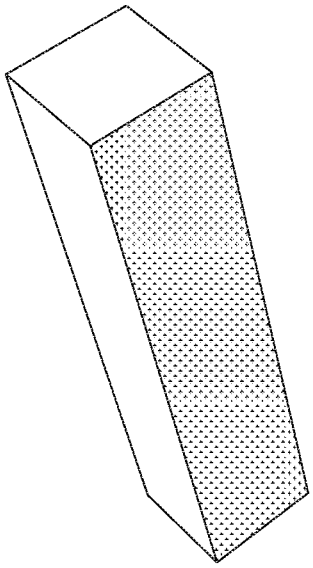
FIGS. 5*a*-5*d* show four examples of the overall appearance of a travel bag in the extended configuration.
Figure 5B:
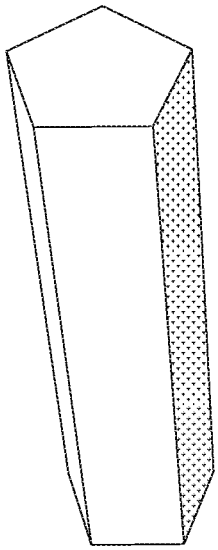
Figure 5C:
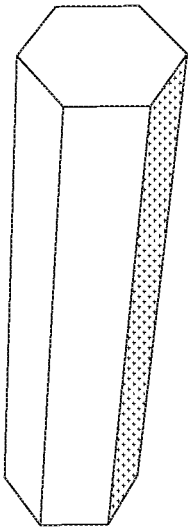
Figure 5D:
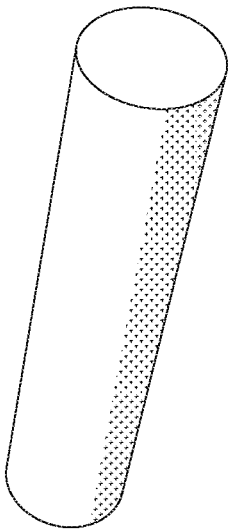

FIGS. 5*a*-5*d* show four examples of overall appearances that a travel bag in the extended configuration may adopt. FIG. 5*a* shows a prismatic configuration having a square cross-section. FIG. 5*b* shows a prismatic configuration with a cross-section having a pentagonal shape. FIG. 5*c* shows a bag with a cross-section having a hexagonal shape. And FIG. 5*d* shows a bag with a cross-section having a circular shape. Other polygonal or rounded cross-sections may also be foreseen. The overall appearance of the extended configuration may thus be considered substantially tubular.

Figure 6:
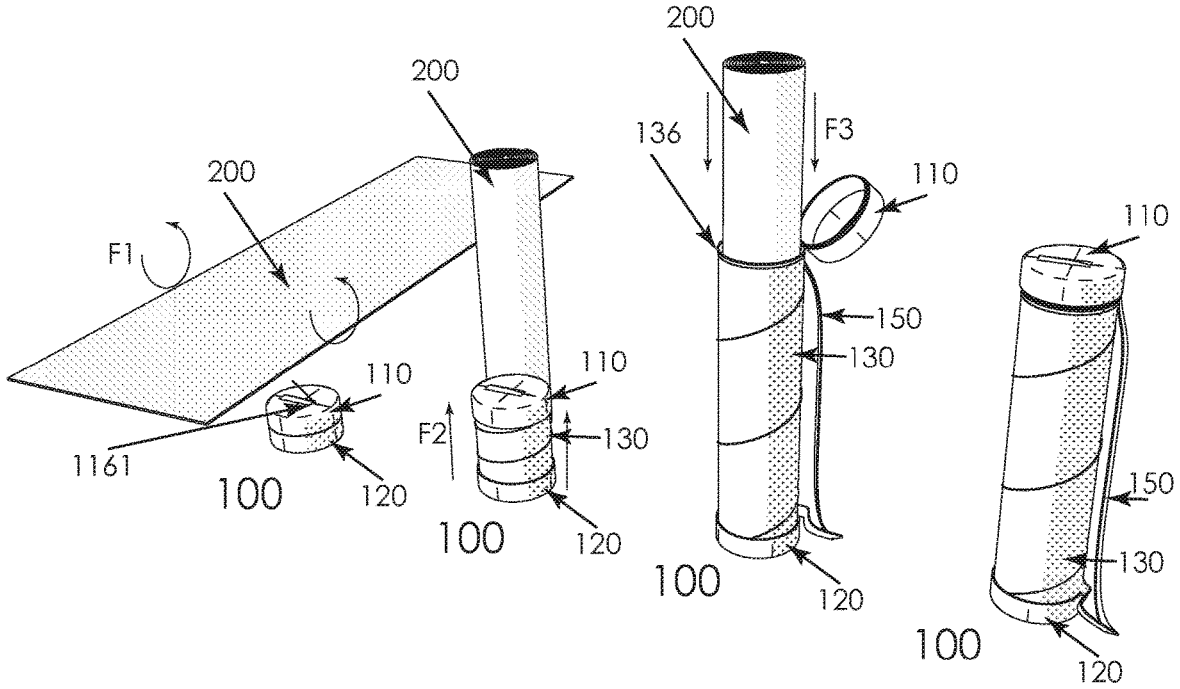
FIG. 6 shows a mat and the travel bag of FIG. 1*a* in different configurations.

FIG. 6 shows the travel bag of FIGS. 1*a* and 2 with a mat (200). The sequences of figures from left to right show the steps for rolling the mat and introducing it inside the bag to get ready for transport. The first step starts with the bag in the compressed configuration. In this configuration an incense stick (1161) may be placed in the incense burner as explained in connection with FIG. 1*a*. The first step may comprise rolling up the mat (200). See arrows F1. Once the mat is rolled up, the second step may comprise starting expansion of the main body. See arrows F2. When the main body (130) is in the extended configuration, the third step may comprise opening the first lid 110 by unzipping zipper (136) and introduce the folded mat (200) inside the elongated storage housing defined in the extended configuration (explained in connection with FIG. 1*a*). See arrows F3. The last step may comprise closing the first lid (110).

Figure 7:
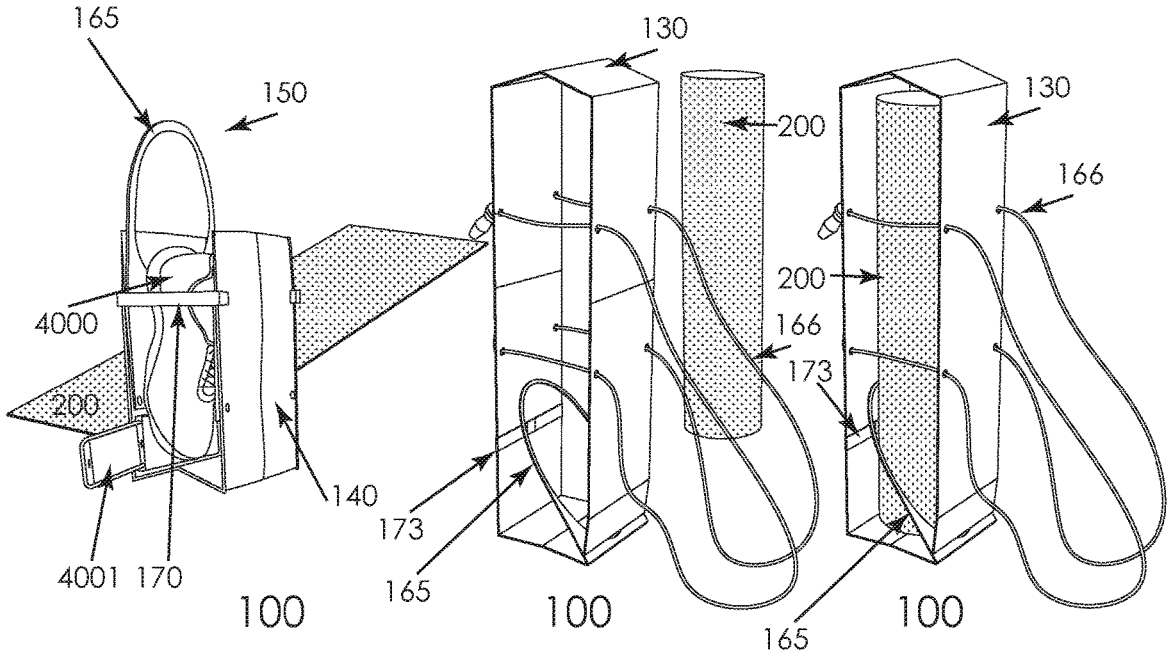
FIG. 7 shows a mat and the travel bag of FIG. 4 in different configurations.

FIG. 7 shows the travel bag of FIG. 4 with a mat (200). The sequences of figures from left to right show the steps for rolling up the mat and introducing it inside the bag to get ready for transport. The first step starts with the bag in the compressed configuration and the strap/rope or cords in a released configuration, i.e. being usable e.g. as a jumping rope as explained in connection with FIG. 1*b*. This compressed configuration may allow storage or transportation of other items such as shoes (4000), cell phones (4001) or other items that might require storage while practicing yoga or related activities. The first step may comprise rolling up the mat (200) as explained in connection with FIG. 6. Once the mat is rolled up, the second step may comprise starting expansion of the main body. To do this the strap (173) needs to be unfasten and the rope may be provided through the eyelets. When the main body (130) is in the extended configuration, the third step may comprise introducing the folded mat 200 inside the elongated storage housing defined in the extended configuration (explained in connection with FIG. 1*b*). When doing this, care should be taken to introduce the mat within the oval cut-out (165) as explained in connection with FIG. 1*b*, which may also act as a handle in the compressed configuration.

Figure 8:
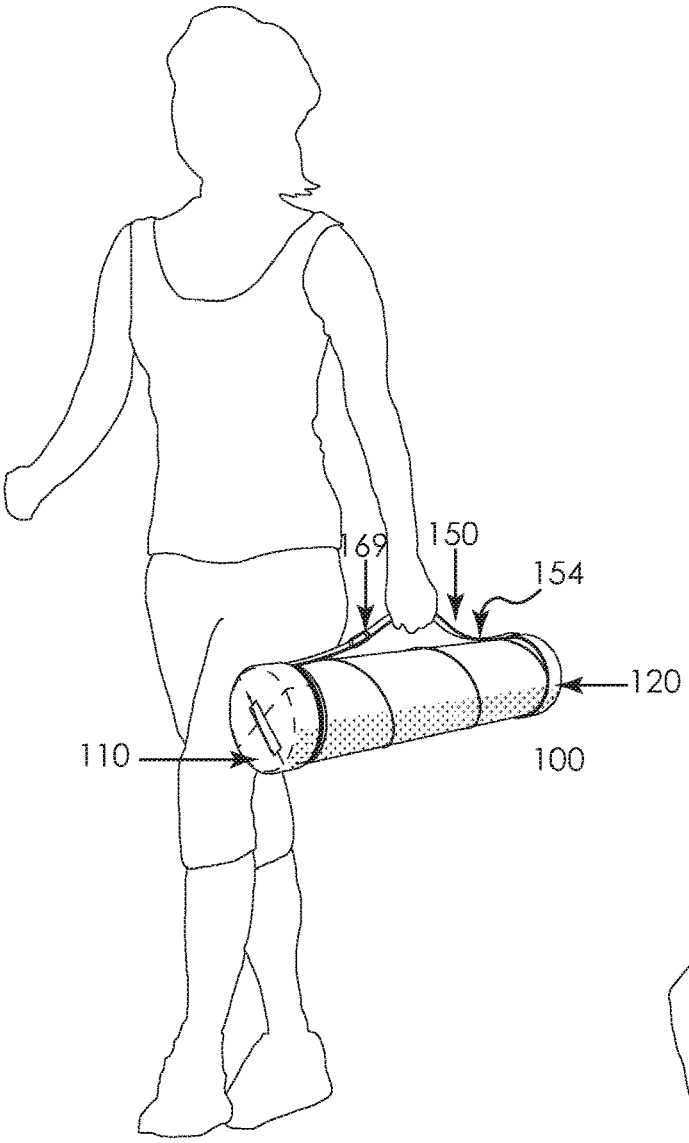
FIG. 8 shows a person carrying the travel bag of FIG. 1*a* in the extended configuration.

FIG. 8 shows a person carrying the bag of FIG. 1*a*, 2 or 6 in the extended configuration being used to transport an elongated element, e.g. a yoga mat. In this example, the handle system (150) may be a belt (154) that may comprise rings (169) to adjust its length.

Figure 9:
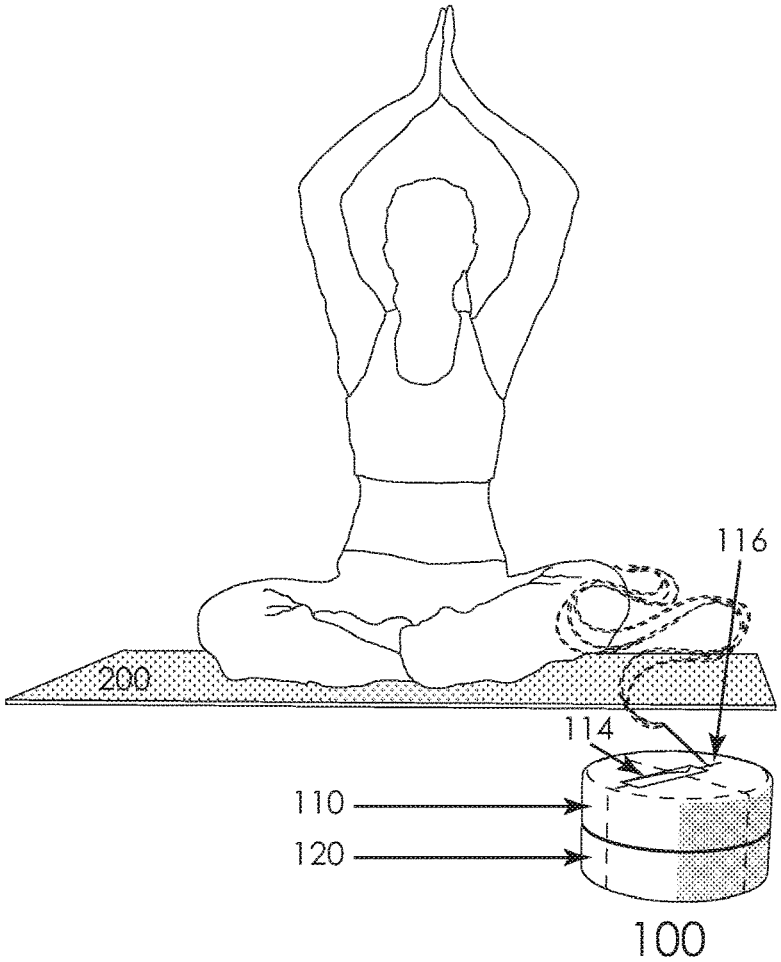
FIG. 9 shows a person using the travel bag of FIG. 1*a* in the compressed configuration.

FIG. 9 shows a person using the bag of FIG. 8. The person may actually be using the mat (200) for practising yoga while the bag may be in the compressed configuration in which the incense burner (116) may be used. Furthermore small items such as keys, mobile phone, or purse may be housed inside the storage space defined by the two lids (110) and (120) being fasten to each other defining the compressed configuration.

Figure 10A:
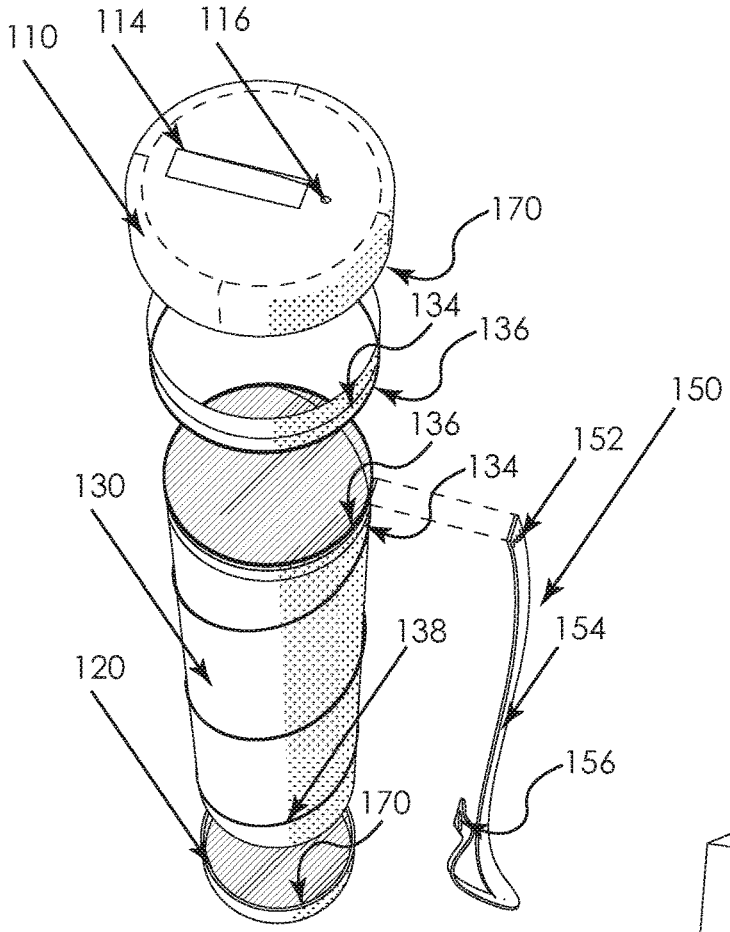
FIG. 10*a* shows an exploded view of an example of the travel bag of FIG. 1*a* in the extended configuration.

FIG. 10*a* shows an exploded view of the travel bag of FIGS. 1*a*, 2 and 6 in the extended configuration. In this exploded view the connector (170) of the first lid (110) may comprise a stiffening member (134) with a zipper (136) and the main body first end may also comprise a stiffening member (134) with a matching zipper (136). The strap (150) may be in the form of a belt (154) and may be connected to the main body through a mechanical detachable coupling such as a button/eyelet coupling (156). In alternative examples, other mechanical couplings may be foreseen such as clips, hook-and-loop strip, tie strings, Velcro® or similar. The belt (154) may be made of textile, leather or similar. The belt may be connected to the main body with a fixed stitching (152) or similar. The stitching (152) is also shown in the cross-sectional view of FIG. 15. Having one end fixed and the other detachable ensures that the belt remains fixed to the main body but does not hinder compressing it into the small storage housing in the compressed configuration. In alternative examples, other ways of attaching the belt or strap to the main body may be foreseen, e.g. the strap may comprise two fixed stitching at both ends of the main body or two mechanical joints buttoned type or clip may be foreseen. In these cases, the strap may be released from the main body and may have a further use, e.g. jumping rope, resistance bands. Alternatively, two slings or ropes may be provided such that the bag can be converted into a backpack.

Figure 10B:
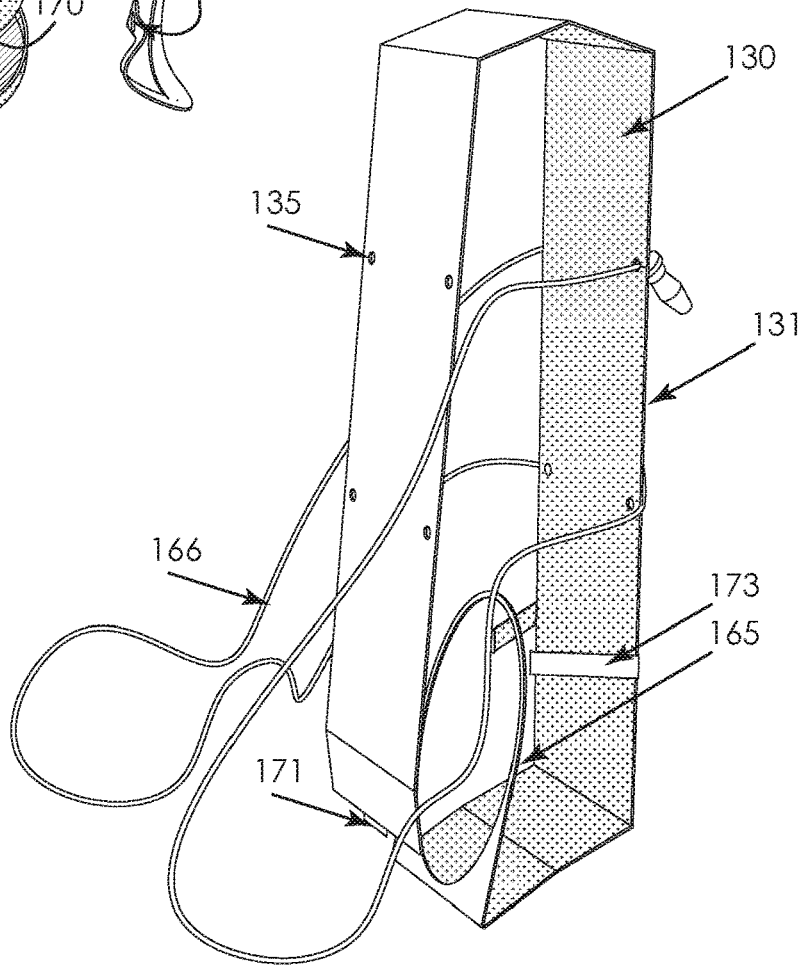
FIG. 10*b* shows an exploded view of the travel bag of FIG. 1*b;*
Figure 11A:
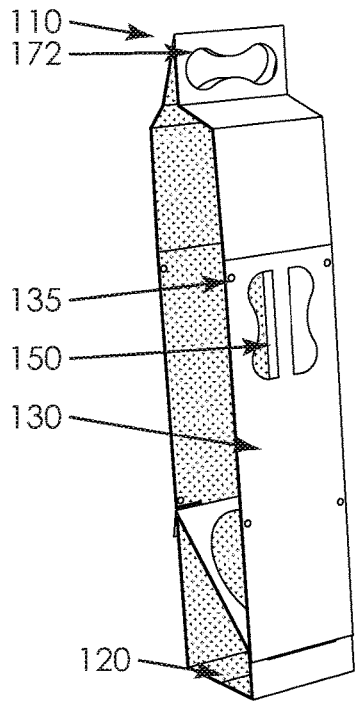
FIGS. 11*a*-11*f* show further examples of the travel bags of FIGS. 1*a* and 1*b* in the extended configuration.

FIG. 10*b* shows an exploded view of the travel bag of FIGS. 4 and 7 in the extended configuration. The strap (173) for holding together the bag in the compressed configuration is identified and is attached to the main body (it has no use in the extended configuration). A further tongue (171) is shown at the second end (120) which aids completing the folding and maintaining its folded condition in the extended configuration FIG. 11*a* shows the example of FIG. 1*b* (figure on the left) in the extended configuration in which the pair of foldable handles has been removed.

FIGS. 11*b*-11*f* show further examples of the travel bag of FIG. 1*a* in the extended configuration.

Figure 11B:
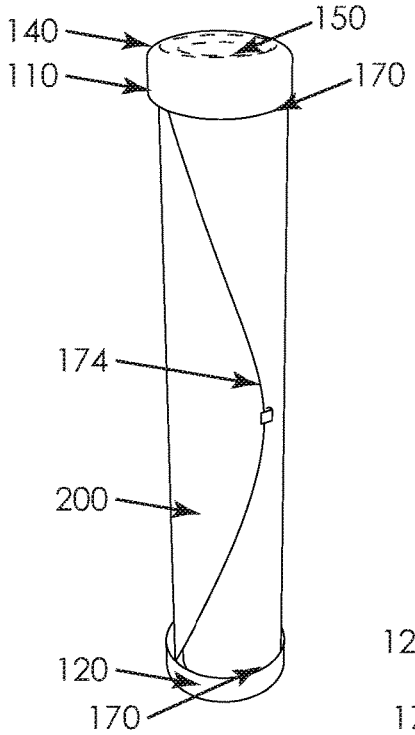

FIG. 11*b* shows an example in which the main body (of the travel bag) as such is left out. This way, the travel bag may comprise only a first lid (110) and a second lid (120). This example may be used for transportation of rigid or semi-rigid elongated articles such as the yoga mat in a rolled condition. The first end (110) that may extend from an inner open end to a closed end and the second end (120) may also extend from an inner open end to a closed end. The rolled mat may be inserted into the inner open ends of the first (110) and second (120) lids.

The lids (110) and (120) may be provided with fastening connectors (170) able to connect each other when the mat is removed to define a compressed configuration.

In this example, the inner open ends of the first and second lids may have a geometry that may be defined as a function of the substantially rigid or semi-rigid elongated article to be transported, e.g. the rolled mat, such that the rolled mat can be snap fitted inside the inner open ends. In alternative examples, the inner open ends of the first and second lids may be provided with mechanical-based fastening elements able to fix the rolled mat (or any other elongated article) to be transported to the first and second lid.

A handle or strap (174) may further connect the first lid (110) to the second lid (120) to provide a handling system and more rigidity or stability to the bag in the extended configuration. A handle system (150) may be provided in e.g. the first lid (110) (or in the second lid or in both lids).

Figure 11C:
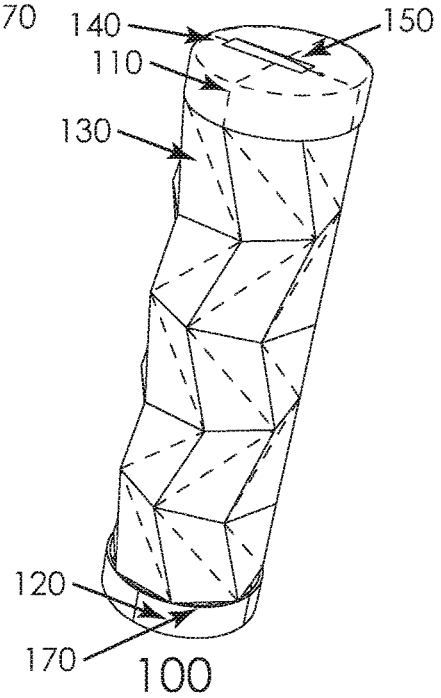
Figure 25:
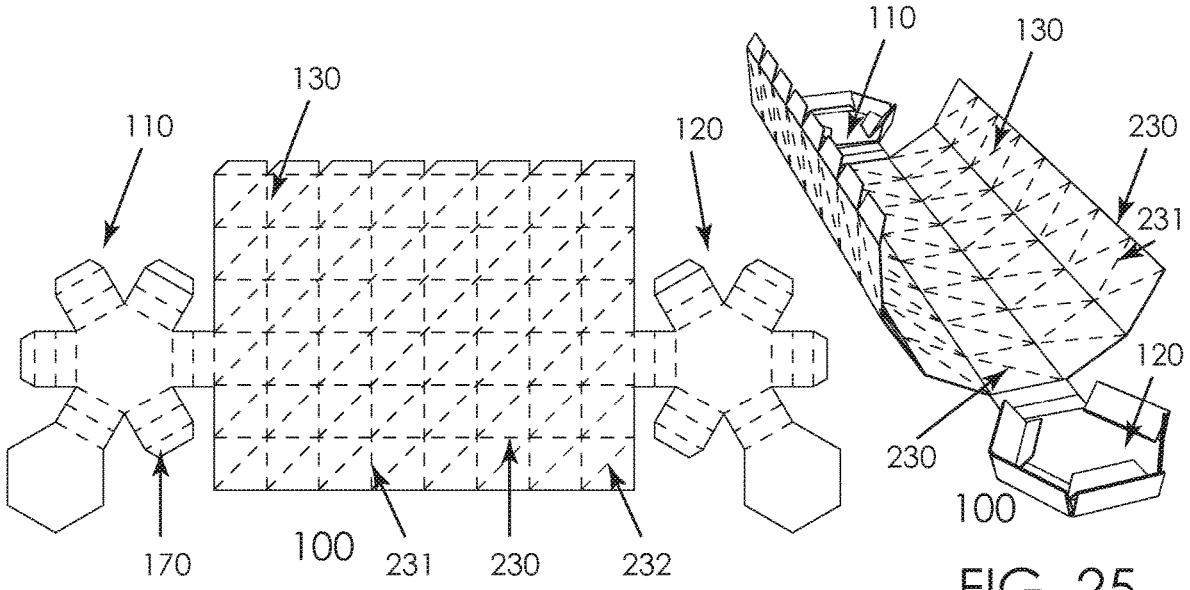
FIG. 25 shows an exploded view of a travel bag according to an example.
Figure 26:
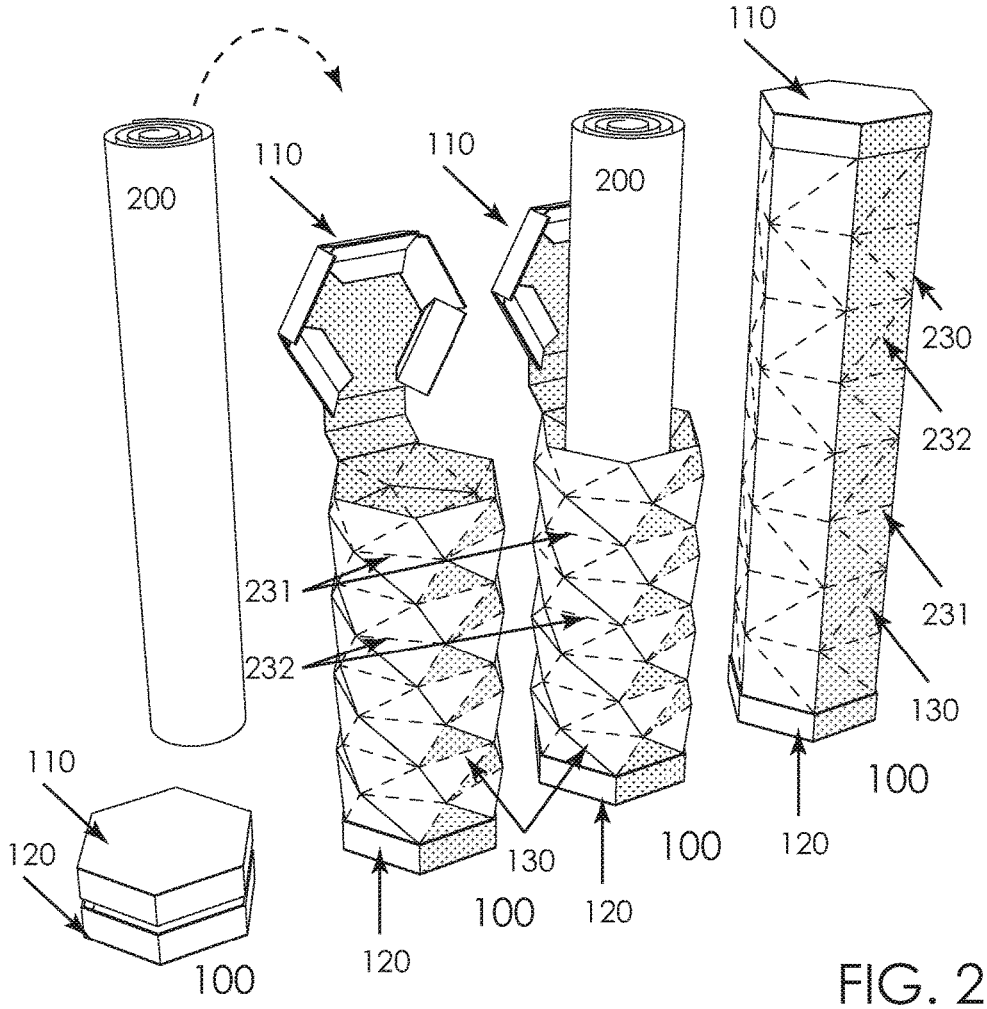
FIG. 26 shows a mat and the travel bag of FIG. 25 in different configurations.

FIG. 11*c* and FIG. 25 or 26 show an example in which the main body may be made of a rigid or semi-rigid foldable material such as cardboard, plastic, rubber or alike. In these examples, the main body may comprise a plurality of folding lines that may comprise a combination of triangles forming a faceted-like surface so as to fold like an accordion or origami when the main body is in the compressed configuration. The main body may be connectable to a first and second lid substantially as explained in connection with FIG. 1*a*, 4, 6 or 10*a*. Alternatively, the folding lines may be a series of parallel lines that may be arranged substantially perpendicular to the longitudinal axis of the main body so as to fold like an accordion when the main body is in the compressed configuration.

The example of FIGS. 25 and 26 differ from that of FIG. 11*c* in that the main body and the lids may be made from a single piece. A further difference is the shape of the lids. In the example of FIG. 25 the lids are hexagonal whereas in the example of FIG. 11*c* the lids are circular. Other shapes may also be foreseen.

In FIG. 25 the figure of the left shows the cardboard, plastic, rubber or alike in a cut condition with the folding lines shown in sketch or interrupted lines. In this example, the main body may have a substantially rectangular shape and the folding lines may comprise parallel lines (230) in the direction of the longer sides of the rectangular shape and parallel lines (231) in the direction of the shorter sides of the rectangular shape thus defining a plurality of small squares. The folding lines may further comprise parallel diagonal lines (232) traversing vertices of the squares. The figure of the right shows some folding lines in a folded condition to form the lids (110, 120) and lines (230) folded to form part of the main body. Glue or other adhesive may be used to put together the side ends of the main body and lines in a folded condition forming the lids. Instead of glue, other components may be added to connect the side ends of the main body with elements such as zips, male-female connectors, magnets, pressure fitting, friction fitting, snap fit connectors, clip connectors, latches, buckle connectors, electronic connectors, biometric or other password locks of any kind, rubber connectors, threads, clamps or other mechanical-based connectors, e.g. Velcro®.

FIG. 26 shows the travel bag of FIGS. 11*c* and 25 with a mat (200). The sequences of figures from left to right show the steps for folding the mat and introducing it inside the bag to get ready for transport. The first step starts with the bag in the compressed configuration and may comprise rolling up the mat (200). Once the mat is rolled up, the second step may comprise opening the first lid (110) and starting expansion of the main body by unfolding lines (231) and (232). When the main body (130) is an intermediate configuration between compressed configuration and the extended configuration, the third step may comprise introducing the folded mat (200) inside the elongated storage housing defined in the intermediate configuration. The last step may comprise completing extension of the main body and closing back the first lid (110).

Figure 11D:
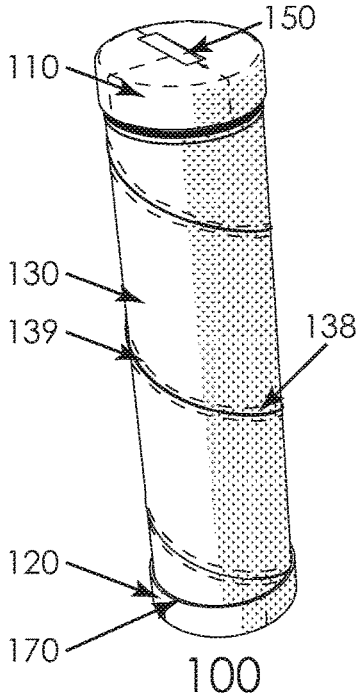

FIG. 11*d* shows the example of FIG. 1*a* or FIG. 6 in the extended configuration in which the handle system has been removed. In this example, the rod (138) describing a substantially helical shape provided around the flexible and foldable material may be provided in combination with joint means, e.g. a channel (139) formed by sewing a portion of a flexible material to provide housing for the rod (138). The rod (138) inserted in the channel (139) is also shown in the cross-sectional view of FIG. 15. The channel (139) may be continuous along the rod (138) or only locally provided along stretches.

Figure 11E:
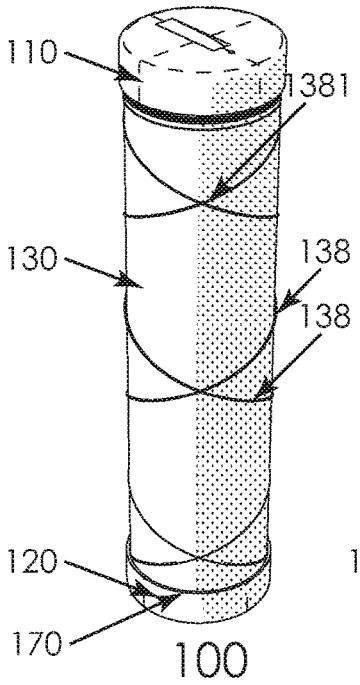

The example of FIG. 11*e* differs from that of FIG. 11*d* in that two rods (138) may be provided describing substantially helical shapes in opposite directions so as to create crossings (1381) between the two rods (138). In alternative examples, instead of rods a cable or other rigid and bendable material may be used.

Figure 11F:
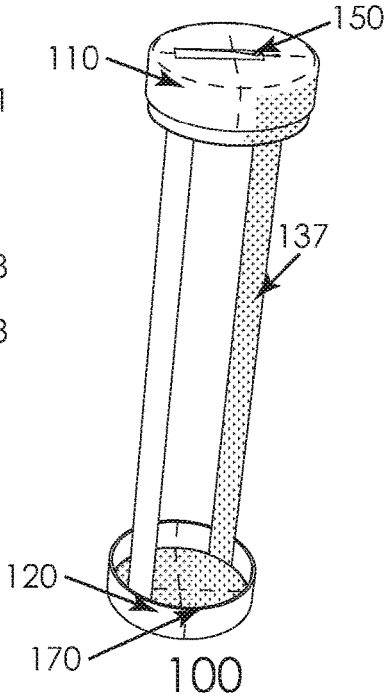

FIG. 11*f* shows an example of travel bag in which the main body may comprise two stripes or bands (137) made of an elastic material. Such elastic material may be capable of returning to its original length and shape due to its nature or may be deformed and extended as a result of gravity, due to the load of the lower lid (120). The bands may extend longitudinally to connect the first (110) and the second (120) lids to define the extended configuration. In alternative examples, other number of bands may be foreseen.

In all cases, an outer surface of the lids may comprise texts, diagrams, drawings, patterns, bar codes, QR codes or any type of logistic and reference code, logos, colours or textures.

FIGS. 12*a*-12*d* show different ways of carrying a travel bag substantially as hereinbefore described in the extended configuration by a person.

Figure 12A:
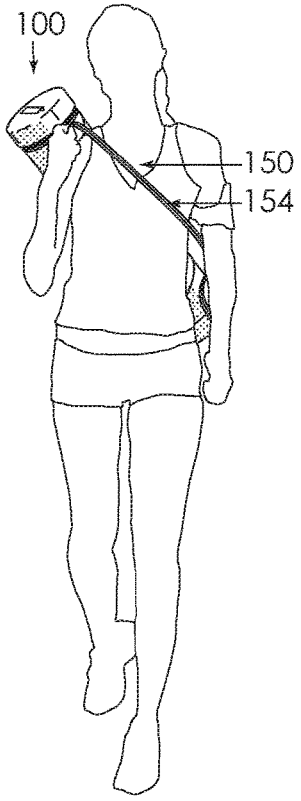
FIGS. 12*a*-12*d* show the travel bag of FIG. 1*a* in the extended configuration being carried by a person in different ways.

In the example of FIG. 12*a* a length of the belt (154) may be adjusted such that the bag may be carried as a bandolier.

Figure 12B:
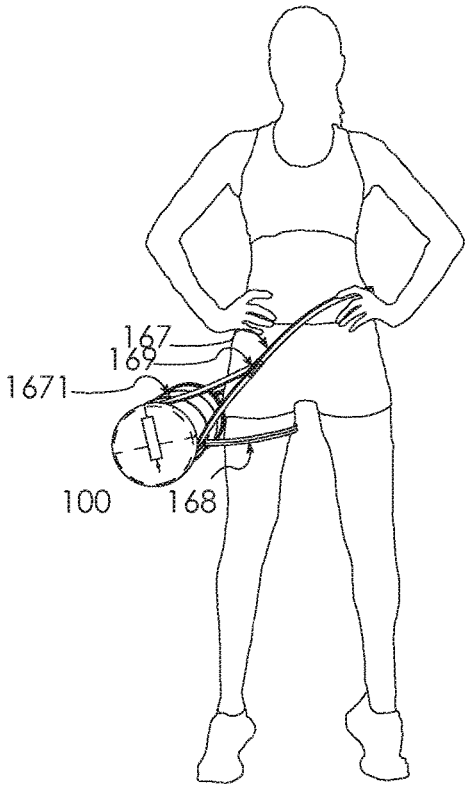
Figure 12C:
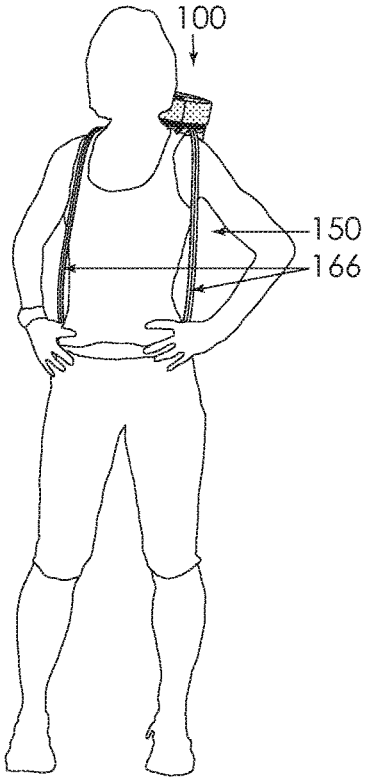
Figure 12D:
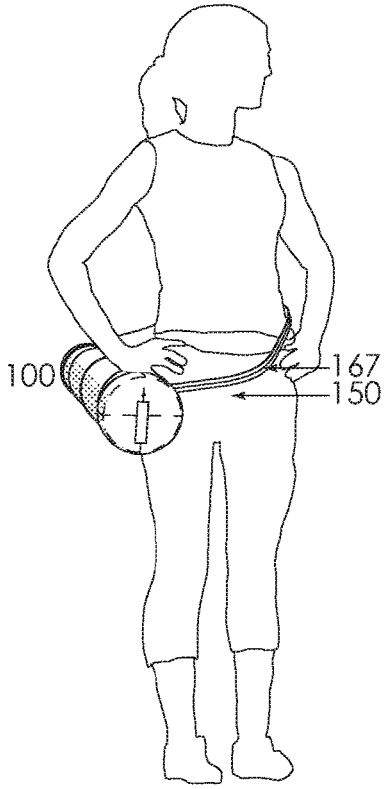

In the example of FIGS. 12*b* and 12*d* the belt may be adjusted (e.g. through the rings 169) as a waist strap (167) and may be provided with an extension (1671) to add stability.

Alternatively, a strap or grip (168) to the leg may further be provided.

In the example of FIG. 12*c* the belt may be replaced by two straps or ropes (166) such that the bag can be carried as a back-pack.

All these examples allow a hands free transport of the bag.

In all cases, the handle system may be folded inside the lids in the compressed configuration or may be fully removable while in such a compressed configuration.

Figure 13A:
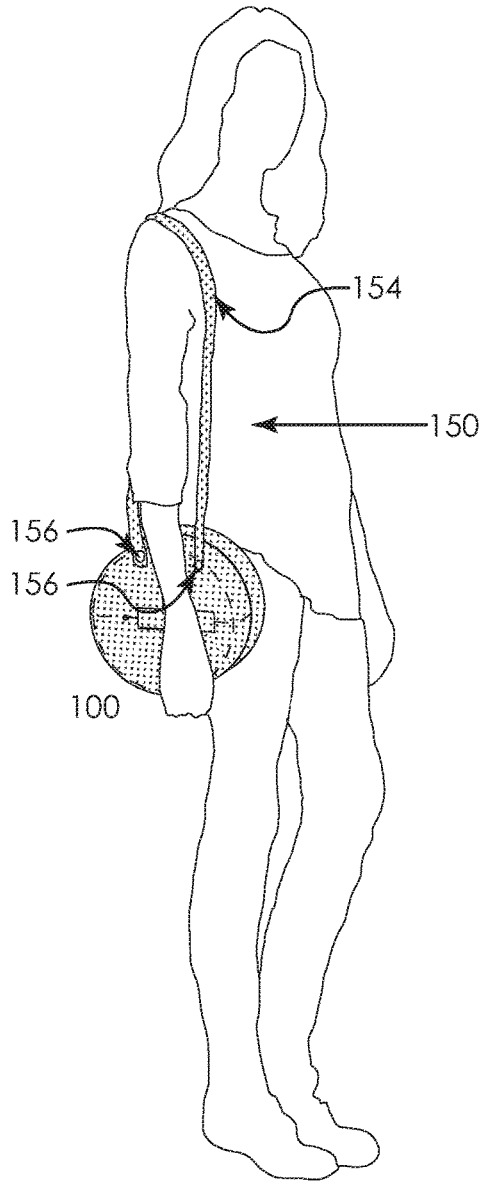
FIGS. 13*a*-13*b* show the travel bag of FIG. 1*a* in the compressed configuration being carried by a person in different ways.
Figure 13B:
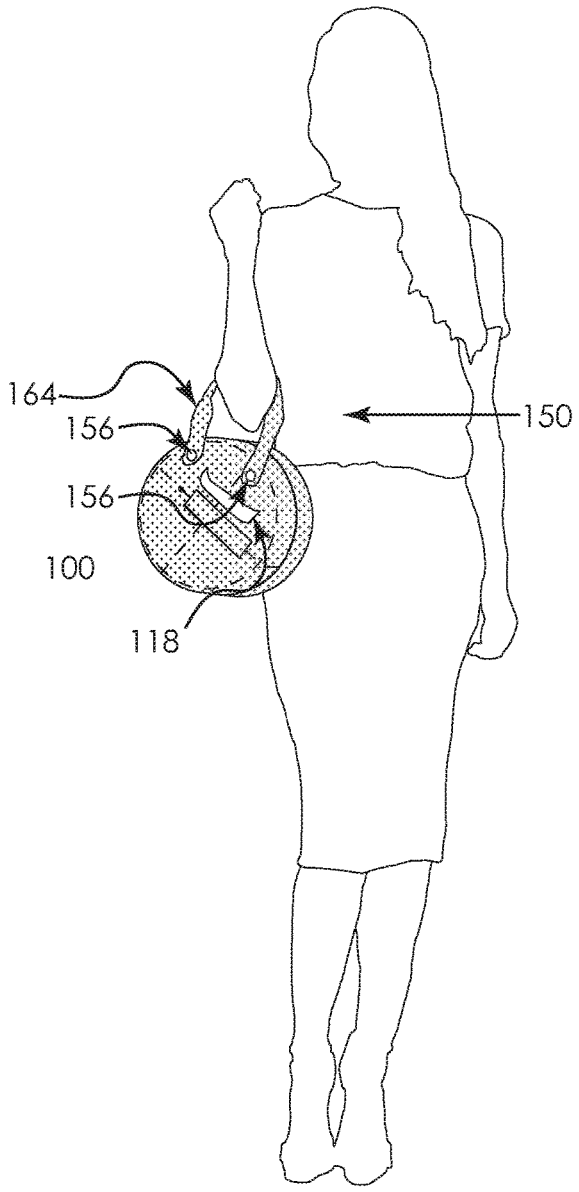

FIGS. 13*a*-13*b* show different ways of carrying examples of a travel bag substantially as hereinbefore described in the compressed configuration. In these examples, the lids (110) and/or (120) may be provided with fastening elements such that the belt (or strap) (154) used to carry the bag in the extended configuration can be adjusted to an outer surface of one or more of the lids (110) and (120). Mechanical joints such as clips, Velcro® o buttons (156) may be foreseen. The compressed configuration can thus become a traditional hanging bag as shown in FIG. 13*a*). Alternatively, the belt or strap may be replaced by handles (164) to transform the travel bag into a grab hand bag as shown FIG. 13*b*

Figure 15:
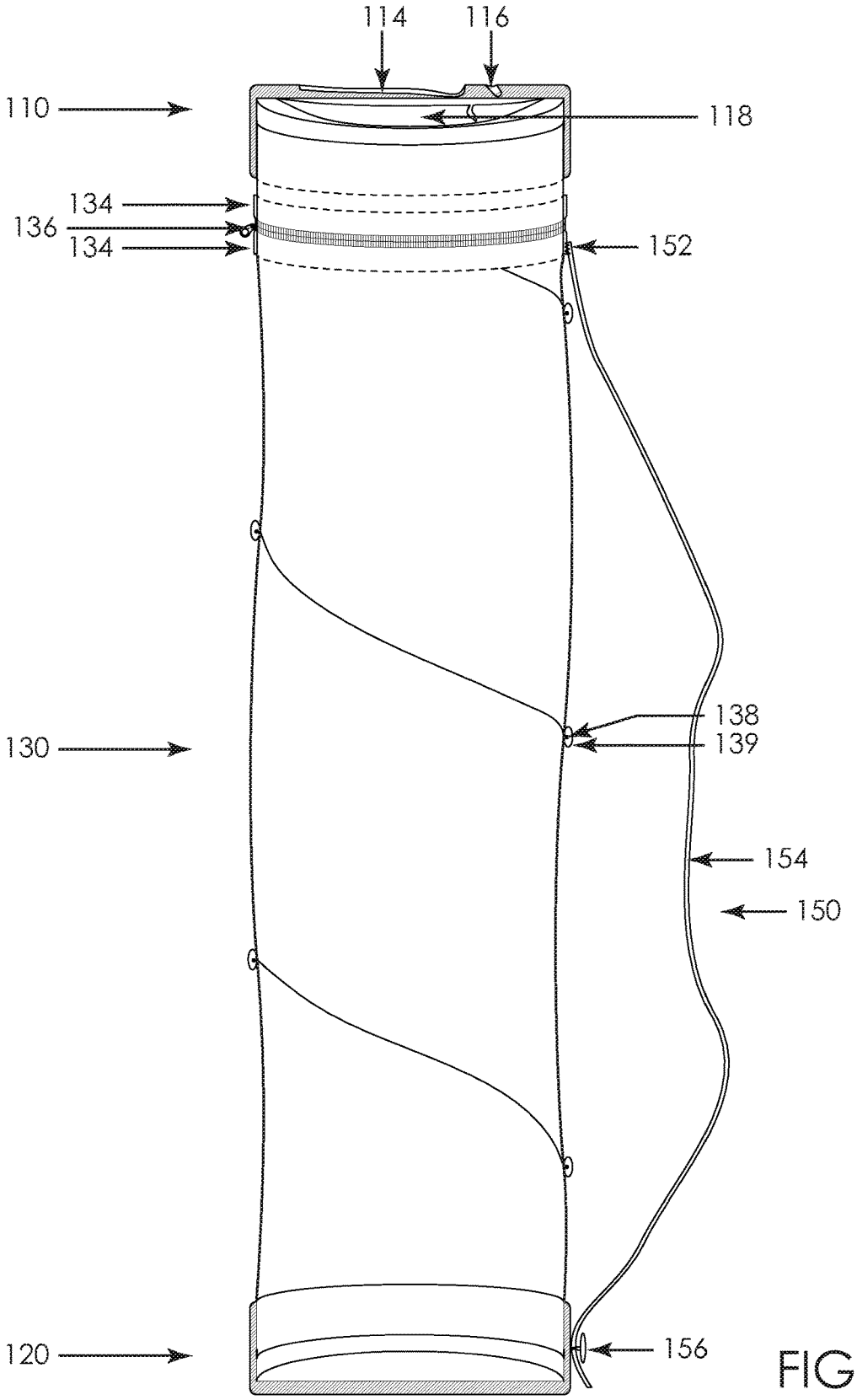
FIG. 15 shows a cross-sectional view of the travel bag of FIG. 1*a* in the extended configuration.

In all these cases, only shown in FIG. 13*b*, one or more of the lids may comprise one or more external pockets (118). The pocket (118) is also shown in FIG. 15 although in the example of FIG. 15 the pocket may be located inside the lid.

Figure 16:
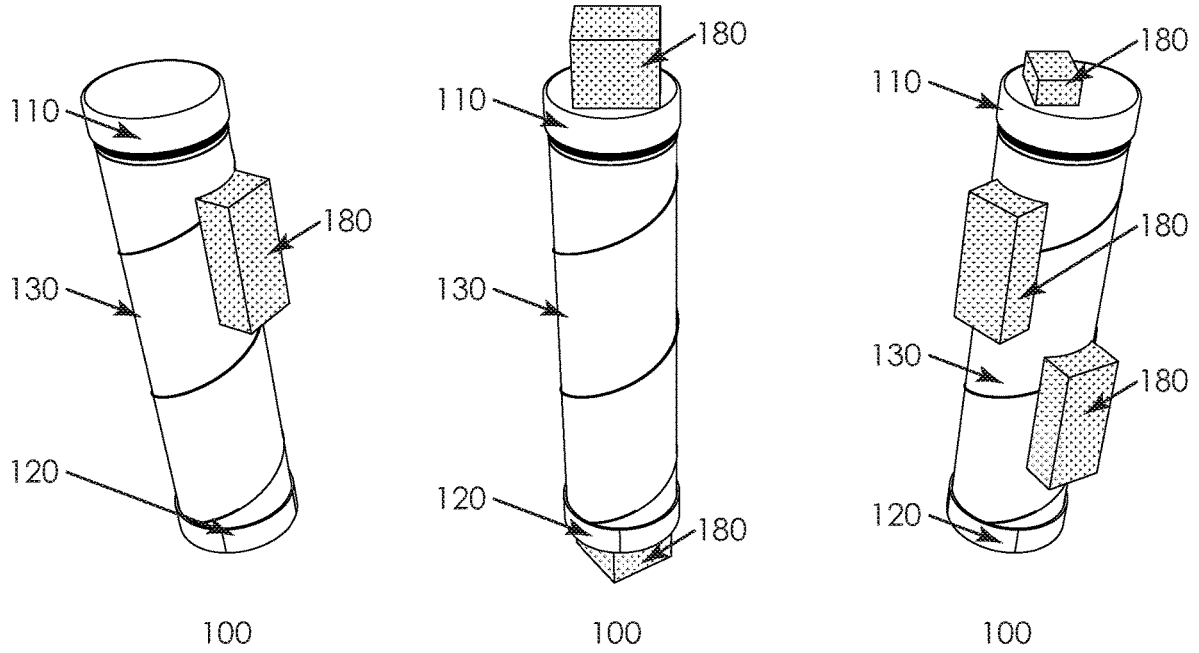
FIG. 16 shows examples of external supplementary storage compartments in the travel bag of FIG. 1*a* in the extended configuration.

In the example of FIG. 16 one or more supplemental storage compartments (180) may be provided in any one of the main body (130) or the first (110) and second (120) lids, or combinations thereof. These compartments (180) may be suitable for carrying personal objects of the user such as mobile phones, purse or keys. Other uses may also be foreseen.

Figure 17:
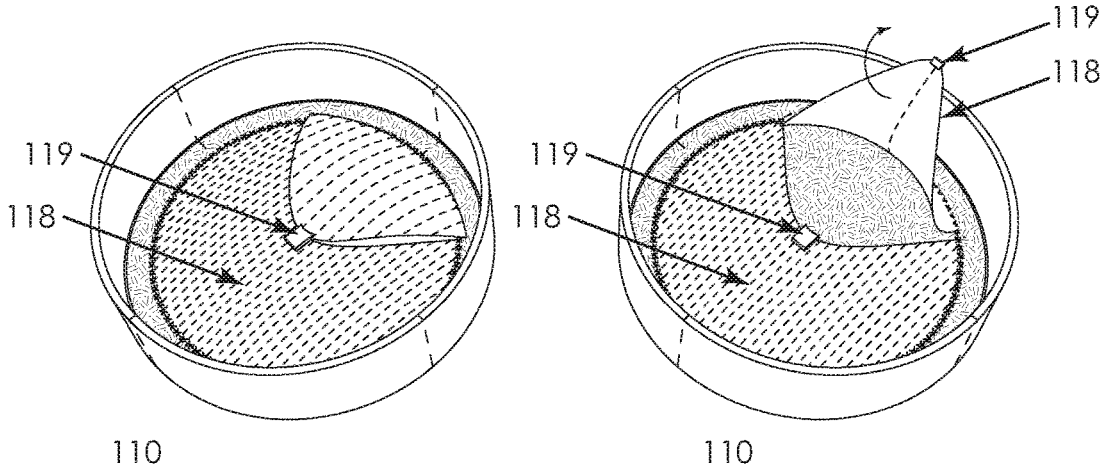
FIG. 17 shows examples of internal supplementary storage compartments in the lids of the travel bag of FIG. 1*a;*

FIG. 17 shows a top view of any of the lids (110 or 120) that may be provided with an internal pocket (118) with its own closure system (119). In more examples, other number of internal or external pockets may be foreseen. In yet more examples, some of these pockets may be removably arranged, i.e. they may be stuck to an outer surface by e.g. Velcro®. In other examples, the pocket may be permanently arranged.

FIGS. 14*a*-14*f* show examples of locking systems for the lids of a bag of FIGS. 1*a*, 4, 6 o similar in the compressed configuration, i.e. locking systems between the first (110) and second (120) lids. As a general rule, the locking system may be visible or not depending on its own design. Examples of visible locking systems are provided in FIGS. 14*a*-14*d* and examples of invisible locking systems are provided in FIGS. 14*e* and 14*f*. Other alternatives may also be foreseen.

Figure 14A:
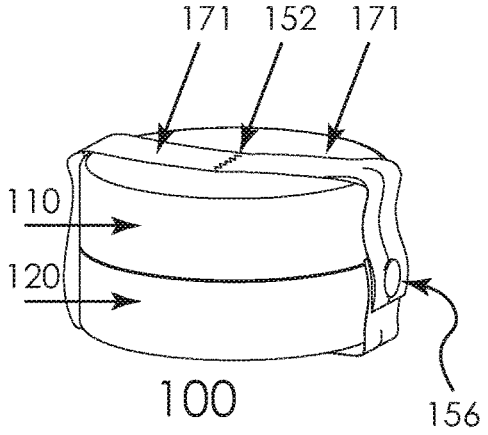
FIGS. 14*a*-14*f* show examples of locking systems for the lids of the bag of FIG. 1*a* in the compressed configuration.
Figure 14B:
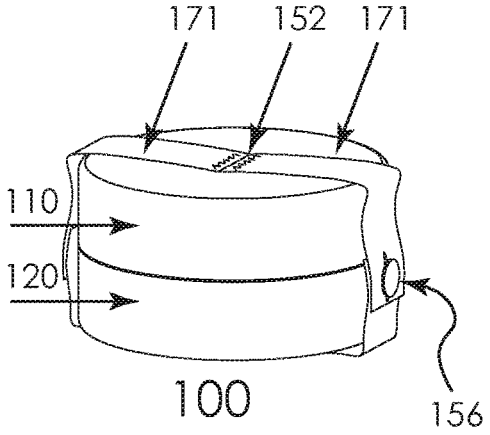
Figure 14C:
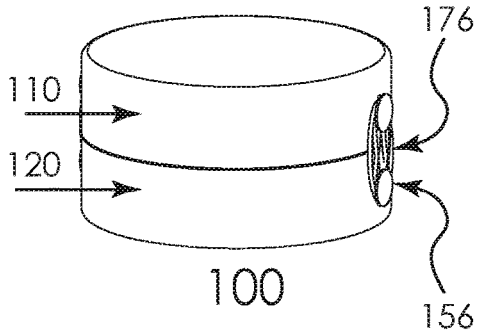
Figure 14D:
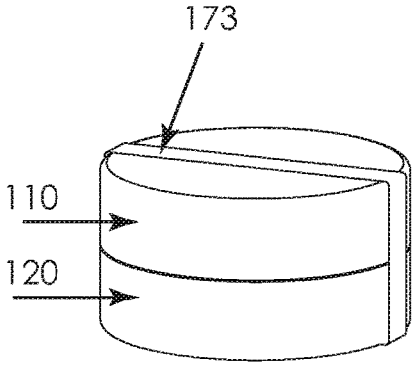

In the example of FIGS. 14*a* and 14*b*, the locking system may comprise a button/eyelet coupling 156 in combination with one or more bands (171). The bands (171) may be sewn (152) to the lids or they may be separate. In the example of FIG. 14*c* the button coupling (156) may be tied with a cord (176) or similar. In the example of FIG. 14*d* the locking system may comprise an elastic band (173) that may be arranged around the two lids (110) and (120) being brought together. In this example, the elastic band (173) may have a further use (in combination with the transport of a mat). It may be used as a resistance band for the practise of yoga or pilates. The button coupling (156) is also shown in the cross-sectional view of FIG. 15.

Figure 14E:
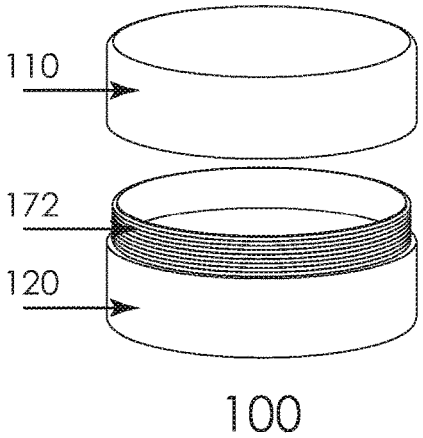
Figure 14F:
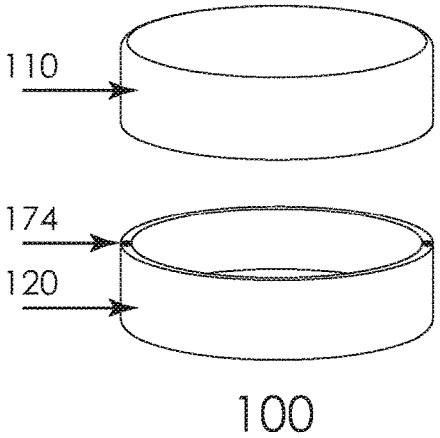

In the example of FIG. 14*e*, the locking system may comprise a matching thread at each open end of the first (110) and second (120) lids. And, in the example of FIG. 14*f*, the locking system may comprise a pair of magnets (174) at each open end of the first (110) and second (120) lids.

Figure 18:
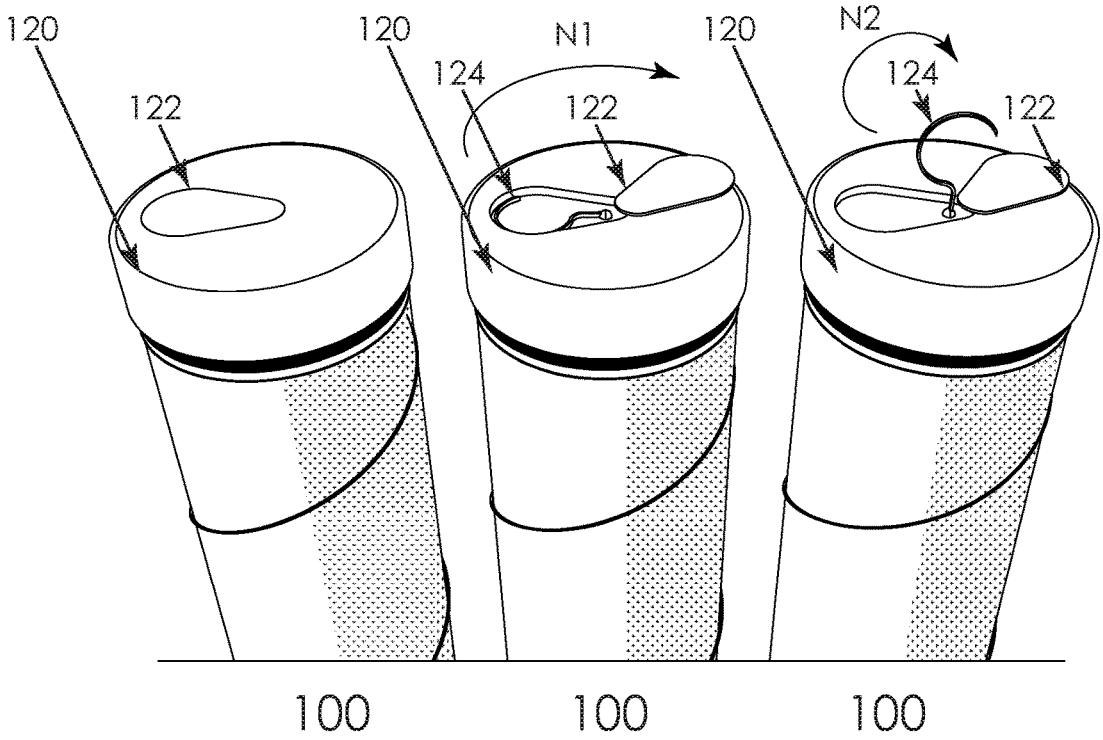
FIG. 18 shows a hanger element in the lids of the travel bag of FIG. 1*a;*

FIG. 18 shows an example of a hanger element that may be provided in any of the lids (110 and/or 120) of a travel bag substantially as hereinbefore described. In an example, the hanger element may be a hook (124) that may be hidden inside the outer closed end of any of the lids (110 or 120). To hide the hook (124) a rotatory notch/cover (122) (or notch with cover) may also be provided. FIG. 18 further shows a sequence from left to right showing how the hook (124) may be extracted. The sequence starts with a closed end of the second lid (120). The notch/cover (122) is rotated (see arrow N1) so as to discover the hook (124). In the next step, the hook (124) is pivoted upwards (see arrow N2) so as to become unfolded.

Figure 19:
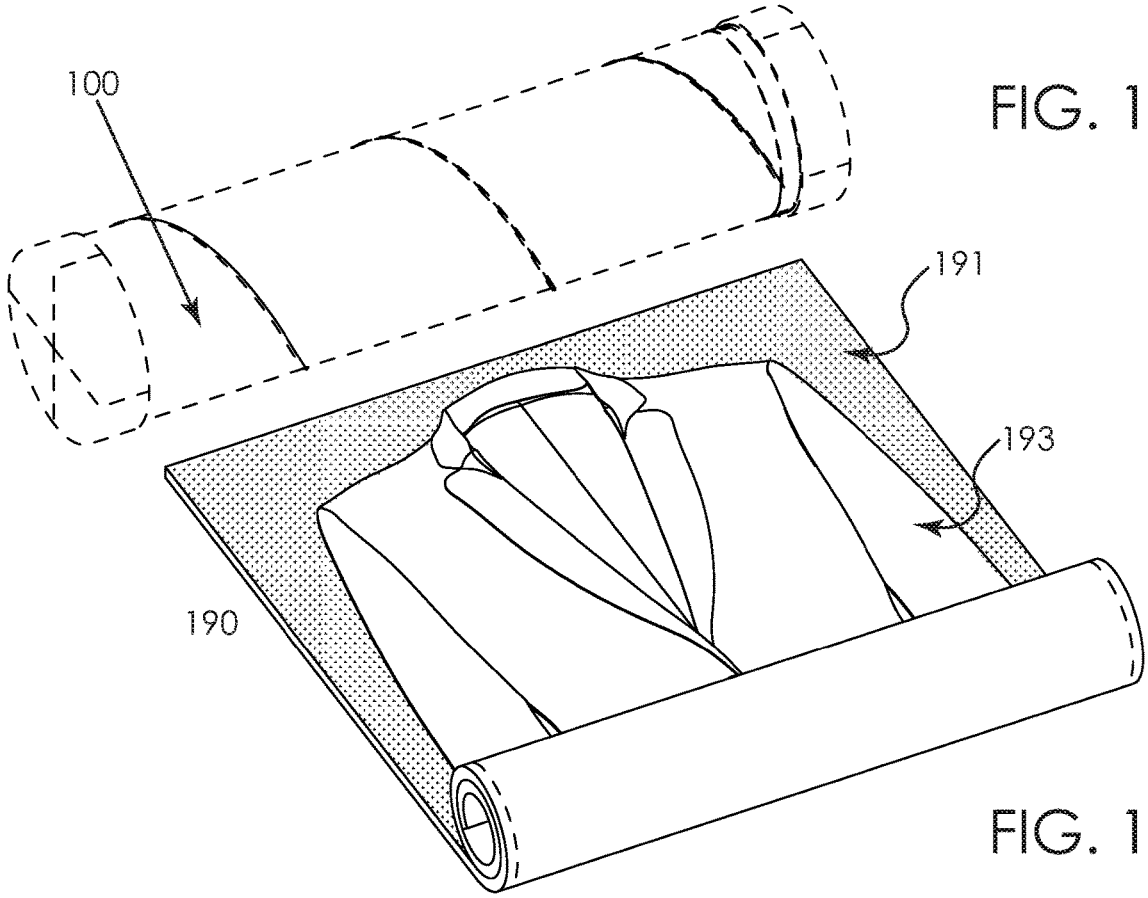
FIG. 19 shows a rolling garment sheet according to an example.

FIG. 19 shows a rolling garment sheet (191) that may be used to fold a garment. The sheet (191) may be rectangular. In more examples, the sheet may have a shape equal or similar to that of the garment to be wrapped, e.g. jacket, shirt, suit, dress. The rolling sheet may be made of a flexible or continuously bendable (in at least a primary rolling direction) material. Alternatively, it may be provided with a plurality of folding lines arranged perpendicularly to the primary rolling direction. In the example of FIG. 19, a method of storing a suit (193) inside a bag substantially as hereinbefore may further be explained. The sheet (191) may be arranged horizontally, the suit (193) may be provided on top of the sheet (191) and the arrangement sheet-suit (191+193) may be rolled-up to define a tubular body that may be fitted inside a bag (shown in broken lines) substantially as hereinbefore described. This packing system can reduce wrinkling of the garment. This packing and transportation of the garment may be of special interest e.g. in case of travelling with jackets by plane or at in hot climates where the garment can be carried in the travel bag before a meeting and then wear it upon arrival and juts during the event, ensuring or at least enhancing the possibility that there are no wrinkles: At the same time, saving space as the compressed configuration of the travel bag may be used as an elegant small accessory substantially as hereinbefore explained.

Figure 20:
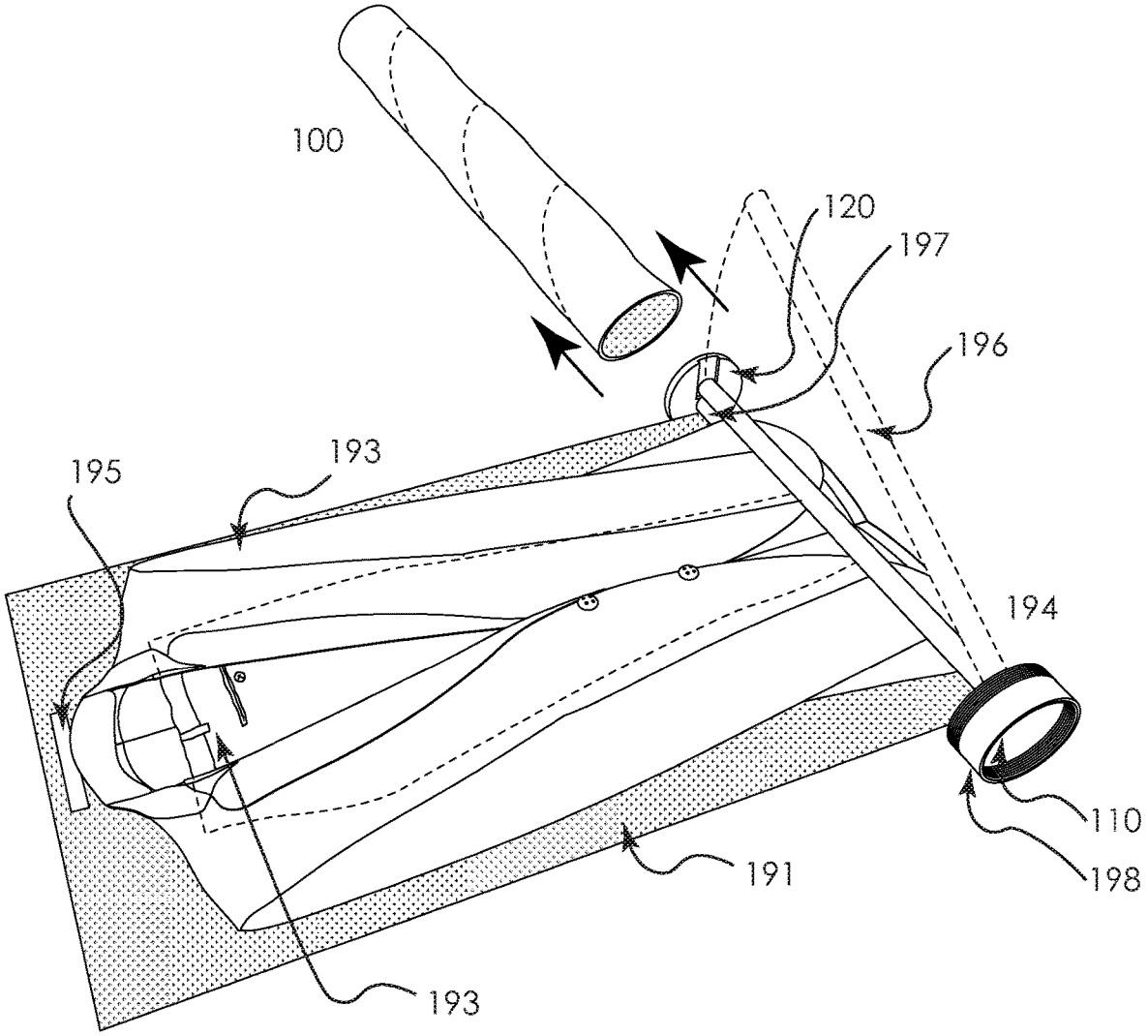
FIG. 20 shows an example of a garment rolling guide.

FIG. 20 shows a further example in which the rolling sheet (191) may be combined with a rolling guide. The rolling guide may be provided with a clipping system to fasten a garment to be rolled-up while it is being rolled-up. The clipping system may comprise two bars or rods (197) and (196) that are separable (see broken lines) from each other thereby fixing the suit (193) to be wrapped. In more examples, the two bars may be replaced by one or more clips or two fixed bars at one end. The provision of two bars enhances the ironing effect of the rolled condition in a garment.

In some cases, as shown in FIG. 20, the rolling sheet (191) may further comprise fastening members (195) to firmly secure the suit (193) while it is being rolled-up.

In some cases the garment rolling sheet is flexible or continuously bendable in at least a primary rolling direction or is provided with a plurality of folding lines arranged perpendicularly to the primary rolling direction. In other examples the rolling sheet is rigid or semi-rigid so as to be self-held in a tubular form once it is rolled-up. In further examples the garment rolling sheet is rectangular or has a shape substantially equal to that of a garment to be wrapped, while in other examples the rolling sheet further comprises fastening members to firmly secure a garment while allow rolling of the garment.

In more examples, a cover may be provided on top of the garment to further protect it while being transported. In more examples, the sheet may comprise one or more cut-outs through which the garment to be rolled-up can be at least partially inserted. And in yet more examples, a motor may be provided to automate the rolling of the sheet, similarly to rolling window shades or projection screens.

The rolling guide may be made of bamboo, paper, metal paper, cork, carbon fiber, nylon fiberglass, polyester, polymers, leather, graphite, cotton or other fabrics, foam, cardboard, plastics, rubber, thermos-formable materials, elastomers, shape-memory alloys, aramid fibers, aluminium and other light metals, recycled materials, biodegradable materials, jute, composites or aerogels.

Figure 21:
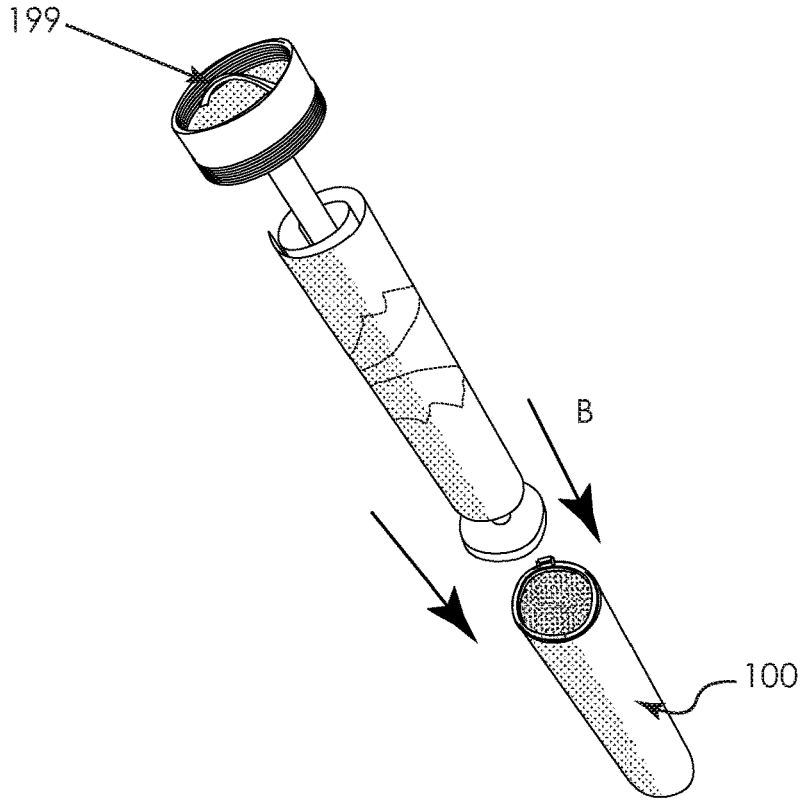
FIG. 21 shows an example of a garment rolling guide being inserted into a travel bag.

FIG. 21 shows an example of the garment rolling sheet with the suit being inserted (see arrow B) into a travel bag substantially as hereinbefore described. In this example, one of the lids may be provided with a hanger element (199) that may be fixed or removable. Velcro®, clips, hook-and-loop string or any other closing system may be foreseen for ensure locking of the packed suit.

Figure 22:
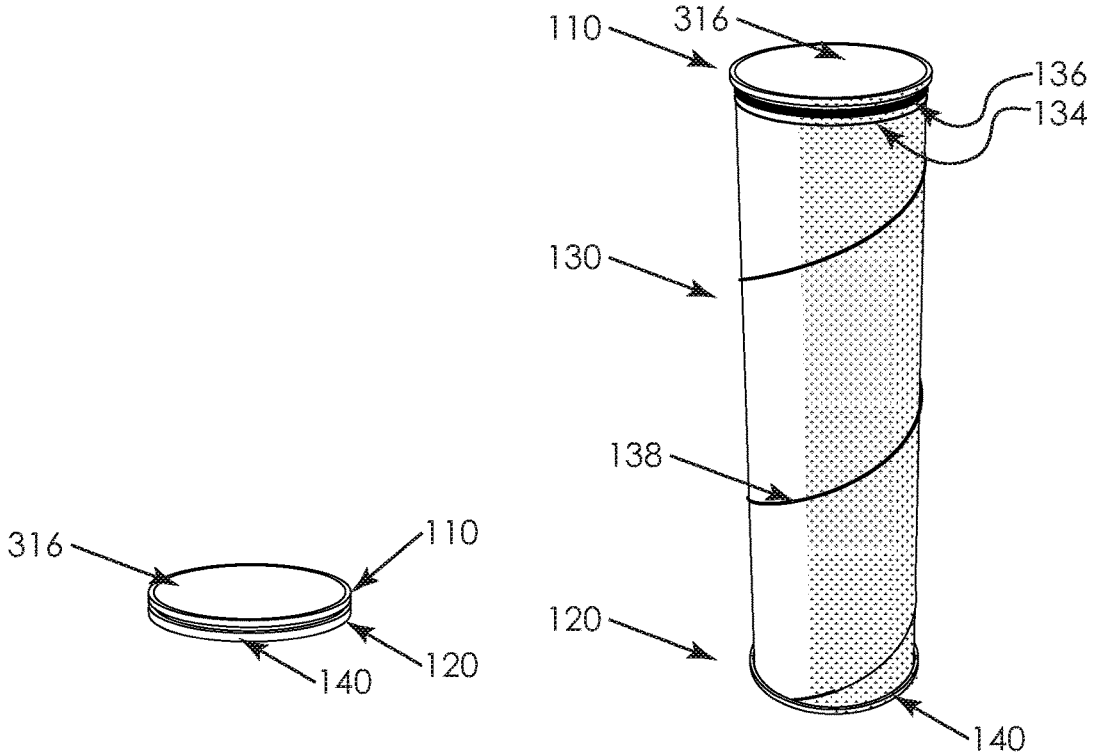
FIG. 22 shows an example of travel bag in the extended and compressed configurations.

The example of FIG. 22 differs from that of FIG. 1*a*, 4 or 6 in that the lids (110 and 120) may be compacted, i.e. a distance between an open end and a closed end of each of the lids (110 and 120) may be minimal, or they may even be virtually coincident. In these examples, an outer surface of the closed end of the lids (110 and/or 120) may comprise elements such as a mirror, note pad, digital screen or an area to expose inspirational, marketing or logistic features such as texts, diagrams, textures, drawings, patterns, bar codes, QR codes, logos or colours.

FIGS. 23*a*-23*f* show examples of travel bags in the extended and compressed configurations showing different alternative uses of the compressed configuration. These examples differ in the way the lids are built or fitted to allow any of this or other use.

Figures 23A, 23B, 23C, 23D, 23E, 23F:
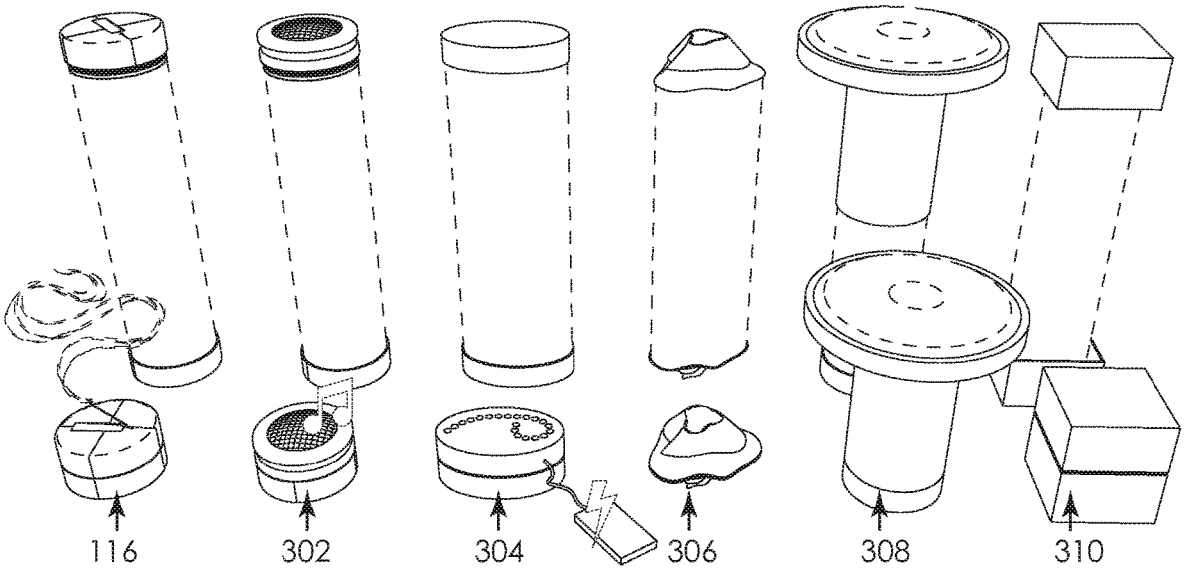
FIGS. 23*a*-23*f* show examples of travel bags of FIG. 1*a* in the extended and compressed configurations.

In the example of FIG. 23*a* at least one of the lids may be provided with an incense burner (116) as explained in connection with FIG. 1*a*. In the example of FIG. 23*b*, at least one of the lids may be provided with a speaker (302). Alternatively, one more electronic devices selected from a further speaker, a media player, a geolocation device, a digital screen, a light, a plug or an electronic ink display may be provided. In the example of FIG. 23*b*, at least one of the lids may be provided with a portable battery (304) for charging electronic devices. In more examples, other power sources selected from photovoltaic chargers, piezoelectric or kinetic chargers or any other portable energy device or power source able to charge a user electronic device may be foreseen.

In the example of FIG. 23*d* at least one of the lids may be provided with a sculpture (306). In the example of FIG. 23*e* at least one of the lids may be made rigid enough to be used as a seat (308). In the example of FIG. 23*f* at least one of the lids may be made of foam or cork to provide a yoga-pilates block usually used in the practise of these activities.

Figures 24A, 24B, 24C, 24D:
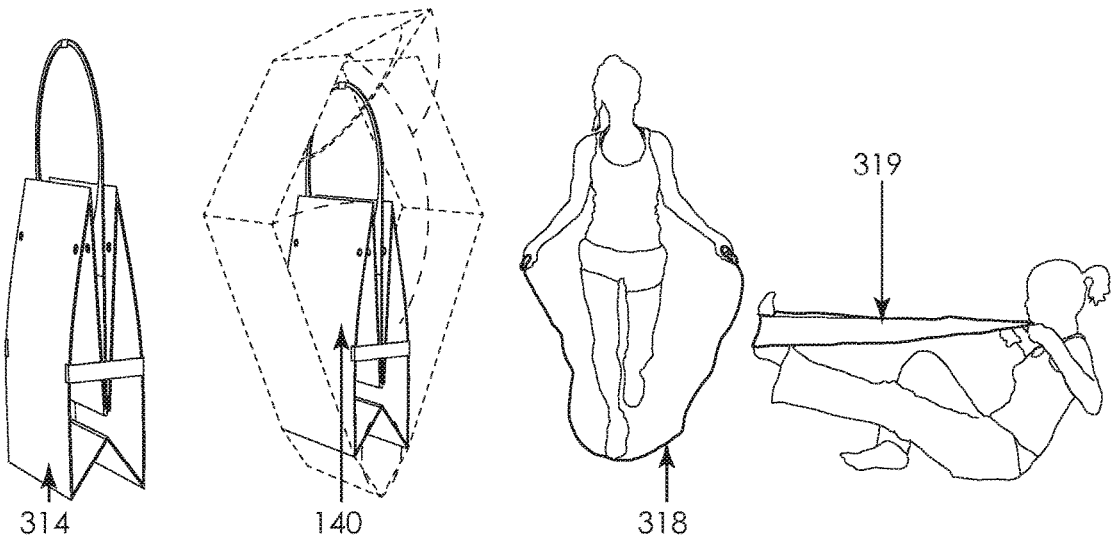
FIGS. 24*a*-24*d* show examples of the travel bag of FIG. 1*b* in the compressed configuration.

FIGS. 24*a*-24*d* show examples of the travel bag of FIG. 4 or 7 in the compressed configuration. In the example of FIG. 24*a*, a portion of the outer surface of the main body may be used as a notepad (314) in a similar manner as explained in connection with FIG. 4. This configuration may also function as a bag for articles that are smaller than the elongated article to be carried in the extended configuration. In the example of FIG. 24*b* this portion of the outer surface may be used to show a text or drawings. FIGS. 24*c* and 24*d* show alternative uses of the ropes or cords or bands use to close the bag in FIG. 1*b*, 4 or 7. In FIG. 24*c* a jumping rope (318) is shown and in FIG. 24*d* a resistance band (319).

Figure 29:
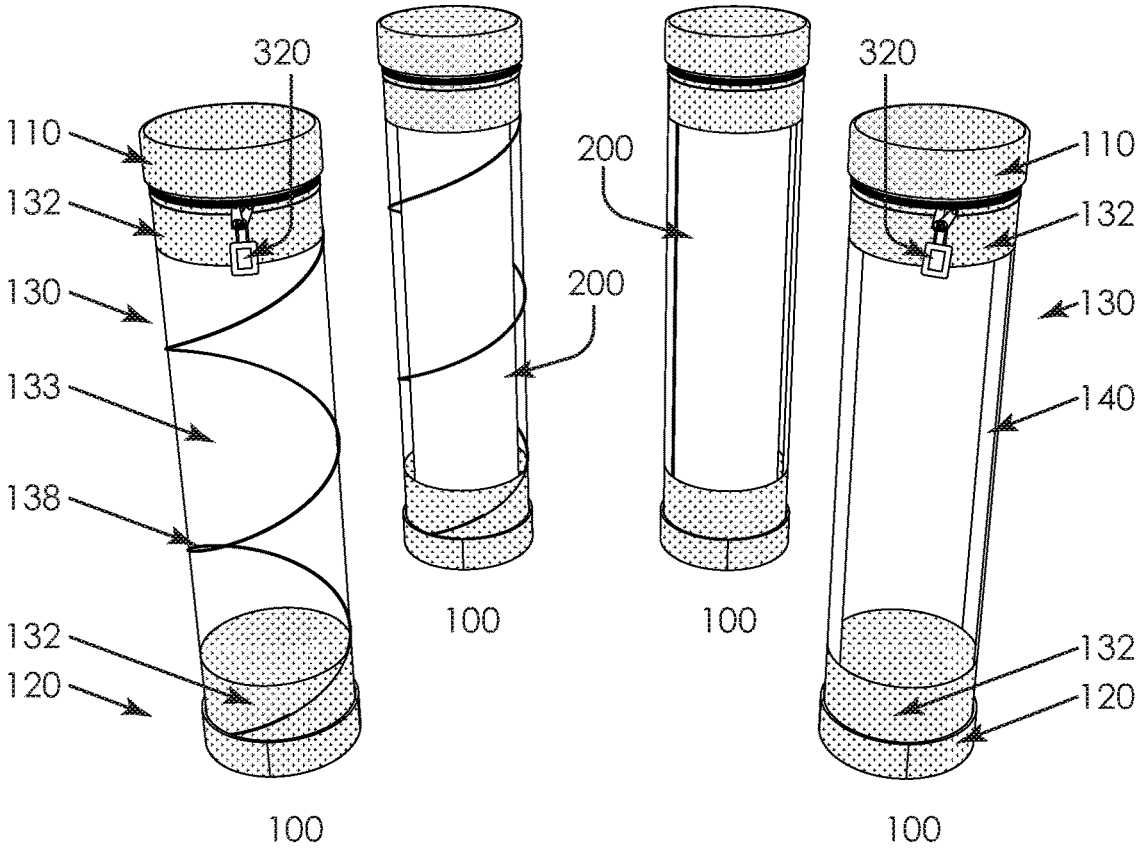
FIG. 29 shows examples of locking systems for travel bags in the extended configuration.

In some examples, the main body may be made of transparent or translucent materials. FIG. 29 shows examples of bags having a main body that is at least partially made of a transparent or translucent material. In these examples, the portion of the main body made of a transparent material is denoted with numeric reference (133) whereas the portion that is made of an opaque material is denoted with numeric reference (132). A locking system (320) may further be provided. The locking system (320) may be configured to authorize or control the opening of the bag.

In some examples, the locking system may comprise any of biometric locks, digital, electronic, magnetic, mechanical password locks or near-field communications.

Figure 30:
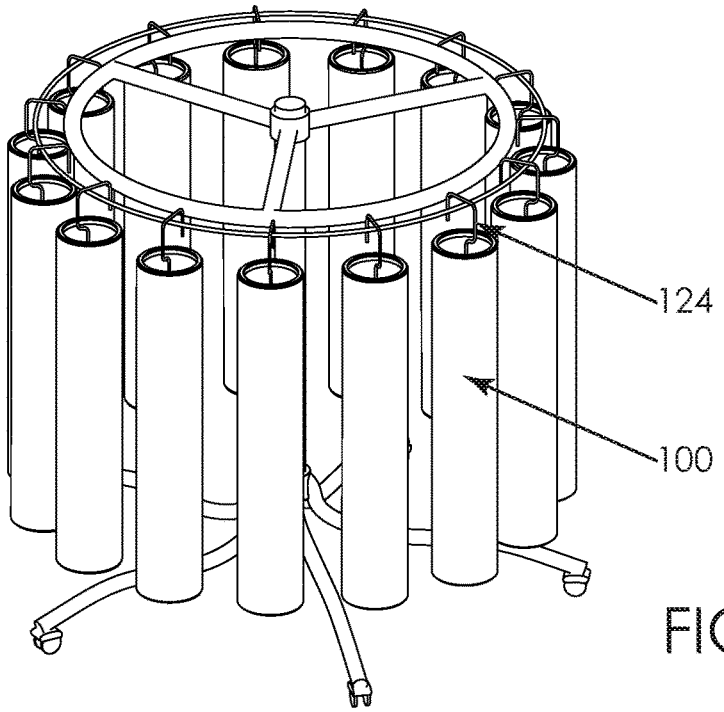
FIG. 30 shows an example of a plurality of travel bags in the extended configuration being displayed on a clothing rack.

In these examples, the bag may further solve a problem of displaying garments in reduced size stores as the garments may be displayed in a rolled condition hung from a relatively small display. FIG. 30 shows an example of a plurality of bags containing, e.g. a suit, being displayed in a hung condition from a clothing rack. A mannequin may be provided on top of the clothing rack wearing the garment that represents the style of the rest of the garments packed and displayed in the rack. This way the actual cloth, its texture and design can be exhibited without the need to take out the garments from the bags.

Figure 27:
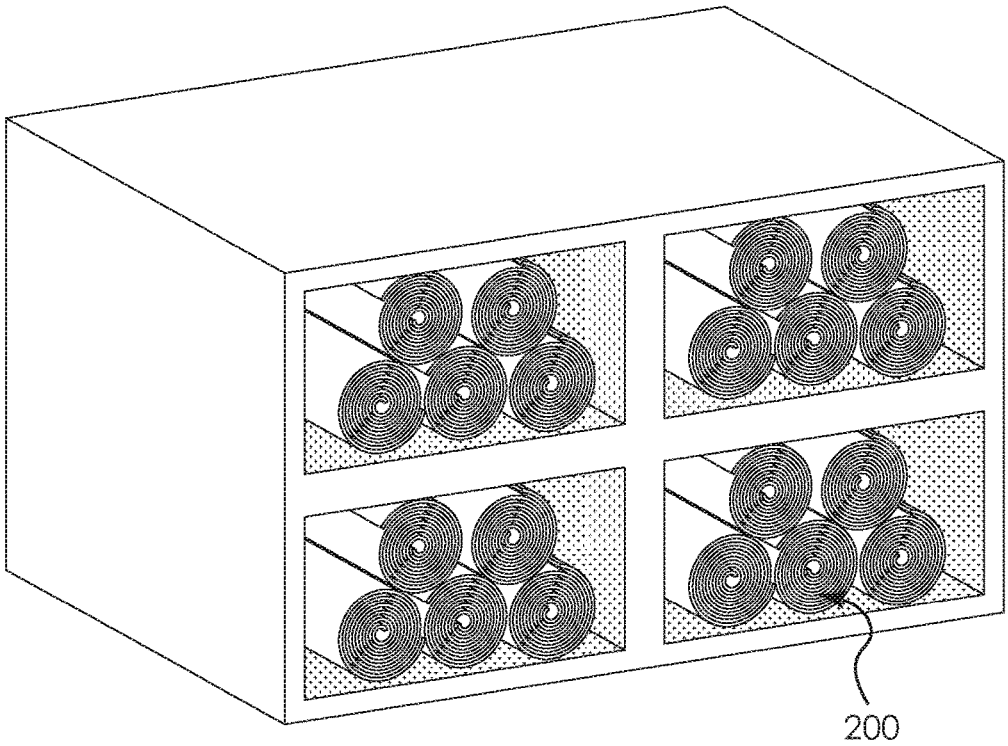
Prior Art FIG. 27
FIG. 27 shows a traditional storage of mats.
Figure 28:
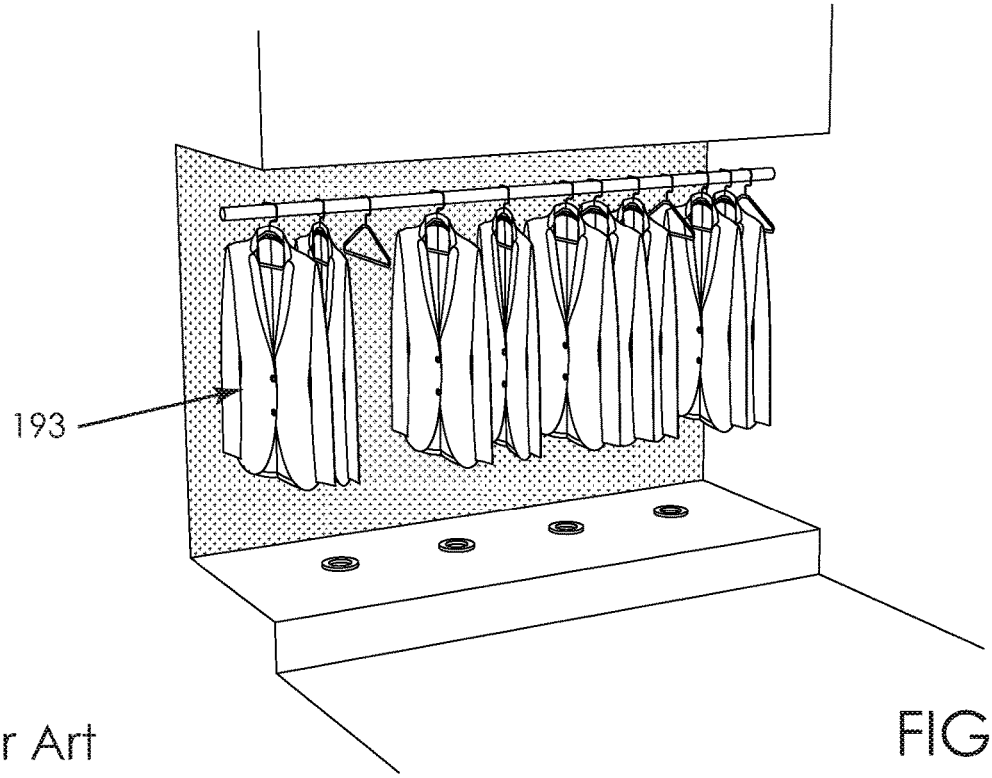
Prior Art FIG. 28
FIG. 28 shows a traditional display for selling garments.

FIGS. 27 and 28 display traditional set-ups for selling yoga-mats and garments respectively.

Figure 31:
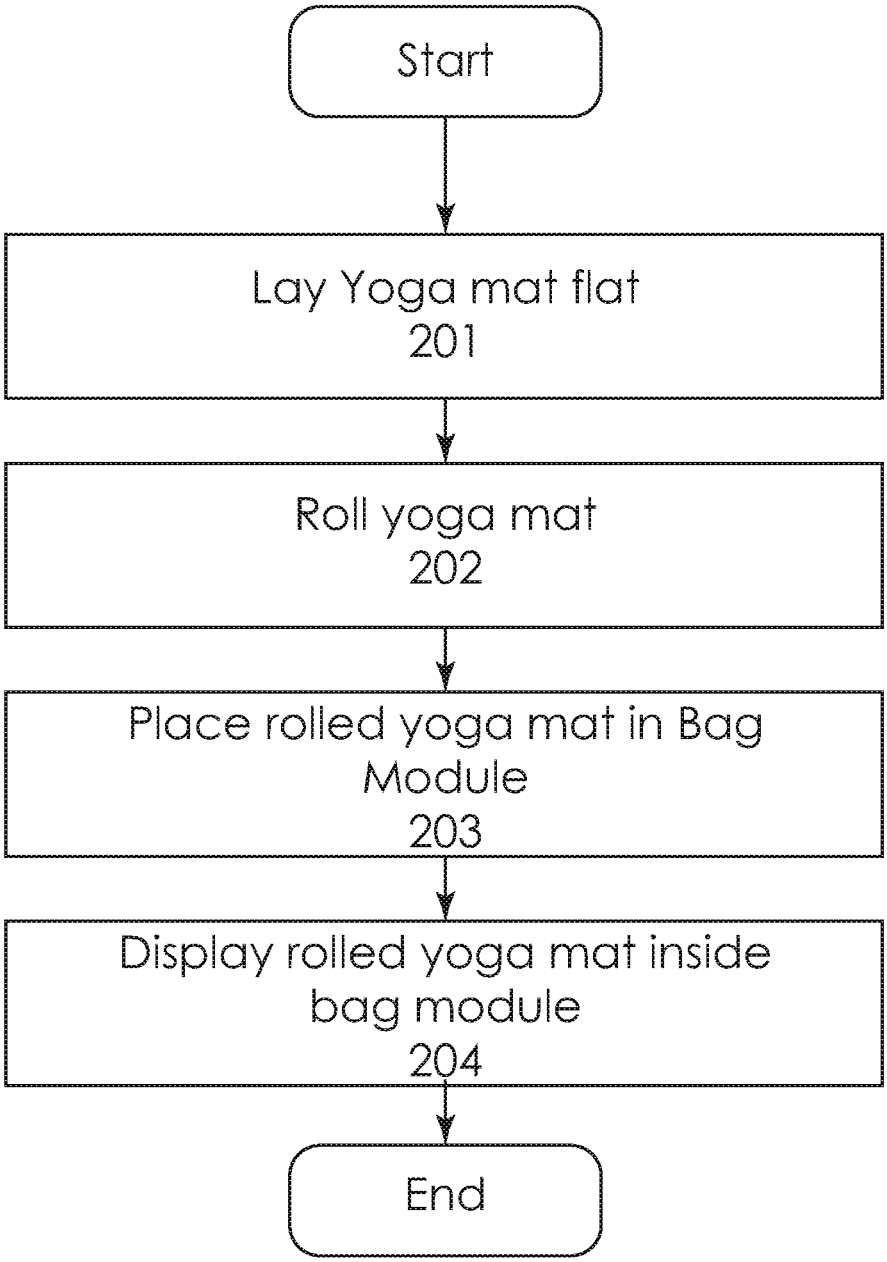
FIG. 31 shows a flow chart of an example of a method of displaying, selling or storing yoga mats being placed in a travel bag substantially as hereinbefore described.

FIG. 31 shows a flow chart of an example of a method of displaying or storing yoga mats being placed in a travel bag substantially as hereinbefore described. The process starts at step (201) with a travel bag according to any of above examples and a yoga-pilates mat to be rolled up and store within the bag. The yoga mat is laid flat. At step 202 the yoga mat is rolled up. At step (203), the rolled yoga mat is inserted into the bag (see e.g. FIG. 6, 7 or 26). At this point, examples of the storing process may comprise e.g. accommodating the bags in a horizontal configuration in rows, one next to the other and a row above the other and examples of a displaying process may comprise hanging the bags from a display rack.

Figure 32:
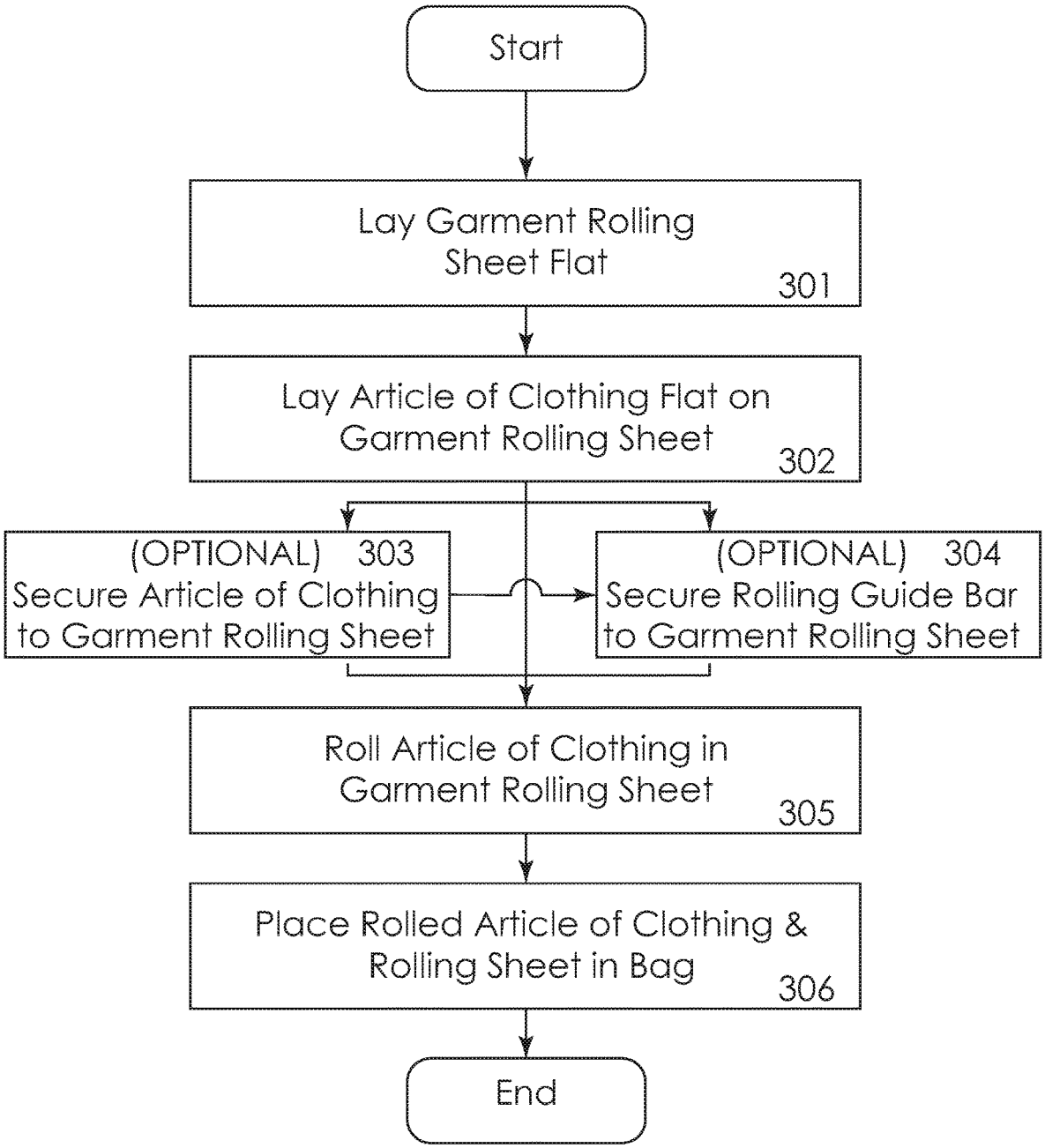
FIG. 32 shows a flow chart of an example of a method of displaying, selling or storing garments being placed in a travel bag substantially as hereinbefore described.

FIG. 32 shows a flow chart of an example of a method of displaying garments being placed in a travel bag substantially as hereinbefore described. The process starts with a plurality of travel bags according to any of above examples and a plurality of garments, e.g. suit, shirts, dresses, jackets, to be rolled-up and stored within the bag. The first step (301) involves laying a garment rolling sheet substantially as hereinbefore described in an extended condition, i.e. substantially flat (see FIG. 20). At step (302) a piece of garment is laid flat on the rolling sheet. After this, two optional steps may follow, either alone or in combination. In a first optional step (303), the piece of clothing is secured to the garment sheet to prevent the clothing from slipping off or moving while rolling up. And/or in a second optional step (304), the rolling sheet is secured to a rolling guide to ensure the clothing is properly rolled-up (see FIG. 20). At step (305) independently from steps (303) and/or (304), the piece of clothing and garment rolling sheet are rolled-up to form a tight roll to prevent wrinkling and other deformations of the clothing. At step (306), the rolled garment and sheet are inserted into the bag (see e.g. FIG. 21). At this point, examples of the displaying process may comprise hanging the bags from a display rack. The disclosed displaying method involves that each piece of clothing is previously stored within the bag and then the plurality of bags housing the pieces of clothing is hung from the display rack.

In some examples, as explained before, the bags with the mats or the pieces of clothing may be locked or sealed.

Figure 33:
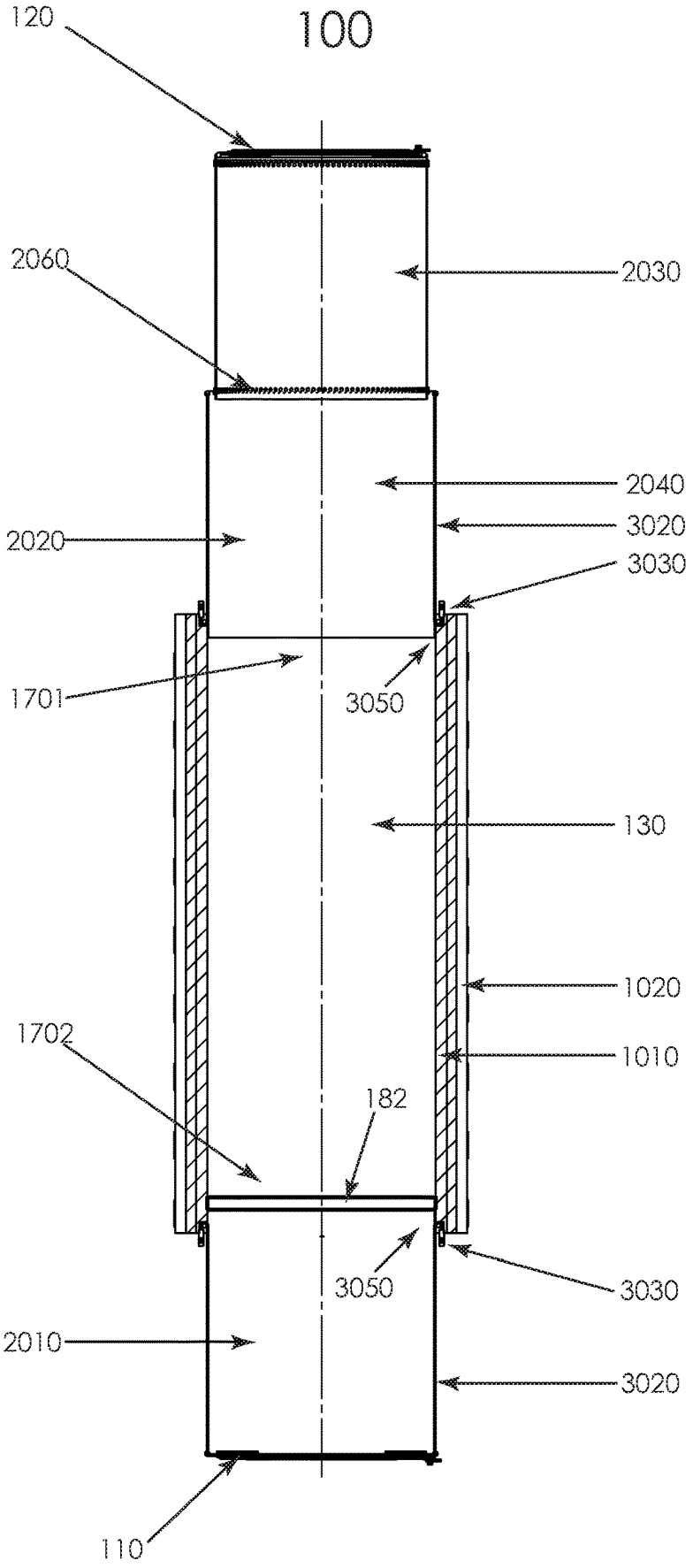
FIG. 33 shows a longitudinal section of the bag through the storage cavity.

Turning now to FIG. 33, it shows a longitudinal section of the bag (100) through the storage cavity of three bags modules, the first bag module (130) or main body, the second bag module (2020) and the third bag module (2010). FIG. 33 shows the hollow core (1010) and the roller body (1020) of the first bag module as well as the sub-modules of the second bag module (2020), consisting of the first sub-module (2030) and the second sub-module (2040) both connected by the zip connector (2060). FIG. 33 also shows the lid (120) of the second bag module (2020) and the lid (110) of the third bag module (2010). In the embodiment documented, the second bag module is connected to the first bag module at a first connection area (1701) and the third bag module is connected to the first bag module at a second connection area (1702). In these cases, the connection is permanent and is performed by gluing and/or sewing the modules at said connection areas. In alternative examples, a detachable option may be provided at these connection areas (1701) and (1702). FIG. 33 explains in section the side straps (3020) of the second or third module, their connector (3030) located at the end point of such straps and the device at the first bag module that acts as additional connector (3050) to said side straps (3020) and therefore to the module that has said straps. FIG. 33 also shows an inner lid (182) located inside the storage area of the bag (100) separating the storage area in said bag. Said inner lid may be permanent or removable with zips, velcro or other related connects as explained in the invention.

According to an embodiment of the present invention, a bag may be comprised of a first main module (130) and a second module (2020). The first bag module (130) may be used as a foam roller and consists of a rigid or semi rigid roller core (1010) and of a roller body (1020) on the exterior core surface of the roller core (1010). In some embodiments the roller core may be a hollow core, while in others such core (1010) may be solid, creating a solid first bag module (130). The second module (2020) may be connected to the first bag module (130) at a first connection area (1701). Said second module may incorporate a telescoping functionality to collapse into the first main module (130) to create a more compact form factor. In some embodiments a third module (2010) may be provided and connected to the first module at a second connection area (1702) located at the opposite side of said first connection area (1701). Said third module may also incorporate a telescoping functionality to collapse into the first main module (130). In some embodiments the said second bag module (2020) may comprise of two telescoping sub-modules, wherein the second sub-module (2040) is connected to the first bag module at the first connection area (1701) and the first sub-module (2030) is connected to the second sub-module (2030) by any kind of connector (2060) that allows the first sub-module to telescope onto the second sub-module or vice versa.

According to some embodiments of the present invention the first bag module (130) may comprise an elongated main body portion defined by a first end at one end of the main body portion and by a second end at the opposite end of the main body portion, a storage area formed inside of the main body portion and one or more module connectors located at a first connection area (1701). In some embodiments the main body portion may consists of a rigid or semi rigid hollow core (1010) that provides the said storage area. The first bag module may also be comprised of a roller body (1020) on the exterior core surface of the hollow core (1010). The roller body (1020) may have a generally elongated, cylindrical shape and may be a resilient material. The roller body (1020) may be glued and/or otherwise attached to the exterior core surface of the hollow core (1010). In other embodiments, the hollow core (1010) and the roller body (1020) may be molded as one piece according to the knowledge of those skilled in the art. In other embodiments the hollow core (1010) and the roller body (1020) may be the same material and element. In other embodiments, the hollow core (1010) or the roller body (1020) may be perforated to reduce the weight while in others they will be continuous. In some other embodiments the hollow core (1010) may be a tube comprising a soft element with a metal helicoid string, or alike, that provides the strength to the hollow core while being very light. In some other embodiments the hollow core may consist of a corrugated or textured tube to provide higher load resistance. In some embodiments where the hollow core consists of a soft or semi-rigid material a third material consisting of a mesh or grill may be provided between the hollow core and the roller body to provide rigidity to the overall bag. One of ordinary skill in the art would appreciate that numerous possible ways to connect or combine the hollow core and the roller body, and embodiments of the present invention are contemplated for use with any such component or configuration.

According to some embodiments of the present invention the first bag module (130) may comprise a first end of the bag module, located at the first end of the main body portion of the bag module, and a second end of the bag module, located at the second end of the main body portion of the first bag module.

According to some embodiments of the present invention the hollow core (1010) at the first bag module (130) may be a rigid or semi rigid material and with cylindrical shape. In some embodiments the said rigid hollow core (1010) may have a shape having a cross-section with a shape selected from, but not limited to, circular, oval, elliptical, triangular, square, hexagonal, spherical, or similar shape. In some embodiments the hollow core (1010) may be perforated to create a lighter element while in others such hollow core may be a continuous tube. In some embodiments the hollow core (1010) may get deformed under a light load, being able to hold the maximum load of one kid's hand pushing towards the inside of such hollow core, while in other embodiments the hollow core (1010) may take the entire load of one heavy person jumping on it. In some embodiments the hollow core (1010) may be perforated to create a lighter element while in others such hollow core may be a continuous tube. The said rigid hollow core (1010) may consist of hard or light materials. Such materials may be selected from, but not limited to: plastics; metal; carbon fiber; fiberglass; polyester; polymers; graphite; thermo-formable materials; elastomers; shape-memory alloys; aramid fibers (e.g. Nomex® or Kevlar®); aluminium and lightweight metals; or combinations thereof. In other embodiments the materials of the rigid hollow core (1010) may be environmentally friendly by being recycled, recyclable or biodegradable and such hard and light materials may be selected from, but not limited to: bamboo; coconut fibers; hemp; wheat straw; carrot fiber; mycelium; cardboard; wood; plant fibers; bioplastics; cellulose; recycled aluminium and other recycled metals; biocomposites; or combinations thereof.

Figure 34:
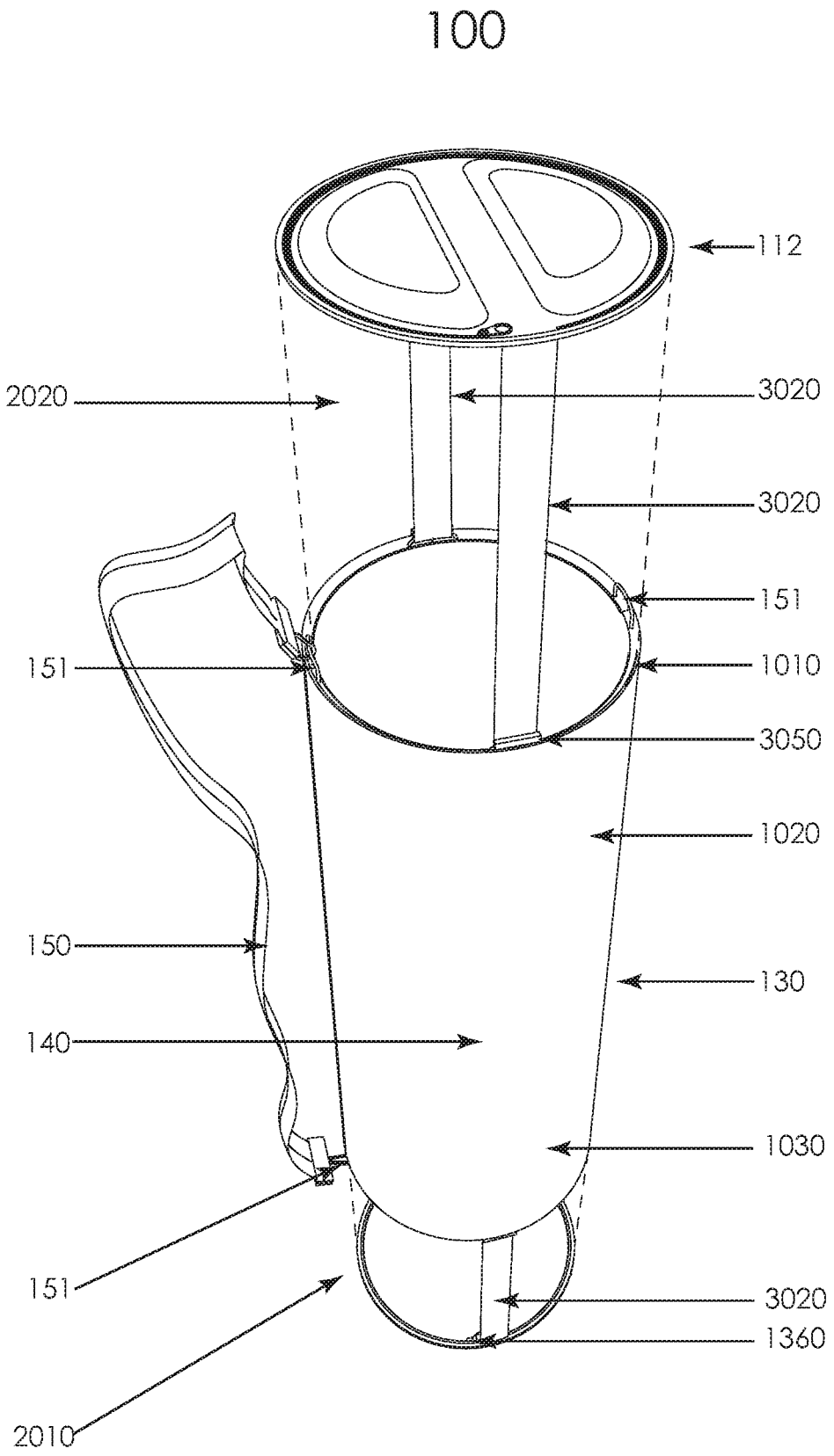
FIG. 34 shows an extended configuration of the foam roller with a flat surface of the main module and showing the main structural elements of the bag.
Figure 35A:
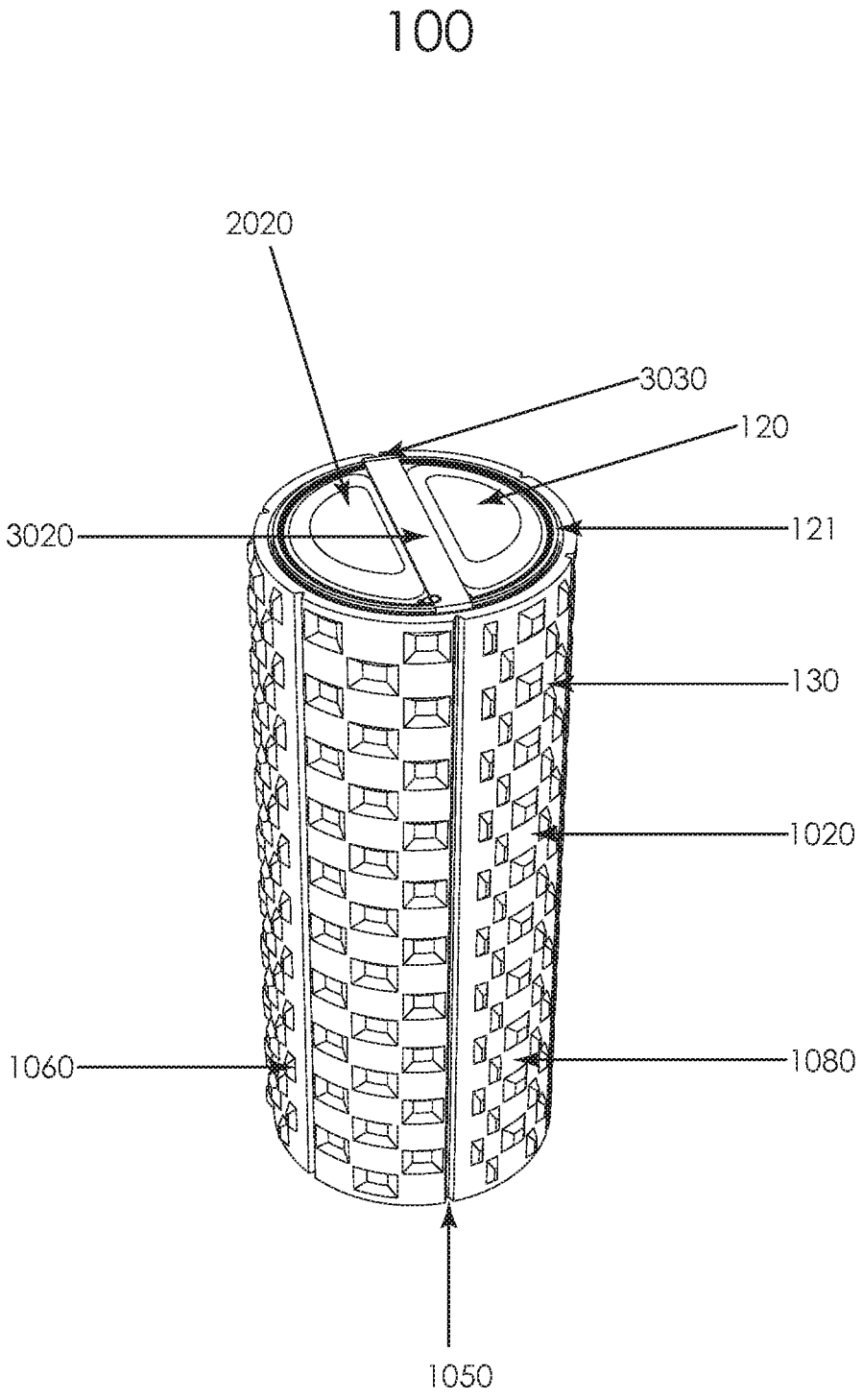
FIG. 35*a* shows the foam roller in the compressed configuration.
Figure 35B:
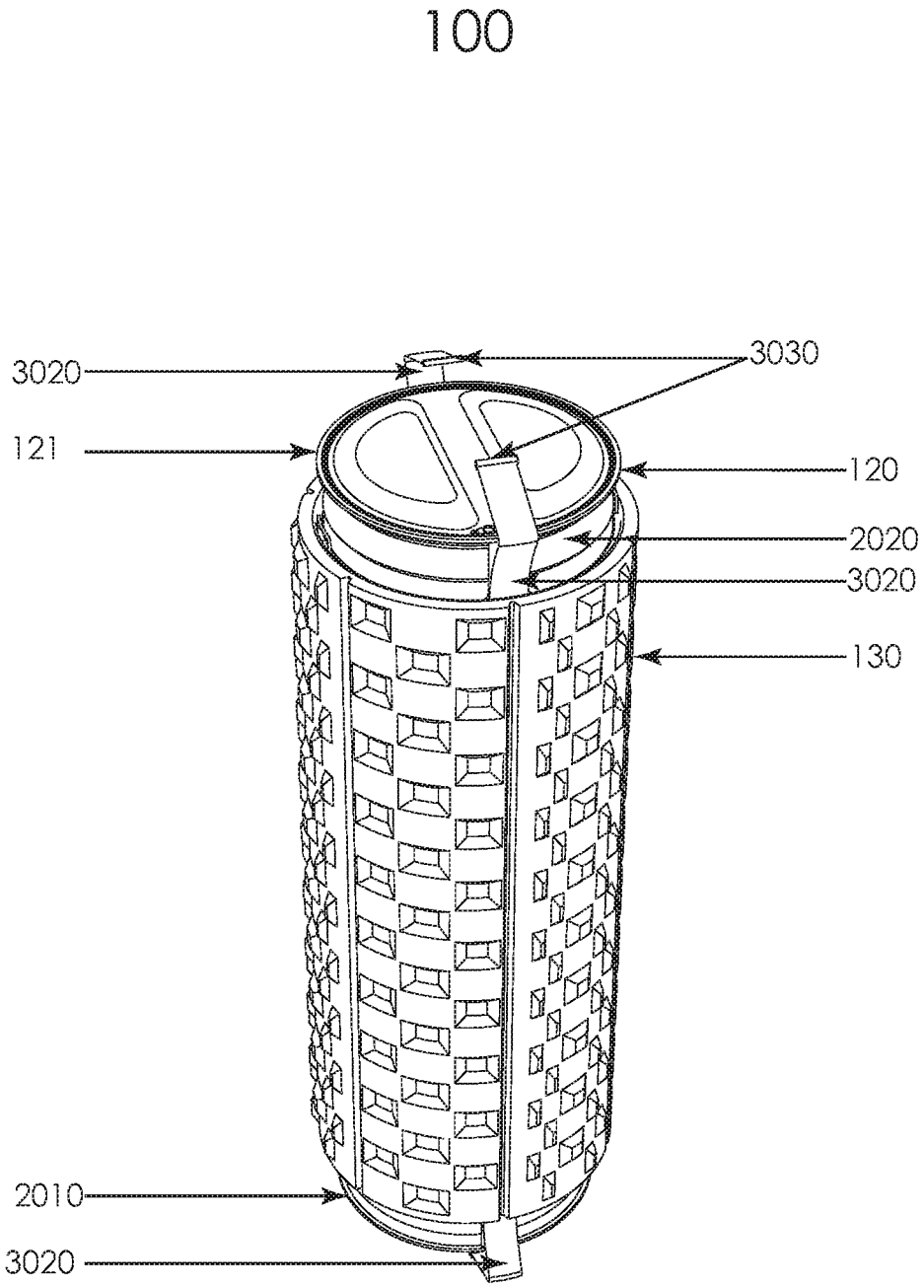
FIG. 35*b* shows the foam roller in an intermediate configuration.
Figure 35C:
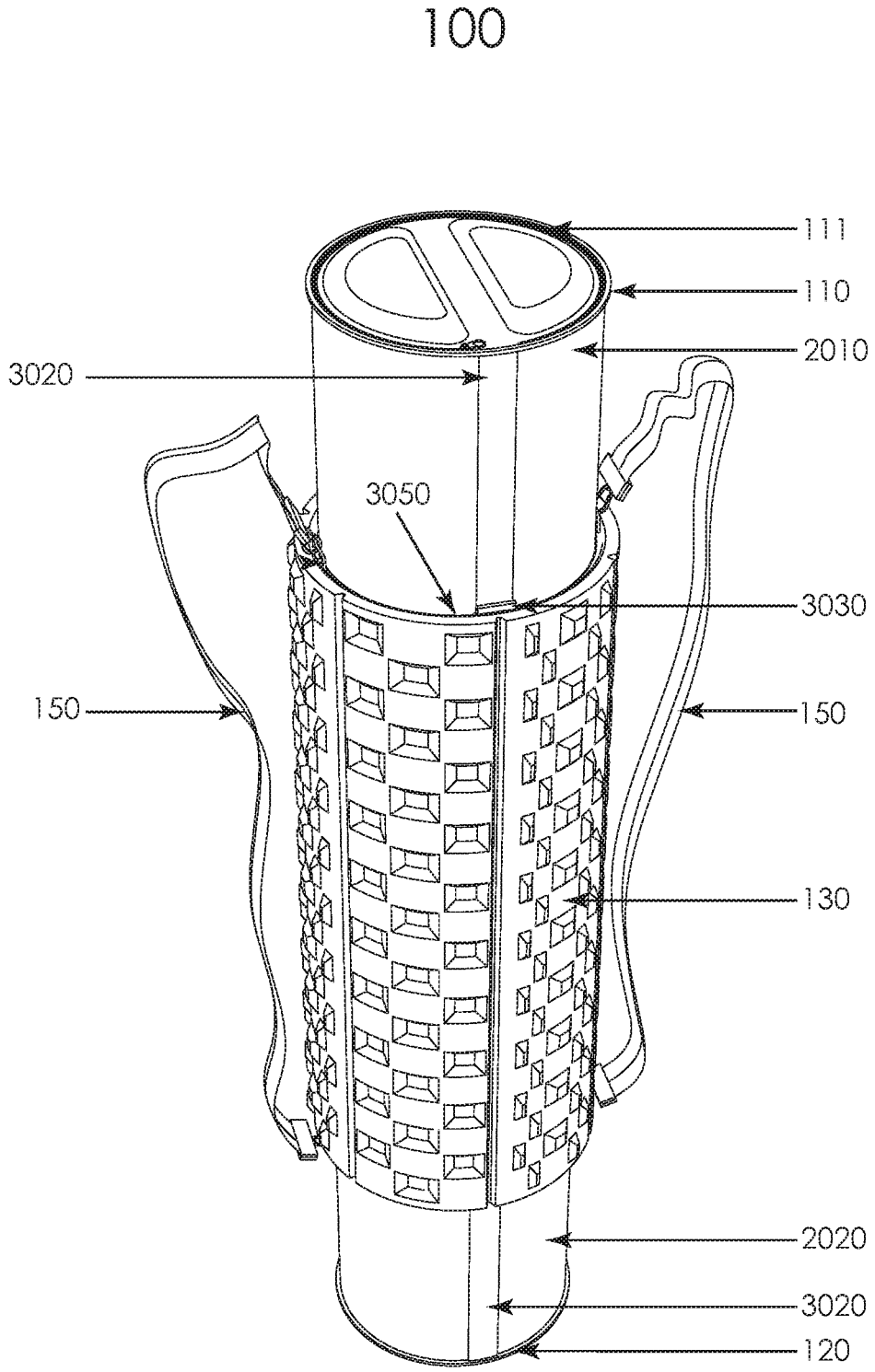
FIG. 35*c* shows the foam roller in an extended configuration.
Figure 35D:
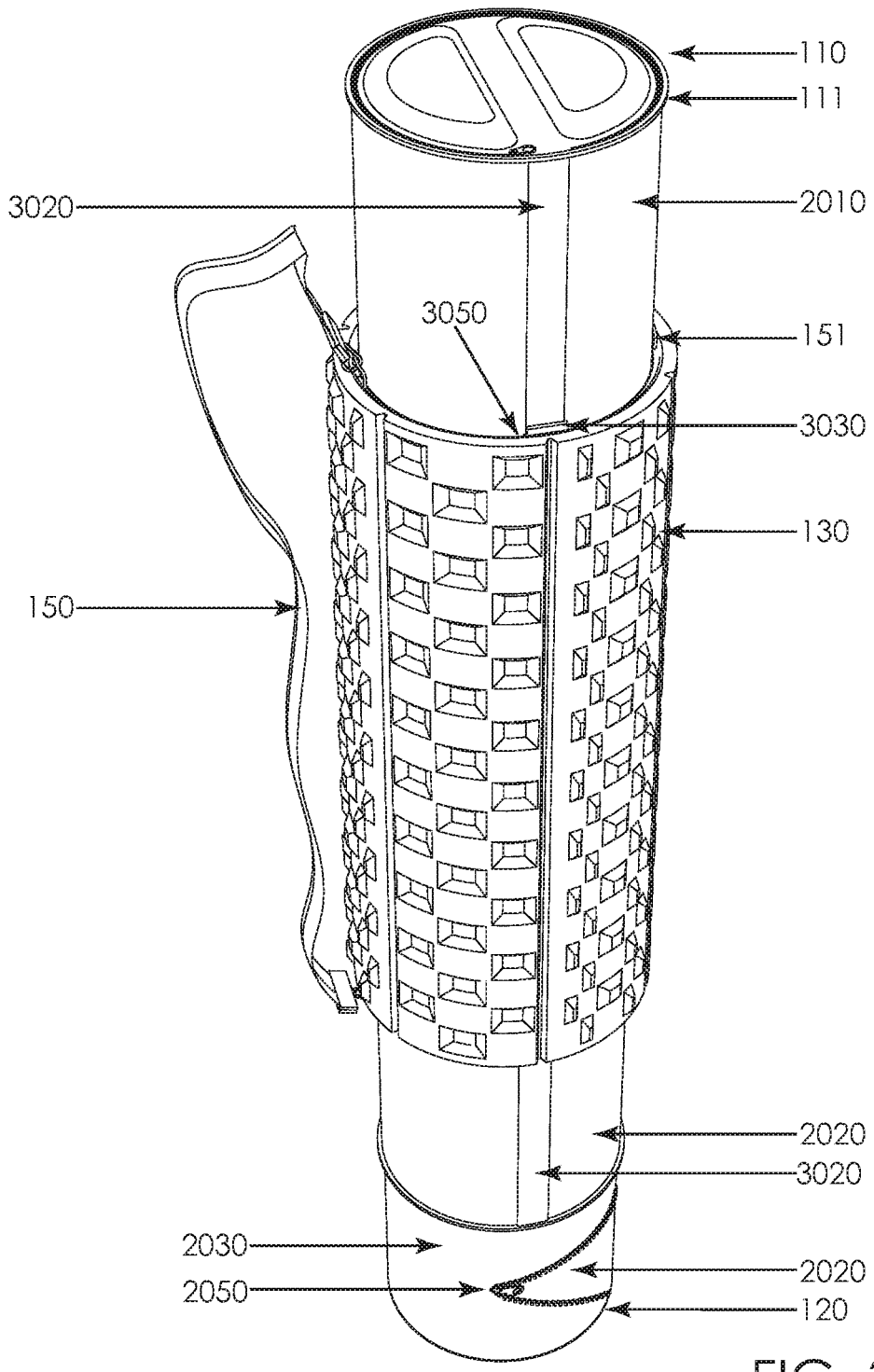
FIG. 35*d* shows the foam roller in an extended configuration with a telescopic compressible body at one of the secondary modules.

Turning now to FIG. 34, shows the bag (100) with a flat surface (1030) at the roller body (1020) of the first bag module (130), which also includes drawings or diagrams in said surface (140). FIG. 2 also shows some of the most relevant structural and connection elements of the invention. The first bag module (130) comprises a hollow core (1010) that is soft, rigid or semi rigid and that includes connectors (3050) for connecting with the second bag module (2020) and with the third bag module (2010). Said second and third bag modules may include connectors to connect with said first bag connectors (3050) and that may be side strap (3020). Such side straps may hold to the first bag module connectors by sliding through a hole that said first bag connectors (3050) may provide. Said side straps (3020) may be connected at the second bag module, permanently or in a removable matter, to a rigid and flat in nature element (112) located at the first end of the second bag module (2020). In some embodiments they may not be any material closing the side of the second bag module (2020) while in others there may be fabrics or alike materials that provide a closure of the storage area of said second bag module. Said side straps (3020) may also exist at the third bag module (2010) and may be connected permanently or in a removable matter, to a rigid ring (1360) located at the first end of the third bag module (2010). The said side straps (3020) may be elastic or may be foldable and may be may be an elongated rubber, leather strap; paper; nylon; fiberglass; polyester; polymers; plastics; graphite; thermo-formable materials; elastomers; shape-memory alloys; aramid fibers (e.g. Nomex® or Kevlar®); or combinations thereof. In other embodiments the materials of the side strap (3020) may be highly environmental by being recycled, recyclable or biodegradable and such materials may be selected from, but not limited to: cork; paper; pulp; bamboo; coconut fibers; hemp; wheat straw; carrot fiber; mycelium; cardboard; wood; natural rubber; cotton; wool and other fabrics; leather; plant fibers; bioplastics; cellulose; recycled aluminium and other recycled lightweight metals; jute; biocomposites; or combinations thereof. The first bag module (130) may also include connectors (151) for holding elements (150).

According to some embodiments of the present invention the roller body (1020) of the first bag module (130) may provide multiple massage zones in just one zone. In other embodiments there may be various densities in the roller body (1020) while in other they may be only one density in said roller body. In other embodiments the roller body may be textured (104) while in other embodiments said roller body may be flat (1030).

Turning now to FIGS. 35*a*-35*d*, they show the different configurations of the bag. FIG. 35.*a* shows the bag (100) in a compressed configuration where the length of the bag (100) is nearly the same as the length of the first bag module (130). Said first bag module comprises a surface area which is created by the roller body (1020) and which may be flat in nature with only one material or may have different textures and materials. In the embodiment of the FIG. 35.*a*, the roller body (1020) includes serrations (1080), longitudinal zone channels (1050) and massage fingers (1060). FIG. 35.*a* also shows the side strap (3020) being unlocked at their connectors (3030) from the lid (120) of the second bag module (2020). Such connectors may lock and lock with magnets located in both the lid (120) and the connectors at the ends of the side straps (3020). FIG. 35.*a* also shows the opening provided at the lid (120) to access the storage area of the second bag module, where such opening is closable with a zip (121) or alike. FIG. 35.*b* shows the second bag (2020) and the third bag (2010) being pulled out of the compressed configuration. FIG. 35.*c* shows the extended version of the bag (100) upside down, in such a way that the second bag module is now on the lower part of the bag. FIG. 35.*c* shows a third bag module (2010), its side straps (3020) with similar or same characteristics of the second module, the lid of said third module (110) and the zip device (111) that closes the opening to access to the storage inside the third bag module. FIG. 35.*c* also shows the connectors at the end points (3030) of the side straps (3020) holding the position of the second and third bag modules, thanks to an element at such end points (3030) that is bigger than the hole provided at the connectors (3050) of the first bag module. FIG. 35.*c* also shows two straps (150) connected to the bag (100) to support in the carrying of such bag either as a backpack or as any other means of transportation associated with straps. FIG. 35.*d* shows the second bag module comprising two telescoping sub-modules, a first sub-module (2030) and a second sub-module (2040). FIG. 35.*d* also shows the first sub-module in a telescoping configuration with a zip (2050) that allows such configuration.

According to some embodiments serrations (1080) may be provided at the roller body (1020) to grip the surface and to ensure that the roller rolls and does not slide. In some embodiments, multiple longitudinal zones channels (1050) may extend into the exterior surface of the roller body (1020) separating the areas with different textures and/or densities. In other embodiments multiple circumferential zone channels may extend into the exterior surface of the roller body (1020). In some embodiments the roller body may comprise a plurality of massage fingers (1060) each comprising an outward tip, an inward base, and a center axis central to the outward tip and the inward base, the center axis extending to a center of the hollow core (1010). In some embodiments the roller body (1020) may have discs, cushioning elements, spherical tips, sloping conical side walls, raised welts, ridges, buttons, rotatable parts, nodules, prongs, projections or protuberances arranged in either a staggered or geometrical relationship. In some embodiments the roller body (1020) may have decorative texts, diagrams, drawings and patterns, art representations, logos, specific colours or alike (140) to provide a more esthetic look to the bag while being used for transportation. One of ordinary skill in the art would appreciate that there are numerous possible ways to provide the finish texture and look to the roller body (1020), and embodiments of the present invention are contemplated for use with any such component or configuration.

According to some embodiments of the present invention the roller body (1020) of the first bag module (130) may consist of materials that allow for the first bag module to act as a foam roller for any kind of myofascial release massage. Such materials may be selected from, but not limited to: EVA (Ethylene vinyl acetate); EPE (Expanded Polyethylene Foam); PPE (polyphenylene); PVC (Polyvinyl chloride); rubber; foam; styrofoam; paper; metal; carbon fiber; nylon; fiberglass; polyester; polymers; plastics; graphite; thermoformable materials; elastomers; shape-memory alloys; aramid fibers (e.g. Nomex® or Kevlar®); aluminium and lightweight metals; or combinations thereof. In other embodiments the materials of roller body (1020) may be highly environmental by being recycled, recyclable or biodegradable and such materials may be selected from, but not limited to: cork; paper; pulp; bamboo; coconut fibers; hemp; wheat straw; carrot fiber; mycelium; cardboard; wood; natural rubber; cotton; wool and other fabrics; leather; plant fibers; bioplastics; cellulose; recycled aluminium and other recycled lightweight metals; jute; biocomposites; or combinations thereof. In other embodiments the materials of roller body—(1020) may be materials that transform movement and deformation into energy such as quartz piezoelectrics or alike, so the energy is stored in said power sources as additional components of the bag module. One of ordinary skill in the art would appreciate that there are numerous possible ways to provide the finish texture and look to the roller body (1020), and embodiments of the present invention are contemplated for use with any such component or configuration.

According to some embodiments of the present invention the roller body (1020) of the first bag module (130) may consist of materials with non-slippery properties or may include treatments for waterproofing, bacteria, anti-scratch, stain or heat resistance.

According to some embodiments of the present invention a second module (2020) may comprise a main body portion defined by a first end at one end of the main body portion and by a second end at the opposite end of the main body portion, a storage area formed inside of the main body portion, one or more module connectors, one or more lids (120) at the end points of said main body portions, and one or more access points (111) that provide access to the storage area.

According to some embodiments of the present invention the second bag module (2020) may comprise a first end of the second bag module, located at the first end of the main body portion of the second bag module, and a second end of the second bag module, located at the second end of the main body portion of the second bag module. In some embodiments the second bag module is connected with the first bag module (130) at a first connection area (1701). Such connection may be located at the second end of the main body of the second bag module. The access points (111) of the second bag module may be located at the first end of the second bag module. In some embodiments the second bag module (2020) includes a telescoping functionality such that the first end of the second bag module collapses into the second end of the second bag module, or vice versa.

According to some embodiments of the present invention, the first bag module is configured to have the second bag module aligned at either end of the first bag module.

According to some embodiments of the present invention the telescoping function of the second bag module would allow said second bag module to collapse or slide inside the first bag module to reduce the overall size of the entire bag (100). In some embodiments the side of the main body portion of the second module has an accordion-like shell or side walls that permits the main body of the second module to be compressed or reshaped. In some embodiments the bag (100) with said first and second modules may be collapsible into the size of the first bag module due to the telescoping nature of the second bag module. In another embodiments the telescoping functionality could be used to provide an adaptable in size of the second bag module and the final the bag (100). The possibility of the bag to enlarge its geometry and define housings of different sizes permits the transportation of the elongated article and the introduction of less volumetric articles when it is not being used for transportation of the elongated article. A function to an object that usually would be stored occupying a valuable space is thus provided. Some articles may be stored inside the first bag module while the bag is compressed and being used as a foam roller. One of ordinary skill in the art would appreciate that there are a number of benefits to incorporating a telescoping functionality into the second bag module, and embodiments of the present invention may be configured to take advantage of any such benefit.

According to some embodiments of the present invention the second bag module may be fully removable at the first connection area (1701) from the first bag module while in other embodiments the second bag module (2020) may be partially or permanently fixed to the first bag module. The connection at the first connection area (1701) between the second bag module and the first bag module in the embodiments that are not permanently attached may differ depending on the use but could consist of zips, male-female connectors, magnets, pressure fitting, friction fitting, snap fit connectors, clip connectors, latches, buckle connectors, electronic connectors, password locks of any kind, rubber connectors, threads, clamps or other mechanical-based connectors, e.g. velcro. In some examples the connectors of said bag module at the first connection area (1701) may be located at the inside of either the first or the second bag modules while in other examples the connectors may be located at the outer surface of either modules. In some examples the connectors may be located at lateral sides of the modules at the connection area (1701). In some examples, both first and second bag module may be provided with corresponding connectors for establishing a detachable connection between each other. In other examples the connectors may be located in a combination of the positions hereinbefore. In some examples both first and second bag module may physically and directly touch each other while in other examples the first and second bag module may not have a direct physical contact between each other and may just be connected through one or more appropriate corresponding connectors. In some examples, the second bag module is connected to the first bag module permanently by being glued, sewed or alike to put together the first and second bag module at the connection area (1701). One of ordinary skill in the art would appreciate that there are numerous possible ways to provide a connection between said first and second modules, and embodiments of the present invention are contemplated for use with any such component or configuration.

According to some embodiments of the present invention, one of the end points of the first bag module is connected at the first connection area (1701) to the second end of the second bag module (2020). Some embodiments may comprise a second module with one or more side straps (3020) that are foldable and that act as additional connectors with the first bag module by connecting, at the second end of the second module, to the first bag module at a connection device (3050) located at one of the end points of the first bag module. In some embodiments, the said connection devise device (3050) of the first bag module (130) may be an inverted U-shape device that allows for the side strap of the second module (3020) to slide through said U-shape connection device (3050) and to fold back, once on the other side of the connection device (3050), in the direction of the first end of the second module. The interlocking mechanism as a result of said side straps (3020) of the second module passing through the connection device (3050) of the first module, allows for the telescoping of the second bag module. In some other embodiments, the said locking mechanism may be created by substituting the inverted U-shape connection device (3050) by a hole on the first bag module, a ring or a similar element so as the side straps (3020) of the second bag module to go through such said connection device (3050). One of ordinary skill in the art would appreciate that there are numerous possible ways to create a locking mechanism between the first bag module and the second bag module by having the side straps (3020), and their connection with the first bag connectors, as the source of the telescoping feature of the second bag module, and embodiments of the present invention are contemplated for use with any such component or configuration. In one embodiments the second bag may include two side straps in opposite sides of the second bag while in other embodiments there might be four side straps, one in each quadrant of the horizontal section of the second bag module.

According to some embodiments of the present invention one or more side straps (3020) may comprise a longitudinal axis defined by a first longitudinal end point and a second longitudinal end point at the opposite end of the longitudinal axis, a flexible and foldable material that connects both end points and one connector at one or both of each end points of said side straps. In some embodiments the side straps may be a rope, a line, a cord or any element that is foldable and longitudinal in nature. In some embodiments a first end point of said side straps may be fixed at first end of the second bag module while the second end point of the said side straps (3020) may be movable to allow sliding through the connection devices (3050) of the first bag module and folding back towards the first end of the second module. In some embodiments the second end point of the side straps (3020) may include a locking mechanism or a fastening system (3030) that allows to lock said side straps (3020) to any other part of the outer surface of the second bag module, to the sides of the second module or to the lid of the module located at the first end of said second module, or even to the side of the first bag module. When the side strap is pulled out from its second end point, at the fastening system (3030), it serves to securely position and hold the second bag module in the collapsed state, whereas when the side strap is pulled from its first end point, the pulling serve to extend the telescoping second bag module to the extended position. The fastening system (3030) at the second end point of the side strap may be selected from knots; clasp; hook; staple;

screws; clips; rings; straps; velcro; male-female systems; magnetic solutions; zippers; male-female connectors; pressure fitting; friction fitting; snap fit connectors; clip connectors; latches; buckle connectors; electronic connectors; rubber connectors; threads; clamps; password locks; biometric locks; digital, electronic, magnetic or mechanical password locks; or other mechanical-based connectors.

According to some embodiments of the present invention one or more side straps (3020) may have the same or less length as the diameter of the lid of the second module. In such case, the fastening system (3030) to hold the side straps (3020) and avoid the second module to telescope may lock at the lid of said second module. In other embodiments the length of the side straps (3020) of the second bag module may be longer than the diameter of the lid of the second module. In such case the fastening system (3030) at the second end of the side straps (3020) locks at the exterior surface of the roller body (1020).

Figure 36A:
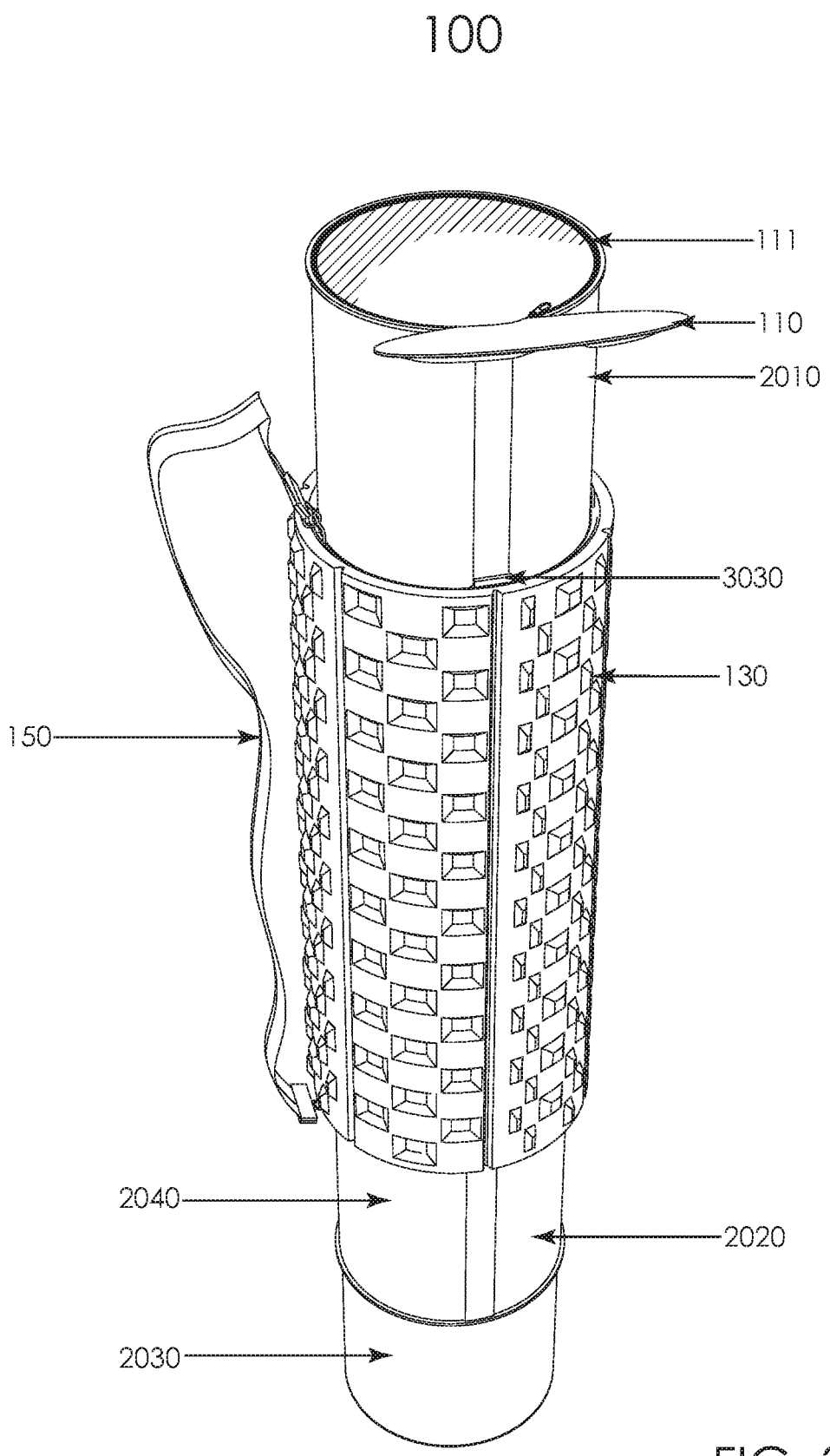
FIG. 36*a* shows the bag opened at the third bag module and the storage cavity created inside the bag.
Figure 36B:
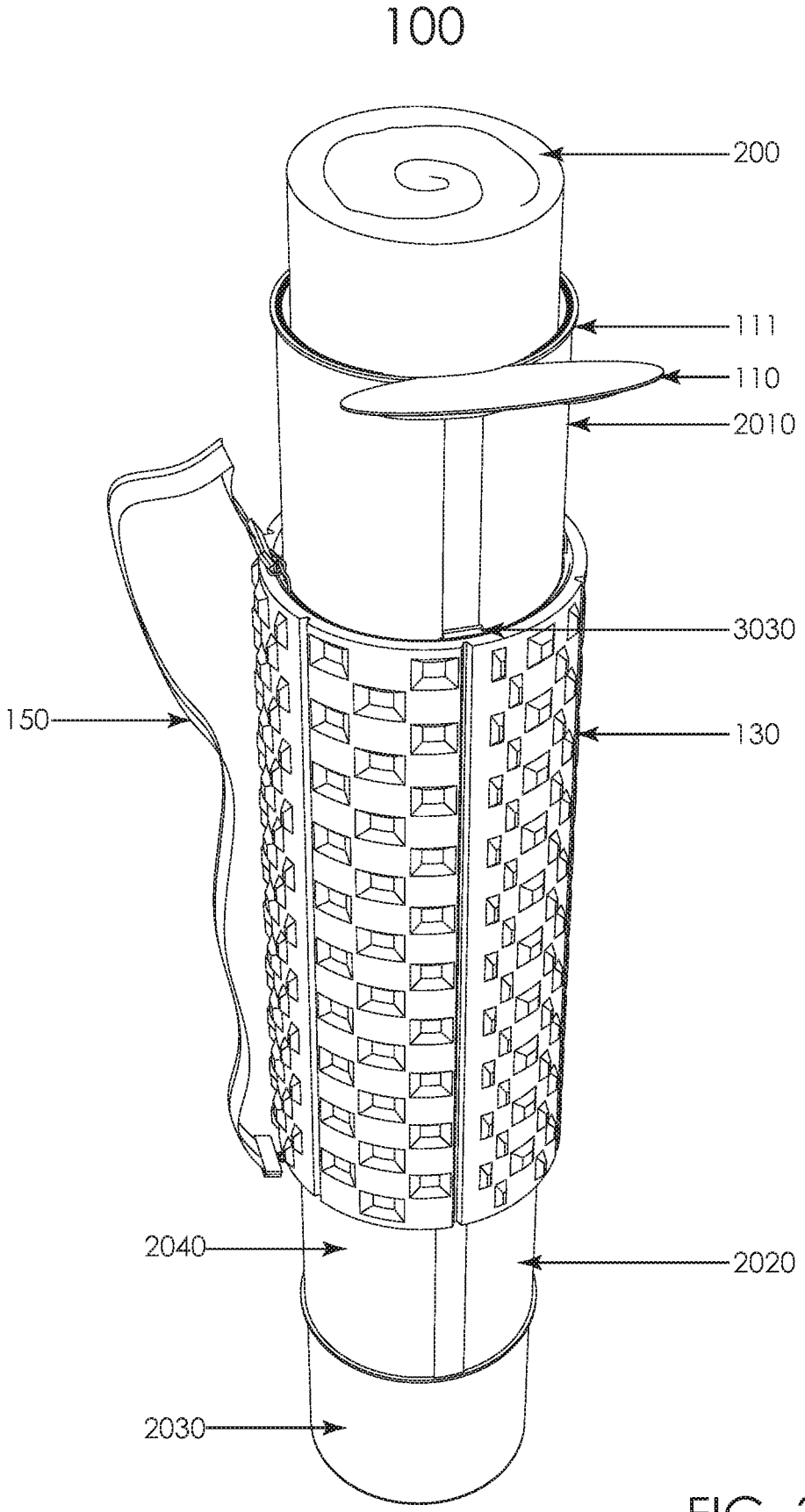
FIG. 36*b* shows the bag opened at the third bag module and a yoga mat being placed inside the storage cavity inside the bag.

Turning now to FIGS. 36*a*-36*b*, they shows the bag (100) in a extended configuration, comprising a first bag module (130), a second bag module (2020), that comprises a first bag sub-module (2030) and a second bag sub-module (2040), a third bag module (2010) and a strap (150) to carry the bag (100). The FIG. 36*a* shows the lid (110) of the third bag module in a opened position with the zip (111) at said lid opened and the storage area of the third bag module being exposed. The FIG. 36*b* shows an object being introduced in the storage of the third bag module. Such storage in this figure is connected to the first bag module, while the storage of the second bag module is not connected to the first bag module storage due to an inner lid that separates the storage area of both first and second bag module. In the FIG. 36*b* the object being introduced in the storage area, created by the combination of the storage area of the third and first modules, is a yoga mat (200) or a garment in a rolled position.

Figure 37A:
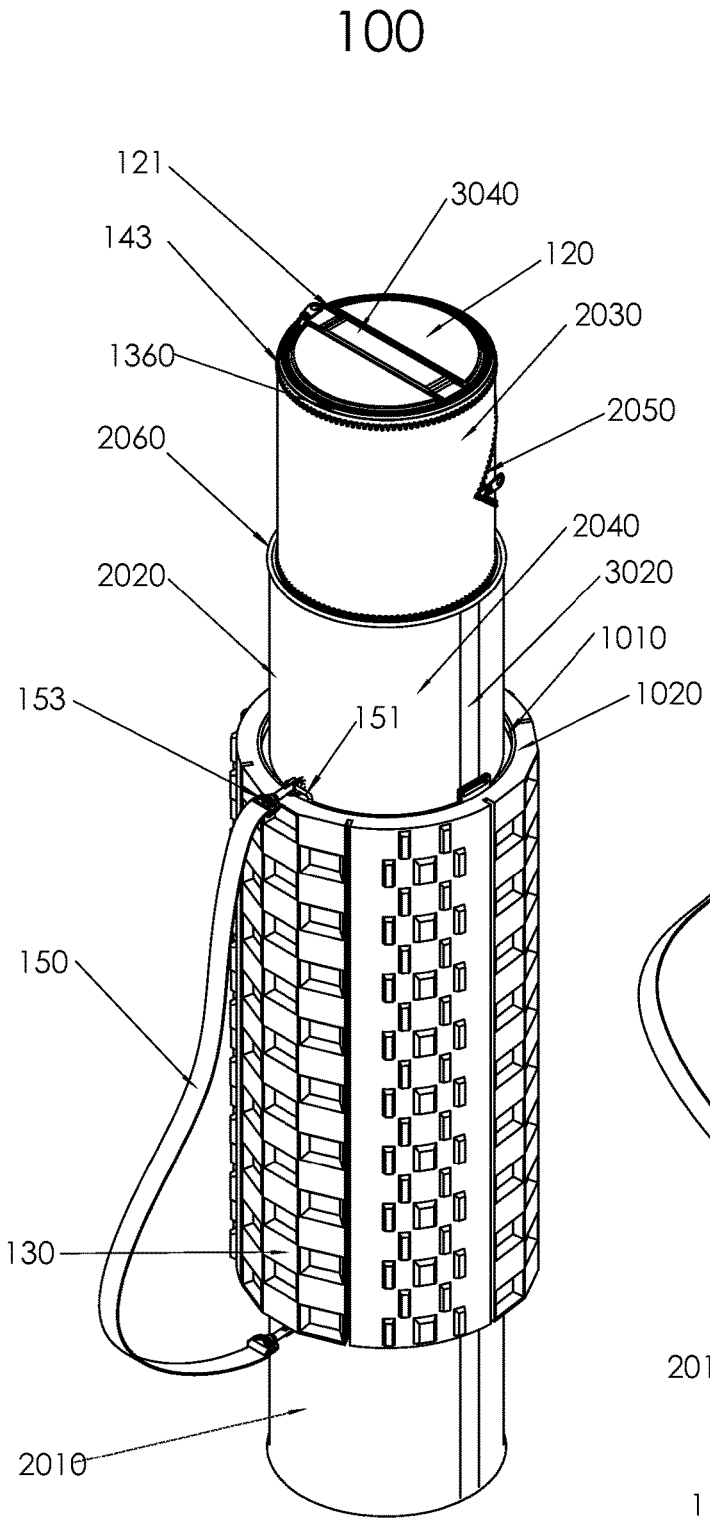
FIG. 37*a* shows an extended configuration of the foam roller with three bag modules and a holding device to carry the bag. The figure presents the second bag module on top.
Figure 37B:
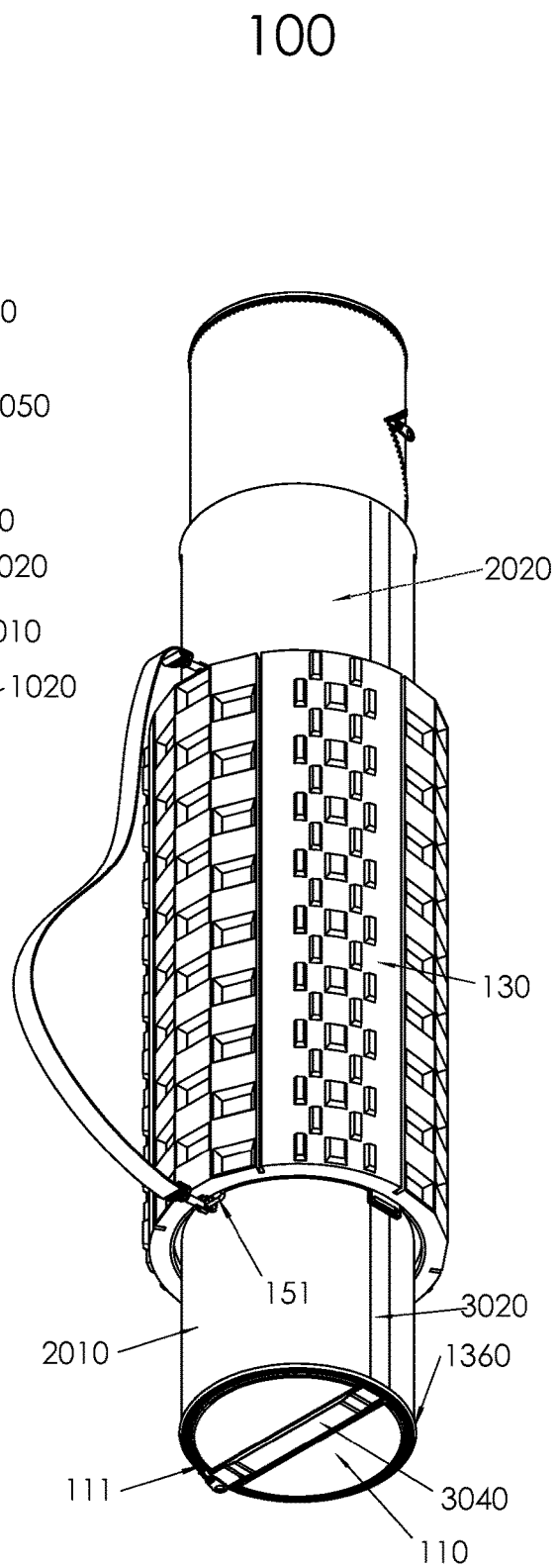
FIG. 37*b* shows the extended configuration of the foam roller with three bag modules and a holding device to carry the bag; The figure presents the same bag rotated with the third bag module on top.

Turning now to FIGS. 37*a*-37*b* show an extended configuration of the bag (100) with three bag modules. The first bag module (130) comprises a roller core (1010) and a roller body (1020). The roller body may have texture or may be fully flat (1030). The second bag module (2020) may be telescoping in nature and may have two sub-modules that telescope into each other, a first sub-module (2030) and a second sub-module (2040), connected to each other at a connector (2060). The first sub-module at the second bag may include a lid (120) to close the storage cavity inside the said sub-module. The closure of said storage cavity may be accomplished by a zip (121). Such lid may include a holding device (3040) and may also include when necessary a ring (1360) to provide rigidity to the lid and the overall sub-module and the second bag module. Said lid may include electronic displays, drawings or diagrams (143). The first sub-module may be telescoping in nature by a zip (2050) that allows such telescoping. The second bag module (2020) may include a side strap (3020) that allows for the telescoping of the second sub-module (2040) into the first bag module (130). The third bag module (2010) may include a side strap (3020) that allows for the telescoping of the third bag module (2010) into the first bag module (130). The third bag module (2010) may include a lid (110) to close the storage cavity inside the said third module. The closure of said storage cavity may be accomplished by a zip (111). Such lid may include a holding device (3040) and may also include when necessary an element, or ring (1360) to provide rigidity to the lid and the overall third bag module. The bag (100) also comprises of a holding element (150) to carry the bag connected to the bag through a connection device (153), located at said holding element, and connected to the bag at a connection device at the first bag module (151);

According to some embodiments of the present invention a second bag module (2020) may consist of soft or rigid materials that allow the telescoping feature. In some embodiments, a given second bag module could use different materials, finishes or opacities on the outside and inside surfaces of the module or throughout different parts of the module. One of ordinary skill in the art would appreciate that there are many suitable materials that could be used to fabricate a telescoping bag module, and embodiments of the present invention are contemplated for use with any such material.

According to some embodiments of the present invention a second module (2020) may comprise an outer surface that allows the possibility of incorporating features such as texts, diagrams, textures, drawings and patterns, technical or installation descriptions, bar codes, QR codes, art representations, logos or specific colours located at the outer surface of said second module. Such second module may include other elements like digital screens, electronic ink displays, note boards, mirrors of different types, touch devices or similar.

According to some embodiments of the present invention a second bag module (2020) may comprise one or more access points (121) that provide access to the storage area of said second bag module. Said access point may be formed at either lids (120) located at the end of the bag module, the side wall of the main body portion of the second bag module, at the main body of the first bag module, or any combination thereof is provided. In some embodiments, the access point may be formed as an opening at the first end of the second bag module, opposite to the second end of the second module, where it occurs the connection between the first bag module and the second bag module. In some embodiments, an access point and lid (182) may be existing in the first (1701) or second (1702) connection area between the first bag module and the second or third bag module, allowing the storage of both modules to connect or to be separate.

According to some embodiments of the present invention said access points may be secured with a cap, latch, strap, buckle, clip, zipper, magnet, or any similar device that could be used to cover or secure an access point. In other embodiments the access point securing device may incorporate security measures that include, but are not limited to, biometric locks, digital, electronic, magnetic or mechanical password locks, and near-field communications where a user's electronic device is used to authorize access. One of ordinary skill in the art would appreciate that there are a variety of suitable access point securing device that could be used to secure an access point of a bag module, and embodiments of the present invention are contemplated for use with any such access point securing device.

According to some embodiments of the present invention, the lid of the second module located at the first end of such said second module may include an attachment accessory such as a carrying or pulling element (3040). In one embodiment, a carrying element could be any feature that could help a user carry, lift, or hold the second bag module or the total bag. In this embodiment the carrying elements might include, but are not limited to, handles, handle straps, collapsible pull handles, shoulder straps, back-pack straps, bandoliers, cords, grips, hooks, and similar elements and such carrying elements could be fixed or adjustable. Such elements may be used also to manually pull the second module while in a compressed configuration after releasing the locking and fastening system (3030) at the side straps (3020) of the second bag module.

According to some embodiments of the present invention, the lid of the second module located at the first end of such said second module may include an electronic or digital accessory such as a digital screen, an electronic ink display, a touch device or similar. One of ordinary skill in the art would appreciate that there are a variety of suitable electronic devises devices that could be used to display information, and embodiments of the present invention are contemplated for use with any such access point securing device.

According to some embodiments of the present invention, the second bag module (2020) may be comprised of two telescoping sub-modules, a first sub-module (2030) and a second sub-module (2040), with a telescoping device or connector (2060) that allows for both sub-modules to telescope into each other. Such telescoping device may differ depending on the use but could consist of zips, male-female connectors, magnets, pressure fitting, friction fitting, snap fit connectors, clip connectors, latches, buckle connectors, rubber connectors, threads, clamps or other mechanical-based connectors, e.g. velcro. One of ordinary skill in the art would appreciate that there are a number of possibilities to provide a bag module with two or more sub-modules that collapse and telescopes, and embodiments of the present invention may be configured to take advantage of any such benefit.

According to some embodiments of the present invention, at least one of the sub-modules of the second bag module (2020) may comprise a central body portion defined by a first end at one end of the central body portion and by a second end at the opposite end of the central body portion, a storage area formed inside of the central body portion, one or more connectors (2060) that connect with one of the other second bag sub-modules, and an opening at the first end of the sub-module that allows access to the storage area. In some embodiments said central body portion may be an expandable central element created by a flexible cover member that may extended and retracted or compressed by virtue of a zipper assembly (2050) that is such that when in an open mode it enables an expansion of the flexible cover member and when in a enclosed mode, enables a retraction of the flexible cover member. Thus, the overall dimensions of said sub-module of the second bag module may be adjusted by activation of the zipper assembly on said sub-module to either increase the storage space available or to reduce it to allow transportation and storage purposes. This also allows to adapt the length of the total sub-module and of the bag to the length of the object being transported so there is no empty space inside the storage area and so the object being transported does not move inside while the transportation occurs.

According to some embodiments of the present invention, the second bag module may be comprised of two sub-modules and a lid (121) at the first end of the second bag module. The location of said lid allows to access the storage area inside the second bag module independently of whether the sub-modules are compressed or expanded, allowing for an easy access to the objects stored inside, regardless of the configuration of the sub-modules.

According to some embodiments of the present invention, at least one of the sub-modules of the second bag module (2020) may comprise an opening at the first end of the sub-module that allows access to the storage area of said sub-module. In some embodiments said opening may be covered with a lid to protect the inside storage area. In some other embodiments said lid of the second sub-module of the second bag module may be the same as the lid of the second bag module, in which case the lid allows to access the storage area inside the second bag module independently of whether the central element of the sub-module has been expanded or retracted and thus, it is easy to access to the objects stored inside regardless of the configuration of the sub-module.

According to some embodiments of the present invention, the first bag module (130) may comprise a first end of the bag module, a second end of the bag module, a storage area and a second bag module (2020) connected to said first module at either ends of the first bag module. In some embodiments either the first end or the second end of the first bag module may be opened allowing the storage area of the first bag module to be exposed to the outside of the bag. In other embodiments either ends of the first bag module may be closed with a permanent element or with a temporal lid that can be opened or fully removed by a fastening system that may be selected from knots; clasp; hook; staple; screws; clips; rings; straps; velcro; male-female systems; magnetic solutions; zippers; male-female connectors; pressure fitting; friction fitting; snap fit connectors; clip connectors; latches; buckle connectors; electronic connectors; rubber connectors; threads; clamps; password locks; biometric locks; digital, electronic, magnetic or mechanical password locks; or other mechanical-based connectors. In some embodiments the second bag module and the first bag module may share their storage area while in other embodiments any of the lids of the first module or the second module may be separating their respective storage areas. This solution allows to transport elements of different nature in each bag module like clean vs dirty clothes, yoga mats vs garments, or any other programmatic configurations. One of ordinary skill in the art would appreciate that there are a variety of configurations that could be used to separate the storage area of the first module and the storage area of the second module, and embodiments of the present invention are contemplated for use with any such access point securing device.

According to an embodiment of the present invention, a bag may be comprised of a first bag module (130), a second bag module (2020) and a third bag module (2010) wherein the third bag module is connected to the first bag module at a second connection area (1702) located at the opposite side of the first connection area (1701). Said third module may or may not incorporate a telescoping functionality to collapse into the first main module (130).

According to some embodiments of the present invention, the first bag module is configured to have the second bag module aligned at one end of the first bag module and to have the third bag module aligned at the opposite end of the first bag module.

According to some embodiments of the present invention a third module (2010) may comprise a main body portion defined by a first end at one end of the main body portion and by a second end at the opposite end of the main body portion and one or more module connectors. In some embodiments the third module may have an storage area formed inside of the main body portion of said third module while in other embodiments the third module may not have any storage area and may comprises at least one of selected from a group of electronic devices modules consisting of a speaker for connecting to external or internal audio device, a media player, a geolocation device, a digital display screen, an electronic ink display, a power source, a piezoelectric charger, a kinetic charger, a portable energy device, or and a battery charger.

According to an embodiment of the present invention, a bag may be comprised a third bag module with the same or similar characteristics of the second bag module while in other embodiments the third module may be different than the second bag module.

According to an embodiment of the present invention, a bag may be comprised of a first main body (130) with its storage area, a second bag module (2020) with its storage area, a third bag module (2010) with its storage area. In some embodiments the storage areas of all bag modules may be connected while in other embodiments some inner lid may be provided to separate the storage areas.

According to some embodiments of the present invention, the second bag module may include a supplemental storage compartment that is attached to the outer side wall of the bag module. In one embodiment, the supplemental storage compartment provides additional storage capacity beyond what is included in the interior of the bag module. In some embodiments, the supplemental storage compartment may be reversibly connectable to the second bag module, while in other embodiments of supplemental storage compartment is permanently fixed to the second bag module. In some embodiments, a bag module may include both permanent and removable supplemental storage compartments. In some embodiments the third module may the module having such supplemental storage compartment. One of ordinary skill in the art would appreciate there are many possible configurations for a supplemental storage compartment, and embodiments of present invention are configured for use with any such supplemental storage compartment.

According to some embodiments of the present invention, one or more bag modules may include an attachment accessory such as a carrying element (150). In one embodiment, one or more carrying elements could be any feature that could help a user carry, lift, or hold a bag module or the bag. In this embodiment carrying elements might include, but are not limited to, handles, handle straps, collapsible pull handles, shoulder straps, back-pack straps, bandoliers, cords, grips, hooks, and similar elements and such carrying elements could be fixed or adjustable. In some embodiments, the carrying element may be incorporated directly into the main body portion of a bag module. As an illustrative example, a carrying handle could be formed in or on the bag module. In some embodiments, the carrying element may be reversibly attachable to a bag module by attaching at an accessory attachment point (151) that is formed in or on a bag module. The accessory attachment point might also be a component that is separately attached to a bag module. In some embodiments, the accessory attachment point may be configured on the carrying element, for example a shoulder strap that has clips on each end (153). In some embodiments the carrying elements may be adjustable in length. This ensures adaptability of the handle system to the different size of people and also allows different handling postures or conditions, e.g. backpack or bandolier. One of ordinary skill in the art would appreciate that there are many ways of to attach or incorporate a carrying element on a bag module, and embodiments of the present invention are contemplated for use with any such carrying element.

Figure 38:
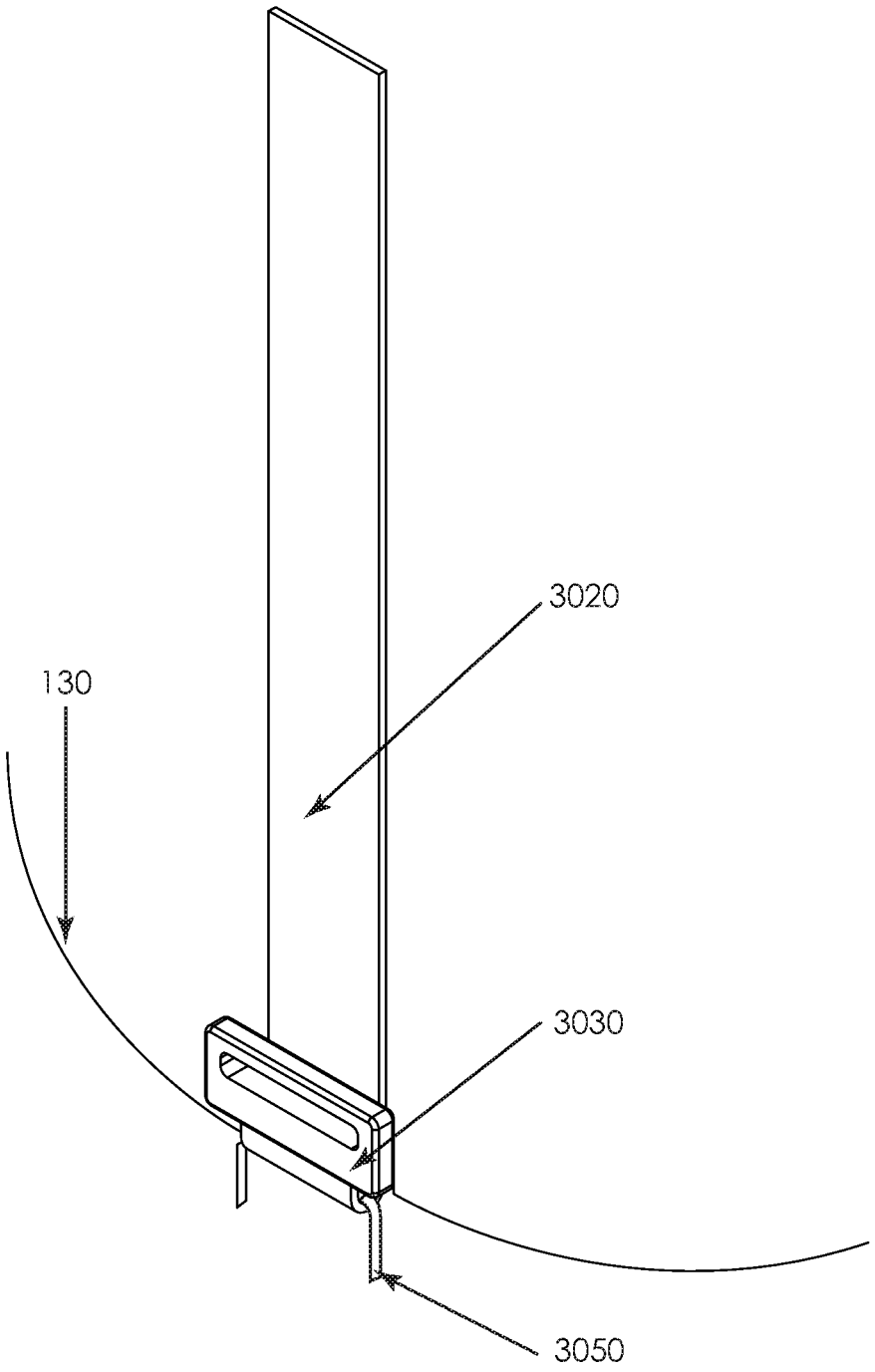
FIG. 38 shows the side strap of the second module and the connector to the first bag module.

Turning now to FIG. 38, it shows the interlocking mechanism between the side straps (3020) of the second or third bag module and the connector device (3050) at the first bag module. It also shows the connector (3030) located at one end point of the side straps (3020) wherein such connectors (3030) may be have a piece of substantial size to avoid the side straps (3020) to slip through the hole or U-shape created by the first bag's connector devices (3050). The connectors (3030) located at one end point of the side straps (3020) may include magnets or may have any other locking mechanism to allow them to close the bag. Such locking mechanism, could consist of zips, male-female connectors, magnets, pressure fitting, friction fitting, snap fit connectors, clip connectors, latches, buckle connectors, electronic connectors, password locks of any kind, rubber connectors, threads, clamps or other mechanical-based connectors, e.g. velcro.

Figure 39B:
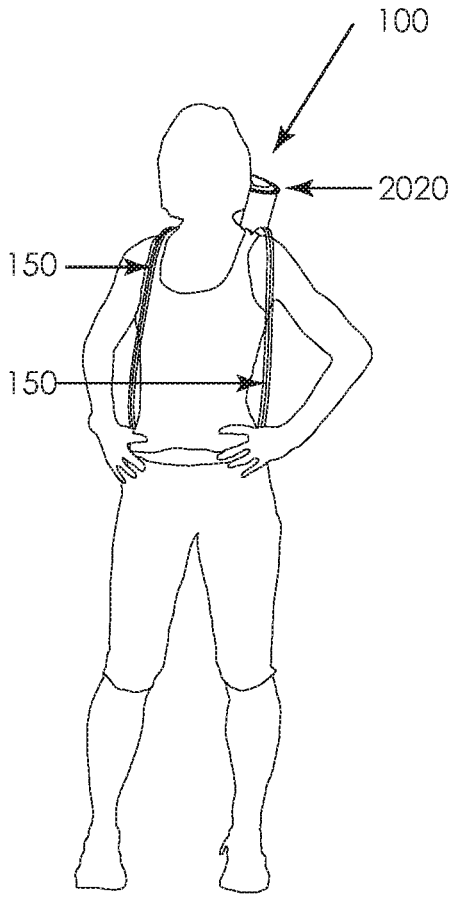
FIGS. 39*a*-39*b* shows a person carrying the foam roller with different handle positions.
Figure 39A:
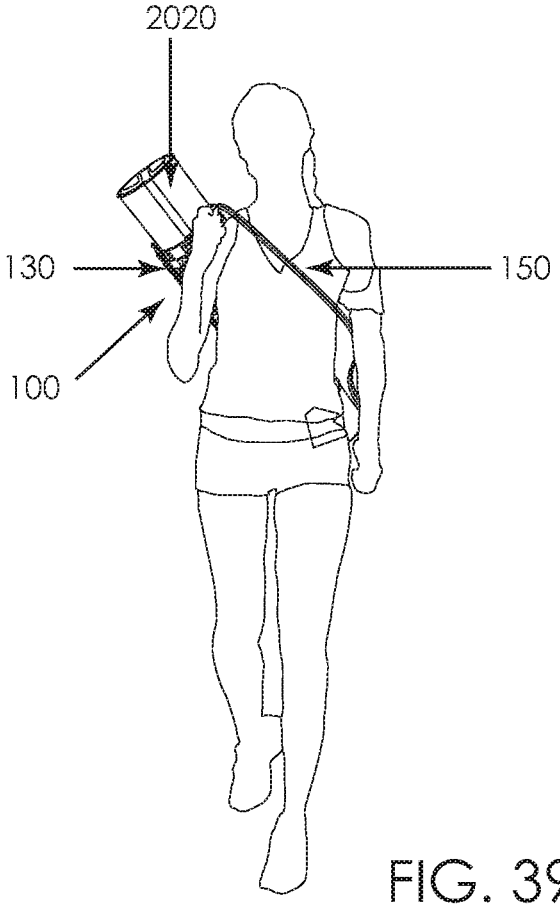
Figure 39C:
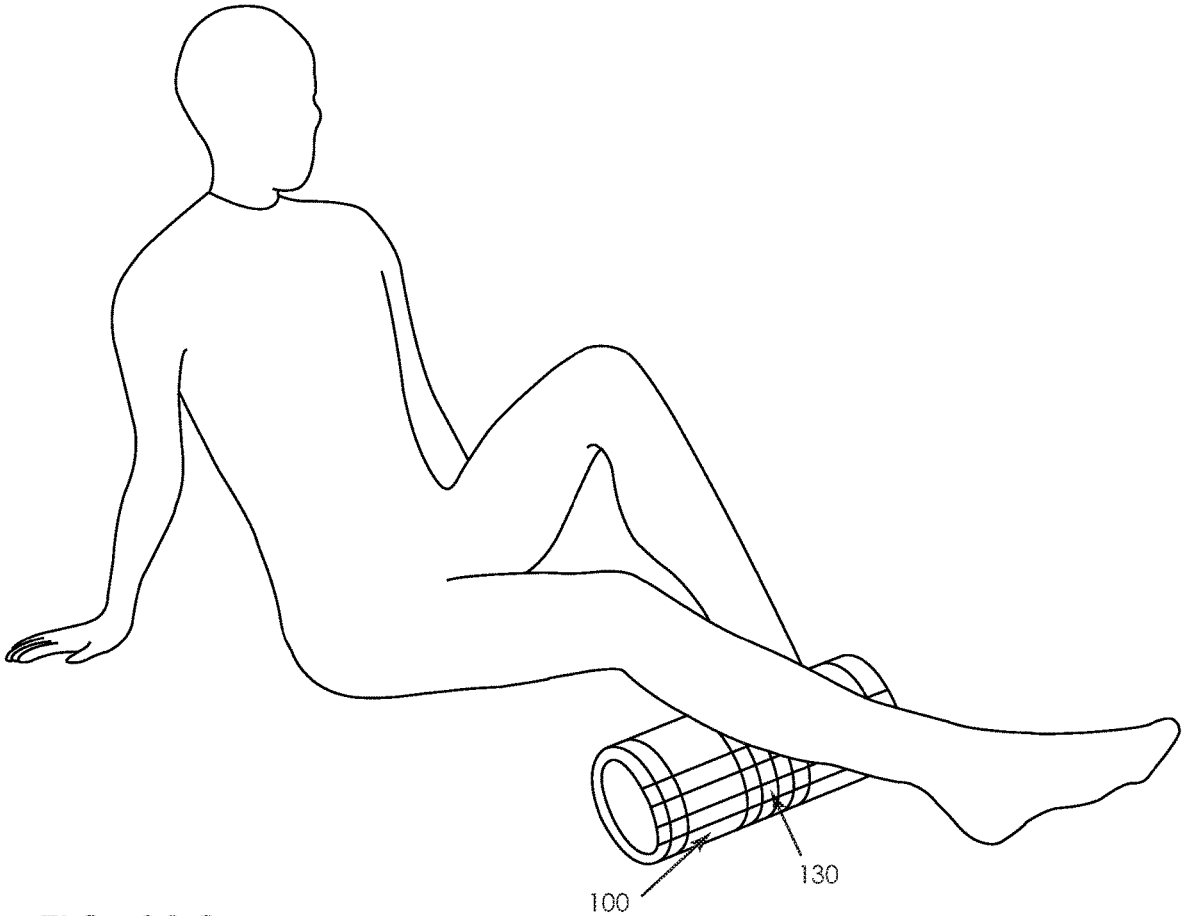
FIG. 39*c* shows a person using the bag in a compressed configuration as a foam roller.

Turning now to FIG. 39*a*-39*c*, they show the bag (100) being used for different functionalities. FIG. 39*a* shows a person carrying the expanded configuration of the bag (100), comprising a first bag module (130), a second bag module (2020) and a strap (150). FIG. 39*b* shows the same bag (100) being carried by two straps (150). FIG. 39*c* shows a person using the compressed configuration of the same bag (100) as a foam roller, where the first bag module, or main body, (130) may act as such foam roller.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A transportation bag comprising:

A first module comprising a hollow and longitudinal core defined by a first end point and a second end point at an opposite end of said first end point, a storage cavity formed inside said core, an exterior surface of said core, and one or more connectors;

A telescoping second module comprising a main body with an end point, a storage cavity formed inside said main body, an openable lid located at said end point of said main body that provides access to the storage cavity of said second module; and wherein the first module and the second module are configured to have the second module connected with the first module at one end of the first module; and wherein the exterior surface of said core of the first module comprises at last one massage zone.

2. The transportation bag of claim 1, wherein the exterior of said first module comprises a massage element selected from a group of massage elements consisting of serrations; longitudinal channels; circumferential channels and massage fingers.

3. The transportation bag of claim 1, wherein the exterior of said core of the first module comprises a plurality of massage zones.

4. The transportation bag of claim 1, further comprising a third module; and wherein the said first module is configured to have said third module connected at the first module.

5. The transportation bag of claim 4, wherein said third module comprises an electronic device that comprises at least one of a speaker for connecting to external or internal audio device; a media player; a geolocation device; a digital display screen; an electronic ink display; a power source; a piezoelectric charger; a kinetic charger; a portable energy device; and a battery charger.

6. The transportation bag of claim 4, wherein said third module comprises a storage cavity and an openable lid that provides access to said third module; and wherein said third module is a telescoping module or an accordion-like module.

7. The transportation bag of claim 1 further comprising a roller body on the exterior surface of the core of said first module.

8. The transportation bag of claim 7 wherein the material of said roller body is different to the material of the exterior surface of the core of said first module.

9. The transportation bag of claim 1 further comprising one or more connectors at the second module wherein said connectors allow to remove the second module from the first module.

10. The transportation bag of claim 1 further comprising an openable second lid located at said second module wherein said second lid separates the storage cavity of said first module and the storage cavity of said second module.

11. A transportation bag comprising:

a first module comprising a hollow and longitudinal main body, extending from a first end point to a second end point at an opposite end of said first end point, a rigid core, a storage cavity formed inside said core, and an exterior surface of said core;

a telescoping second module defined by a first end point and a second end point at an opposite end of said first end point, comprising a storage cavity, and a lid;

a roller body on the exterior surface of said first module, and wherein said roller body comprises at last one massage zone; and wherein said first module and said second module are configured to have said second module directly aligned at one end of the first module;

wherein said lid provides access to the storage cavity of said second module and to the storage cavity of said first module;

wherein the distance between said lid and said first module is larger in the extended configuration of the bag than in the compressed configuration; and wherein the bag is configured to assume an extended configuration for transportation of elongated articles, and a compressed configuration for use other than transportation of said elongated articles.

12. The transportation bag of claim 11, wherein said roller body comprises a massage element selected from a group of massage elements consisting of serrations; longitudinal channels; circumferential channels and massage fingers.

13. The transportation bag of claim 12, wherein said roller body comprises a plurality of massage zones.

14. The transportation bag of claim 11, further comprising a third module, wherein the said first module is configured to have said third module connected with the first module.

15. The transportation bag of claim 11, further comprising:

one or more connectors located at one end of the first module;

a second module body defined by said first end point of said second module and by said second end point of said second module;

an access to said storage cavity of said second module;

at least two side straps at said second module, each comprising a longitudinal axis defined by a first longitudinal end point and a second longitudinal end point at the opposite end of the longitudinal axis, a flexible and foldable material that connects both end points; and wherein the first end points of said side straps are permanently connected to said second module; and wherein each of said side straps go through said first module connectors, creating the telescoping feature of said second module by pulling said side straps from either longitudinal end points of said side straps.

16. A transportation bag comprising:

a main module comprising a hollow and longitudinal main body, a rigid core, a storage cavity formed inside said core, an exterior surface of said core;

a roller body located on the exterior surface of said main module, that comprises a massage zone that includes at last one massage element selected from a group of massage elements consisting of serrations; longitudinal channels; circumferential channels and massage fingers;

a holding element to carry the transportation bag; and a lid connected to at least two longitudinal straps that are connected to the main module;

wherein said straps create a telescoping functionality such that the distance between the lid and the main module is larger in the extended configuration than in the compressed configuration; and wherein the bag is configured to assume an extended configuration for transportation of elongated articles inside said storage, and for use as a massage roller in a compressed configuration.

17. The transportation bag of claim 16 wherein the material of said roller body is different to the material of the exterior surface of the core of said main module, and wherein the roller body comprises a plurality of massage zones.

18. The transportation bag of claim 16 wherein said straps are removable from the main module.

19. The transportation bag of claim 16 wherein said holding element is removable from the main module.

20. The transportation bag of claim 16 further comprising connectors at the main module, and wherein said straps go through said connectors, creating the telescoping feature by pulling said straps from either longitudinal end points of said straps; and wherein the telescoping feature provides an adaptable size of the transportation bag.

* * * * *